US008065046B2

(12) United States Patent
Bandyopadhyay et al.

(10) Patent No.: US 8,065,046 B2
(45) Date of Patent: Nov. 22, 2011

(54) OLIVO-CEREBELLAR CONTROLLER

(75) Inventors: Promode R. Bandyopadhyay, Middletown, RI (US); Sahjendra Singh, Henderson, NV (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 968 days.

(21) Appl. No.: 12/021,555

(22) Filed: Jan. 29, 2008

(65) Prior Publication Data

US 2009/0076670 A1 Mar. 19, 2009

Related U.S. Application Data

(60) Provisional application No. 60/994,093, filed on Sep. 17, 2007.

(51) Int. Cl.
*B60L 15/00* (2006.01)

(52) U.S. Cl. ..... 701/21; 701/1; 440/1; 440/13; 440/14; 440/53

(58) Field of Classification Search ..... 701/1, 21; 440/1, 13–17, 53, 84
See application file for complete search history.

(56) References Cited

U.S. PATENT DOCUMENTS

| | | | | |
|---|---|---|---|---|
| 5,401,196 | A * | 3/1995 | Triantafyllou et al. | 440/13 |
| 6,877,692 | B2 * | 4/2005 | Liu | 244/22 |
| 7,427,220 | B2 * | 9/2008 | Dudek et al. | 440/1 |
| 7,465,201 | B1 * | 12/2008 | Thivierge et al. | 440/42 |
| 7,869,910 | B1 * | 1/2011 | Bandyopadhyay et al. | 701/21 |
| 2004/0195440 | A1 * | 10/2004 | Liu | 244/72 |
| 2005/0106955 | A1 * | 5/2005 | Atmur | 440/38 |
| 2007/0078600 | A1 * | 4/2007 | Fregene et al. | 701/301 |
| 2008/0032571 | A1 * | 2/2008 | Dudek et al. | 440/12.5 |

OTHER PUBLICATIONS

A.L. Hodgkin and A.F. Huxley, A Quantitative Description of Membrane Current and It's Application to Conduction and Excitation in Nerve; journal, 1952, pp. 500-544, vol. 117.

A. Isidori, Nonlinear Control Systems, book, 1995, rd edition, Springer-Verlag, New York.

A. Isidori and C.I. Byrnes, Output Regulation of Nonlinear Systems, article, 1990, pp. 131-140, vol. 35, IEEE Trans. on Automatic Control.

V.B. Kazantsev, V.I. Nekorkin, V.I. Makarenko, and R. Llinas, Olivo-Cerebellar Cluster-Based Universal Control System, article, Oct. 2003, pp. 13064-13068, vol. 100, No. 22, Proc. National Academy of Science.

(Continued)

*Primary Examiner* — Khoi Tran
*Assistant Examiner* — Jonathan L Sample
(74) *Attorney, Agent, or Firm* — James M. Kasischke; Michael P. Stanley; Jean-Paul A. Nasser

(57) ABSTRACT

Non-linear control laws are disclosed and implemented with a controller and control system for maneuvering an underwater vehicle. The control laws change the phase of one Inferior-Olive (IO) neuron with respect to another IO. One control law is global, that is, the control law works (stable and convergent) for any initial condition. The remaining three control laws are local. The control laws are obtained by applying feedback linearization, while retaining non-linear characteristics. Each control law generates a profile (time history) of the control signal to produce a desired phase difference recognizable by a controller to respond to disturbances and to maneuver an underwater vehicle.

7 Claims, 48 Drawing Sheets

OTHER PUBLICATIONS

V.B. Kazantsev, V.I. Nekorkin, V.I. Makarenko, and R. Llinas, Self-Referential Phase Reset Based on Inferior Olive Oscillator Dynamics, article, Dec. 2004, pp. 18183-18188, vol. 101, No. 52, Proc National Academy of Science.
Y. Loewenstein, Y. Yarom, and H. Sompolinsky, The Generation of Oscillations in Networks of Electrically Coupled Cells, article, 2001, pp. 8095-8100, vol. 98, No. 14, Proc. National Academy of Science.
Y. Manor, J. Rinzel, I. Segev, and Y. Yarom, Low-Amplitude Oscillations in the Inferior Olives: A Model Based on Electrical Coupling of Neurons with Heterogenous Channel Densities, article, 1997, pp. 2736-2752, vol. 77, Journal of Neurophysiology.
M.Narasimhan, H. Dong, R. Mittal and S.N. Singh, Optimal Yaw Regulation and Trajectory Control of Biorobotic AUV Using Mechanical Fins Based on CFD Parameterization, article, 2006, pp. 687-698, vol. 128, Journal of Fluids Engineering.
H. Nijmeijer and A.J. Van Der Schaft, Nonlinear Dynamical Control Systems, book, 1990, Springer-Verlag, New York.
D. Ruelle, Elements of Differentiable Dynamics and Bifurcation Theory, Book, 1989, Academic Press, New York.
N. Scheighofer, K. Doya, H. Fukai, J.V. Chiron, T. Furukawa, and M. Kawato, Chaos May Enhance Information Transmission in the Inferior Olive, article, 2004, pp. 4655-4660, vol. 101, No. 13, Proc. National Academy of Science.
S.N. Singh and W.J. Rugh, Decoupling in a Class of Nonlinear Systems by State Variable Feedback, article, 1972, ASME, Trans. Journal of Dynamics, Measurement and Control.
J.J. Slotine and W. Li, Applied Nonlinear Control, book, 1991, Prentice-Hall, Englewood Cliffs, New Jersey.
A. Pellionisz and R. Llinas, Brain Modeling by Tensor Network Theory and Computer Simulation. The Cerebellum: Distributed Processor for Predictive Coordination, article, 1979, pp. 323-348, vol. 4, Pergamon Press Ltd., Great Britain.
A. Pellionisz and R. Llinas, Tensorial Approach to the Geometry of Brain Function: Cerebellar Coordination Via a Metric Tensor, article pp. 1125-1136, vol. 5, No. 7, Pergamon Press, New York.
Promode R. Bandyopadhyay, Trends in Biorobotic Autonomous Undersea Vehicles, article, 2005, pp. 109-135, vol. 30, No. 1, IEEE Journal of Oceanic Engineering, USA.
V.I. Makarenko, J.P. Welsh, E.J. Lang and R. Llinas, A New Approach to the Analysis of Multidimensional Neuronal Activity: Markov Random Fields, article, 1997, pp. 785-789, vol. 10, No. 5, Elsevier Science Ltd. Great Britain.
A. Pellionisz and R. Llinas, A Note on a General Approach to the Problem of Distributed Brain Function, article, Dec. 1979, pp. 48-50, The Matrix and Tensor Quarterly, USA.
Elena Leznik, Vladimir Makarenko and Rodolfo Llinas, Electrotonically Mediated Oscillatory Patterns in Neuronal Ensembles: An in Vitro Voltage-Dependent Dye-Imaging Study in the Inferior Olive, article, Apr. 1, 2002, pp. 2804-2815, The Journal of Neuroscience, USA.
A. Pellionisz and R. Llinas, Space-Time Representation in the Brain. The Cerebellum as a Predictive Space-Time Metric Tensor, article, 1982, pp. 2949-2970, vol. 7, Pergamon Press Ltd, Great Britain.
R. Llinas and A. Pellionisz, Cerebellar Function and the Adaptive Feature of the Central Nervous System, article, pp. 223-375, Elsevier Science Publishers, New York.
Vladimir Makarenko and Rodolfo Llinas, Experimentally Determined Chaotic Phase Synchronization in a Neuronal System, Dec. 1998, pp. 15747-15752, vol. 95, Proc. National Academy Science, USA.
A. Pellionisz and R. Llinas, Tensor Network Theory of the Metaorganization of Functional Geometries in the Central Nervous System, 1985, pp. 245-273, vol. 16, No. 2., Neuroscience, Great Britain.
Andras Pellionisz and Rodolfo Llinas, Tensor Theory of Brain Fucntion, The Cerebellum as a Space-Time Metric, Conference, Feb. 15-19, 1982, pp. 394-417, Kyoto, Japan.

* cited by examiner

OLIVO-CEREBELLAR CONTROLLER

This application claims the benefit of U.S. Provisional Patent Application Ser. No. 60/994,093, filed on Sep. 17, 2007 and which is entitled "Olivo-Cerebellar Controller" by the inventors, Sahjendra Singh and Promode R. Bandyopadhyay.

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

This application relates to U.S. patent application Ser. No. 11/901,546, filed on Sep. 14, 2007 and which is entitled "Auto-catalytic Oscillators for Locomotion of Underwater Vehicles" by the inventors Promode R. Bandopadhyay, Alberto Menozzi, Daniel P. Thivierge, David Beal and Anuradha Annnaswamy.

BACKGROUND OF THE INVENTION (1) Field of the Invention

The present invention relates to a controller and control system for an underwater vehicle; specifically, a controller and control system which utilize non-linear dynamics supported by underlying mathematics to control the propulsors of an underwater vehicle.

(2) Description of the Prior Art

Future underwater platforms are expected to have numerous sensors and performance capabilities that will mimic the capabilities of aquatic animals. A key component of such platforms would be their controller. Because such platforms, and an existing U.S. Navy Biorobotic Autonomous Undersea Vehicle (BAUV) is an example, keep station in highly disturbed fields near submarines or in the littoral areas, it is essential for the platforms (vehicles) to have quick-responding controllers for their propulsor systems.

Hydrodynamic models based on conventional engineering controllers have not been able to produce the desired levels of control. Thus, a biology-inspired controller is a realistic alternative. Because the brains of animals perform complex tasks which rely on nonlinear dynamics, the underlying mathematics provide a foundation for the controller and control system of the present disclosure.

Traditional control systems are designed using linear models obtained by Jacobian linearization. This linearization allows design using frequency domain techniques (such as lag-lead compensation, PID feedback, etc.) and a state-space approach (linear optimal control, pole assignment, servo-regulation, adaptive control, etc.). However, any controller designed using linearized models of the system will fail to stabilize unless the perturbations are small.

One must use nonlinear design techniques if the control system is to operate in a larger region. For underwater vehicles, linear and nonlinear control systems based on pole placement, feedback linearization, sliding mode control, and adaptive control, etc. have been designed. However, in these designs, it is assumed that the vehicle is equipped with traditional control surfaces. As such, these vehicles have limited maneuvering capability.

For large and agile maneuvers, traditional control surfaces are inadequate and new control surfaces must be developed. Observations of marine animals provide the potential of fish-like oscillating fins for the propulsion and maneuvering of autonomous underwater vehicles (AUVs). AUVs exist with multiple oscillating fins which impart high lift and thrust. The oscillatory motion of the fins or propulsors is obtained by inferior olives which provide robust command signals to controllers and servomotors of the fins.

Inferior olives have complex nonlinear dynamics and have robust and unique self-oscillation [(Limit Cycle Oscillation (LCO)] characteristics. Efforts have been made to model the inferior olives (IO). Limited results on phase control of IOs in an open-loop sense are available using a pulse type stimulus. However, the required pulse height of the input signal which depends on the state of the IOs at the switching instant as well as the target relative phase between the IOs has not been derived. For the application of the IOs to the AUV, closed-loop control systems must be developed for the synchronization and phase control of the IOs.

SUMMARY OF THE INVENTION

It is therefore a general purpose and primary object of the present invention to provide control laws for the synchronization and phase angle control of multiple inferior olives (IO) used in a maneuvering controller or control system of an underwater vehicle;

It is a further object of the present invention to provide non-linear control laws that the controller or control system can use to change a phase of one IO with respect to another IO; and It is a still further object of the present invention to provide a global control law for a controller to use in maneuvering an underwater vehicle; and It is a still further object of the present invention to provide a local control law for a controller to use in maneuvering an underwater vehicle.

In order to attain the objects described, the present invention provides closed-loop control of multiple inferior olives (IOs) for maneuvering a Biorobotic Autonomous Undersea Vehicle (BAUV). A model of an ith IO is described where variables are associated with sub-threshold oscillations and low threshold spiking. Higher threshold spiking is also described.

For the sake of simplicity, the synchronization of only two IOs is considered, but it is seen that the approach is extendable for the synchronization of any number of IOs.

In optimizing the controller or control system for maneuvering, the state vector for the ith IO is defined and a nonlinear vector function and constant column vector are obtained. Synchronization is defined by first considering the synchronization of two IOs having arbitrary and possibly large initial conditions. Note that if a delay time is zero, the IOs oscillate in synchronism with a relative phase zero. However, if one sets the delay time, the $IO_1$ will oscillate lagging behind the $IO_2$ with a relative phase angle. Although, the convergence of the synchronization error has been required to be only asymptotic; for practical purposes, it will be sufficient if one can design a control system for the $IO_1$ which is sufficiently fast.

In the disclosure, four control systems are presented for the synchronization of two IOs based on an input-output feedback linearization (nonlinear inversion) approach. For the purpose of the design of the controller or control system, output variables associated with the nonlinear system. It is shown that the choice of the output variable is important in shaping the behavior of the closed-loop system; although, by following the approach presented, various input-output linearizing control systems can be obtained.

The derivation of a control law is considered for the global synchronization of the $IO_1$ with the reference $IO_2$. It is desired to design a synchronizing control system such that $IO_1$ oscillates in synchronism with a delay time corresponding to a desired phase angle with respect to the reference $IO_2$. In global synchronization, the synchronization is accomplished for all values of initial conditions of the two IOs. The output function is a function of the state vectors of $IO_1$ and $IO_2$. This choice of the output yields the global result.

For the nonlinear closed-loop system, the output satisfies a fourth order linear differential equation. One can choose larger gains to obtain faster convergence to zero. For the chosen output, because the system is of dimension four and the relative degree is four, the dimension of the zero dynamics is null. The zero dynamics represent the residual dynamics of the system when the output error is constrained to be zero.

The frequency of oscillation of the IOs depends on the system parameters. Signals of different frequencies can be obtained by time scaling. In the disclosure it is observed that the IOs are not initially in phase. As the controller switches, the IOs synchronize. However, as the command changes, it causes larger deviations in the tracking of trajectories due to a large control input.

The controller or the control system uses feedback of nonlinear functions of state variables and has a global synchronization property. The complexity and performance of the controller depends on the choice of the output function.

The IOs will synchronize if the equilibrium point is asymptotically stable (globally asymptotically stable). For asymptotic analysis, ignoring a decaying part, which represents the deviation of a trajectory from, a periodic signal can be represented by a Fourier series. Moreover, the amplitude of the harmonic converges to zero and for stability analysis a finite number of harmonics will suffice.

A simple control law has linear feedback terms involving only $\tilde{z}$ and $\tilde{w}$ variables and are independent of $u_i$ and $v_i$ variables. The output $\tilde{w}$ satisfies a first-order equation and in the closed-loop system $\tilde{w}$ tends to zero. However, the stability in the closed-loop system will depend on the stability property of the zero dynamics. Apparently if the origin $(\tilde{u}, \tilde{v}, \tilde{z})=0$ of the zero dynamics is asymptotically stable, then $\tilde{x}$ converges to zero as $\tilde{w}$ tends to zero.

The relative merits of the four controllers are such that the first controller has a global stabilization property and the remaining controllers have established local synchronization. It is expected that as the complexity of control law increases, the region of stability enlarges. For this reason, one expects that the control law can accomplish synchronization for relatively small perturbations at the instant when the phase command is given. Of course, the error, and therefore the synchronization of the IOs, depends on the instant of controller switching. Based on simulation results, it has been found that two control laws for the controllers have fairly large regions of stability and one control law does not necessarily have to use another control law.

Unlike the global control laws for the controller, the local control laws provide smoother responses. This is due to a fast-varying nonlinear function of large magnitude in the control law. There exists flexibility in the design, and by a proper choice of feedback gains and the reference phase command signals, one can obtain different response characteristics. This flexibility in phase control of IOs is useful in performing desirable maneuvers for the BAUV.

One must note that the profile of the control signal will depend on the states of the IOs when a pulse is applied. The derived controllers are based on the input-output feedback linearization theory, as well as stability and convergence. The control system can be switched on for phase control at any instant since the system utilizes state variable feedback and one can command the IO to follow a sequence of phase change when needed.

BRIEF DESCRIPTION OF THE DRAWINGS

Further objects and advantages of the invention will become readily apparent from the following detailed description and claims in conjunction with the accompanying drawings wherein;

DETAILED DESCRIPTION OF THE INVENTION

Figure 1A:
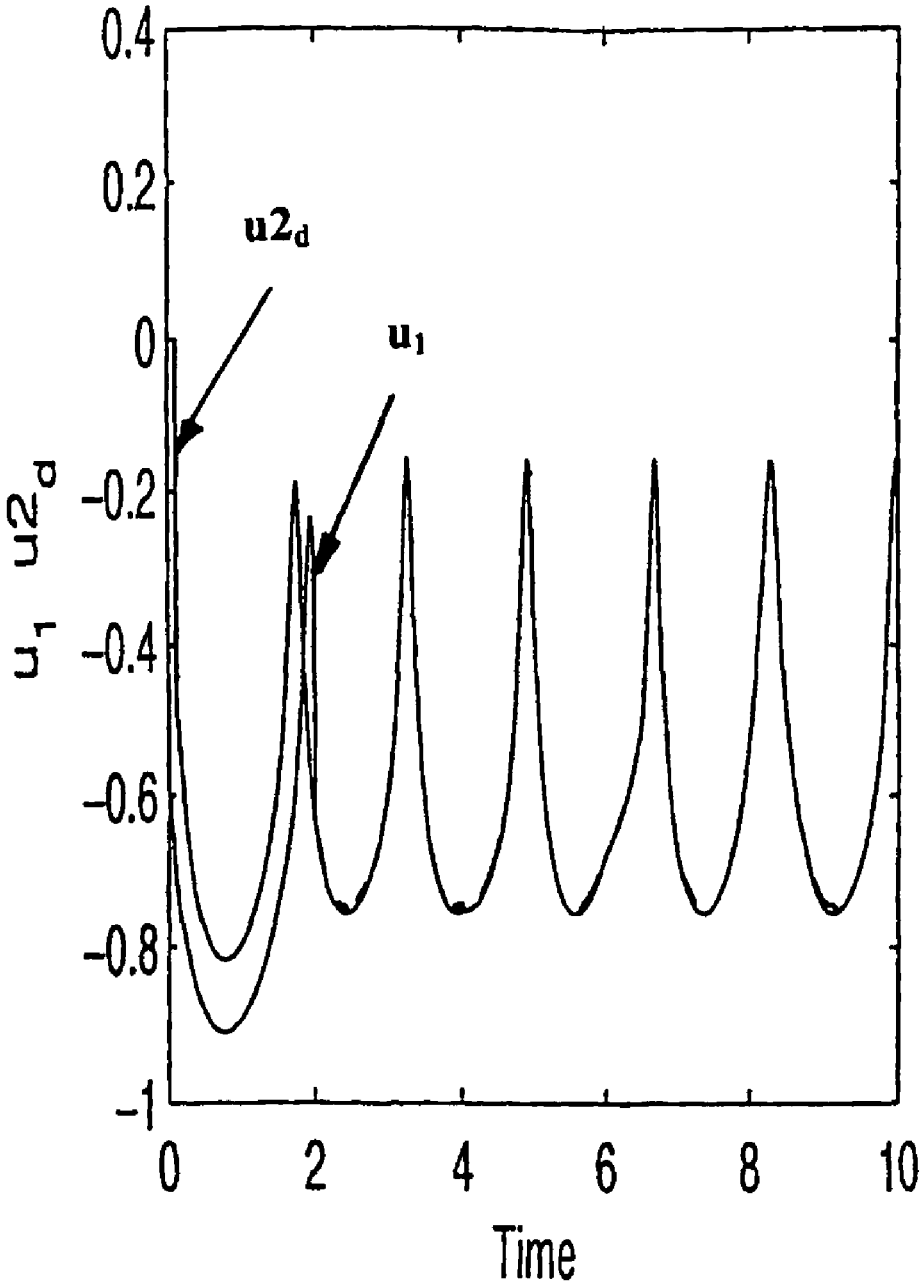
FIG. 1A-1D are each a graph depicting global synchronization using control law $C_u$ with $IO_1$ commanded to track $IO_2$ with a delay 0.125 for $t \in [0, 4)$, 0.25 for $t \in [4, 6)$, 0.5 for $t \in [6, 8)$ and 0.75 for $t \in [8, 10)$ with the controller of $IO_1$, switching at two seconds, plots are of $x_1(t)$ and $x_2(t-t_d)$.

Referring now to the present disclosure, a subsection on inferior-olives and a practical application of control laws affecting inferior-olives are presented.

Inferior Olives Model and Synchronization

This disclosure focuses on closed-loop control of multiple inferior olives (IOs) for maneuvering Biorobotic Autonomous Undersea Vehicles (BAUVs). The model of an ith IO is described by $$\begin{bmatrix} \dot{u}_i \\ \dot{v}_i \\ \dot{z}_i \\ \dot{w}_i \end{bmatrix} = \begin{bmatrix} k\,\epsilon_{Na}^{-1}\,(p_{iu}(u_i) - v_i) \\ k(u_i - z_i + I_{Ca} - I_{Na}) \\ p_{iz}(z_i) - w_i \\ \epsilon_{Ca}\,(z_i - I_{Ca}) \end{bmatrix} + \begin{bmatrix} 0 \\ 0 \\ 0 \\ -\epsilon_{Ca} \end{bmatrix} I_{exit}(t) \tag{1}$$

where the variables "$z_i$" and "w", are associated with the sub-threshold oscillations and low threshold (Ca-dependent) spiking, and "$u_i$" and "$v_i$" describe the higher threshold ($Na^+$-dependent) spiking. The constant parameters $\epsilon_{Ca}$ and $\epsilon_{Na}$ control the oscillation time scale; $I_{ca}$ and $I_{Na}$ drive the depolarization levels; and k sets a relative time scale between the uv- and zw-subsystems.

The nonlinear functions are:

$$p_{iu}(u_i)=u_i(u_i-a)(1-u_i)$$

$$p_{iz}(z_i)=z_i(z_i-a)(1-z_i) \tag{2}$$

"p" being a non-linear function and "a" is a constant parameter.

The function $I_{exti}$ (t) is the extra-cellular stimulus which is used here for the purpose of control.

Define $$x_i=(u_i,v_i,z_i,w_i)^T\epsilon R^4 \tag{3}$$

where "x" is the state vector of the ith IO, "R" is the set of real numbers. Equation (1) can be written in a compact form as $$\dot{x}_i=f_i(x_i)+g_iu_{ci} \tag{4}$$

where $u_{ci}=I_{exti}$ is the control input of the ith IO and "f", "g" are vectors. The nonlinear vector function $f_i(x_i)\epsilon R^4$ and the constant column vector $g_i$ are obtained from Equation (1). It is known to those skilled in the art that a system utilizing Equation (1) exhibits limit cycle oscillations. Using harmonic balancing, it is possible to predict the approximate magnitudes, frequency and phases of periodic solutions of the components of the system.

As stated, the primary objective is to develop control laws for the synchronization and phase angle control of multiple IOs for t he purpose of BAUV control. For the sake of simplicity, the synchronization of only two IOs is considered, but it is seen that the approach is extendable for the synchronization of any number of IOs. Synchronization is defined first.

Consider two IOs $$\dot{x}_1=f_1(x_1)+g_1u_{c1}$$

$$\dot{x}_2=f_2(x_2)+g_2u_{c2}. \tag{5}$$

Suppose that the state vector $x_2$ of the second IO is treated as the reference signal.

Consider a solution $x_2(t)$ of the $IO_2$ beginning from an initial condition $x_{20}$, with an input $u_{c2}=0$ set to zero and let $x_2(t-t_d)$ ["t" being time] be the delayed signal obtained from $x_2(t)$, where $t_d>0$ is an arbitrary delay time. Then for the prescribed delay time $t_d$, $IO_1$ is said to be asymptotically synchronized to the $IO_2$ if the error signal $\tilde{x}(t)=x_1(t)-x_2(t-t_d)$ converges to zero as t tends to ∞ [infinity].

Consider the synchronization of the two IOs having arbitrary and possibly large initial conditions. Note that if the delay time is zero, $x_1(t)-x_2(t)$ diminishes to zero as time progresses and the IOs oscillate in synchronism with a relative phase zero. However, if one sets the delay time as $t_d=\phi/(2\pi f)$ ("f" is the period of oscillation of the $IO_2$), the $IO_1$ will oscillate lagging behind the $IO_2$ with a relative phase angle $\phi$. Although, the convergence of the synchronization error, has been required to be only asymptotic, for practical purposes, it will be sufficient if one can design the control system for the $IO_1$ which is sufficiently fast.

Synchronizing Control Systems

Four control systems are presented for the synchronization of the two IOs based on an input-output feedback linearization (nonlinear inversion) approach. For the purpose of the design, consider output variables associated with the nonlinear system for Equation (5) of the form $$e=h(x_1(t),x_2(t-t_d)). \tag{6}$$

Later "h", which is a function of the state variables of the two IOs, is selected to meet the desired objective. It will be seen that the choice of the output variable "e" is important in shaping the behavior of the closed-loop system. Although, by following the approach presented here, various input-output linearizing control systems can be obtained, derivation of the four control systems of varying complexity and synchronizing characteristics are considered.

Global Synchronization: Control Law ($C_u$)

Now consider the derivation of a control law for the global synchronization of the $IO_1$ with the reference $IO_2$. The reference $IO_2$ has an input $I_{ext2}=0$. It is desired to design a synchronizing control system such that $IO_1$ oscillates in synchronism with a delay time of $t_d$ seconds corresponding to a desired phase angle $\phi$ with respect to reference $IO_2$. By global synchronization, the synchronization must be accomplished for all values of initial conditions $x_{iO}\epsilon R^4$, i=1,2 of the two IOs.

For the purpose of design, the controlled output variable is chosen as:

$$e(t)=h_u(x_1(t),x_2(t-t_d))=u_1(t)-u_2(t-t_d). \tag{7}$$

Note that the output function "e" is a function of only the first component of the state vectors of $IO_1$ and $IO_2$ at time t and $t-t_d$, respectively. But it will be seen later that this choice of the output "e" yields the global result. The subscript "u" of the function "h" denotes dependence on the variables "$u_i$".

For compactness, define the composite state vector for the two IOs as $x_a(t)=(x_1(t)^T, x_2(t-t_d)^T\epsilon R^8$, where "T" denotes matrix transposition. Then from Equation (5), one has $$\dot{x}_a(t) = \begin{bmatrix} \dot{x}_1(t) \\ \dot{x}_2(t-t_d) \end{bmatrix} = \begin{bmatrix} f_1(x_1(t)) \\ f(x_2(t-t_d)) \end{bmatrix} + \begin{bmatrix} g_1 \\ 0 \end{bmatrix} u_{c1}(t) \doteq f(x_a(t)) + gu_{c1}(t). \tag{8}$$

The state error ($\tilde{x}=x_1(t)-x_2(t-t_d)$) dynamics and the associated output e can be written as $$\dot{\tilde{x}} = f_1(\tilde{x}(t)+x_2(t-t_d)) - f_2(x_2(t-t_d)) + g_1u_{c1}(t) \doteq f_e(\tilde{x}(t),t) + g_1u_{c1}(t)$$
$$e = h_u(x_a(t)) = h_u(\tilde{x}(t)) \tag{9}$$

where $f_e(\tilde{x},t)=f_1(\tilde{x}(t)+x_2(t-t_d))-f_2(x_2(t-t_d))$ is defined. Note that argument "t" has been used in "$f_e$" to indicate dependence on the bounded and known delayed reference state vector of the unforced $IO_2$. Thus, the system of Equation (9) can be treated as a nonautonomous system of dimension four.

Define the Lie derivative of the function $h_u$ along the vector field f as $$L_f h_u(x_a(t)) = \frac{\partial h}{\partial x_a} f(x_a(t)) = \frac{\partial h_u}{\partial x_1} f_1(x_1(t)) + \frac{\partial h_u}{\partial x_2} f_2(x_2(t-t_d)) \tag{10}$$

and for $k = 0, 1, 2 \ldots$ ; and let $L_f^j h_u(x_a) = L_f L_f^j(x_a(t))$ and $$L_g L_f^k h_u(x_a) = \frac{\partial L_f^k h_u}{\partial x_a} g. \tag{11}$$

For the system of Equation (8), computing the Lie derivatives, it is verified that for j=0,1,2,3, one has $$e^{(j)}(t) = L_f^j h_u(x_a(t)) \tag{12}$$

and for $j = 4$ gives $$e^{(j)}(t) = L_f^j h(x_a(t)) + L_g L_f^{j-1} h(x_a(t)) u_{c1}(t) \doteq a_{u1}(\tilde{x}, t) + b_{u1} u_{c1} \tag{13}$$

where $e^{(k)}=de^k/dt^k$ and one can show that $b_{u1}=k^2 \epsilon_{Ca}/\epsilon_{Na}$. For the nonautonomous system of Equation (9), defining $$L_{fe}(.) = \frac{\partial(.)}{\partial t} + \frac{\partial(.)}{\partial \tilde{x}} f_e(t, \tilde{x}) \tag{14}$$

$$L_{fe}^j h_u(\tilde{x}, t) = L_f^j h_u(x_a),\ j = 0, 1, \ldots, 4 \tag{15}$$

and $L_{g1} L_{fe}^3 h_u(\tilde{x}, t) = b_{u1}$.

Since the control input appears in the fourth derivative of the output e for the first time for the system utilizing Equation (9), the output e is of the relative degree r=4.

In view of Equation (13), an input-output linearizing control law is selected as $$\dot{u}_{c1} = b_{u1}^{-1}\left( - a_{u1} - \sum_{j=0}^{3} p_j L_f^j h_u(x_a(t)) \right) \tag{16}$$

where $p_j$, j=0,1,3, are the constant feedback gains and "b" is a vector. Because $e^{(j)}(t)=L_f^j h_u(x_a(t))$, substituting the control law of Equation (16) in Equation (13) gives an output equation of the form $$e^{(4)}+p_3 e^{(3)}+p_2 e^{(2)}+p_1 \dot{e}+p_0 e=0 \tag{17}$$

For the nonlinear closed-loop system of Equations (9) and (16), the output e(t) satisfies a fourth order linear differential equation. The gains $p_j$ are chosen such that Equation (17) is exponentially stable, and thereby e(t) and derivatives of e(t) converge to zero as t tends to infinity. Of course, one can choose larger gains to obtain faster convergence of e(t) to zero. For the chosen output, because the system of Equation (9) is of dimension four and the relative degree of e is four, the dimension of the zero dynamics is null. The zero dynamics represent the residual dynamics of the system when the output error e(t) is constrained to be zero.

In fact, there exists a diffeomorphism $P_u$ for $t \in [0,\infty)$ mapping $R^4$ into $R^4$ such that $\tilde{x}=P_u(\xi,t)$, where $\xi=(e, \dot{e}, \ddot{e}, e^{(3)})^T \in R^4$. One can find the map $P_u$. First of all, one has $\tilde{u}=e$, where $\tilde{x}=x_1(t)-x_2(t-t_d)=(\tilde{u},\tilde{v},\tilde{z},\tilde{w})^T$ is defined. Using Equation (12) one can show that $$\tilde{x} = P_u(\xi, t) = \begin{bmatrix} e \\ q_1(e, \dot{e}, t) \\ q_2(e, \dot{e}, \ddot{e}, t) \\ q_3(e, \dot{e}, \ddot{e}, e^{(3)}, t) \end{bmatrix} \tag{18}$$

where $$q_1=-\epsilon_{Na}k^{-1}\dot{e}+p_{1u}(e+u_2(t-t_d))-p_{2u}(u_2(t-t_d)),\ q_2=-\dot{q}_1 k^{-1}+e, \text{ and } q_3=-\dot{q}_2+p_{1z}(\tilde{z}+z_2(t-t_d))-p_{2z}(z_2(t-t_d)).$$

Note that the argument "t" in "$q_i$" and "$P_u$" indicates dependence on the reference trajectory $x_2(t-t_d)$ and derivatives of the reference trajectory. Furthermore, it can be verified that Pu (0, t)=0; that is, $\tilde{x}=0$ when e and derivatives of e vanish. Because $P_u$ is a diffeomorphism, $P_u(0, t)=0$, and the linear system of Equation (17) is exponentially stable, global synchronization of the IOs is accomplished and the two IOs oscillate together but with the required relative phase. Note that the control stimulus, $I_{ext1}$, vanishes when the IOs capture the unique limit cycle; only the $IO_1$ falls behind by the delay time $t_d$ (phase angle $\phi$).

To examine the synchronizing capability of the control system, the closed-loop system including the IOs given in Equation (5) and the control law of Equation (16) is simulated. The parameters of the IOs selected are: $E_{Na}$=0.001, $E_{Ca}$=0.02, k=0.1, $I_{Ca}$=0.018, $I_{Na}$=−0.61, and a=0.015. One can use another set of parameters as well. The input to $IO_2$ is kept to zero. The feedback gains chosen are such that the poles of Equation (17) are at 25(−0.424±j 1.263) and 25(−6.26±j 0.4141). These poles have been selected to obtain good transient responses by observing the simulated responses, however one could choose other pole locations as well for synchronization. The initial conditions are $x_{10}=(0.4, 0.6, 0.4, 0.5)^T$ and $x_{20}=(0.2, 0.4, 0.2, 0.3)^T$. Thus the initial condition of the IOs differs. The frequency of oscillation of the IOs depends on the system parameters. Signals of different frequencies can be obtained by time scaling. For illustration, a time scaling is introduced by multiplying the derivatives of the variables by a scaling factor of sixty.

Figure 1B:
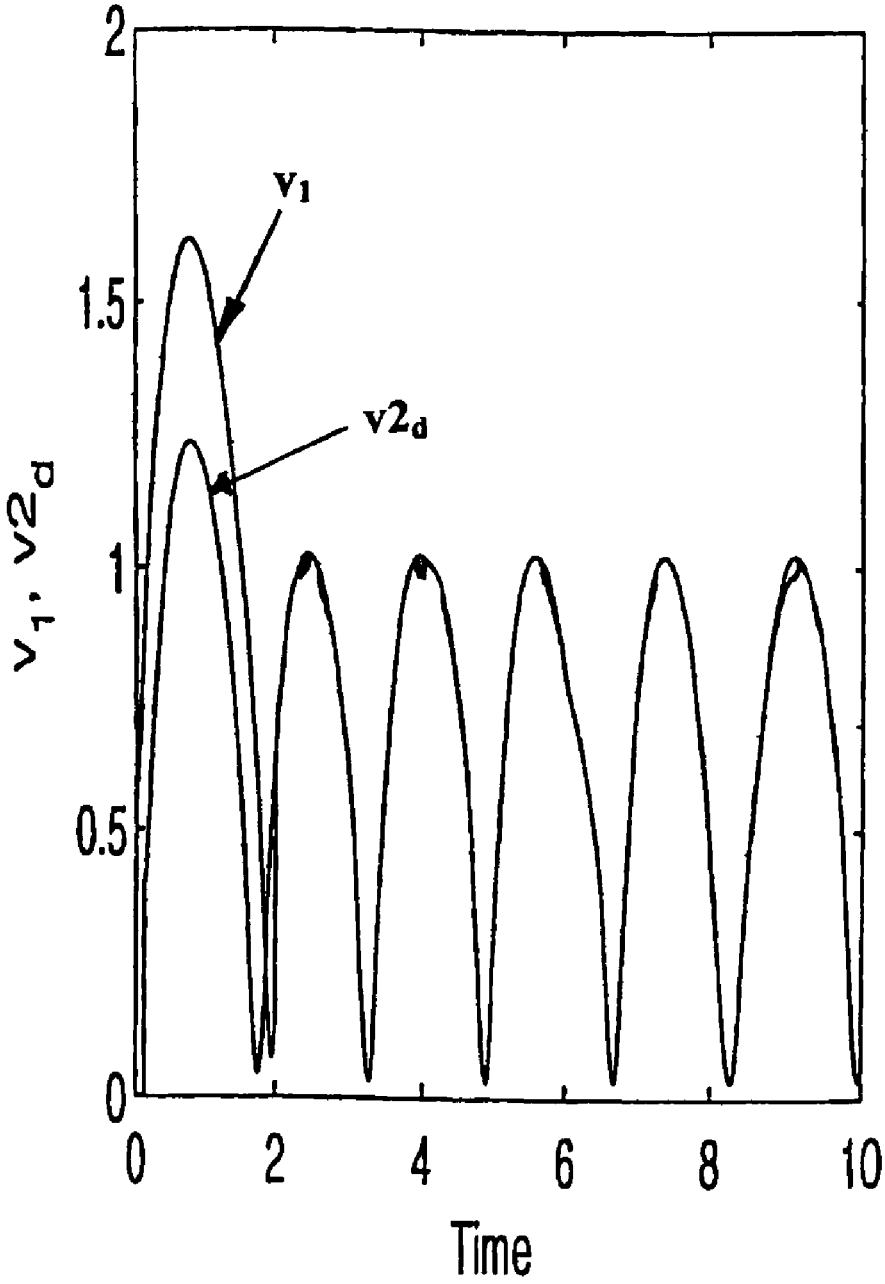
Figure 1C:
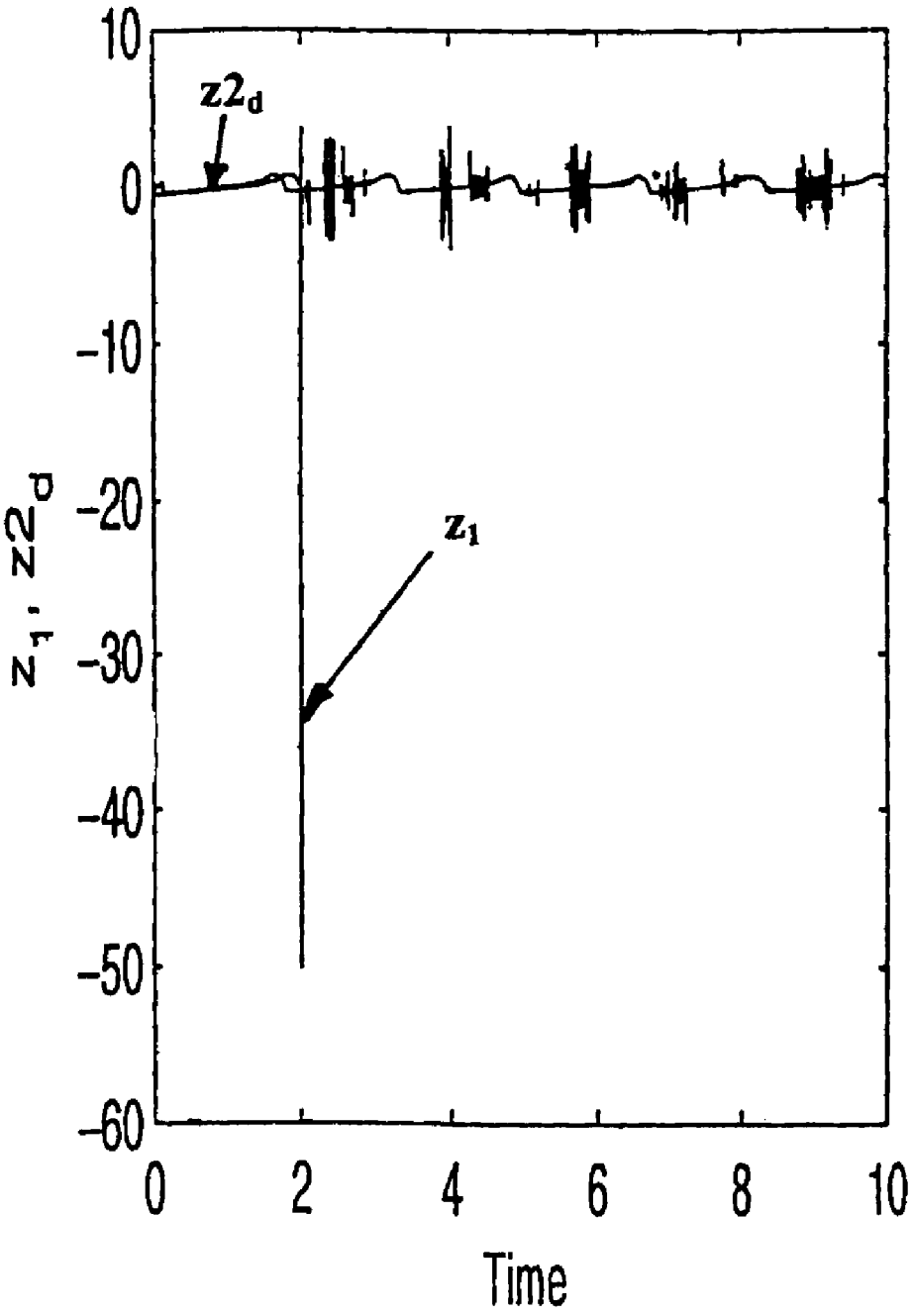
Figure 1D:
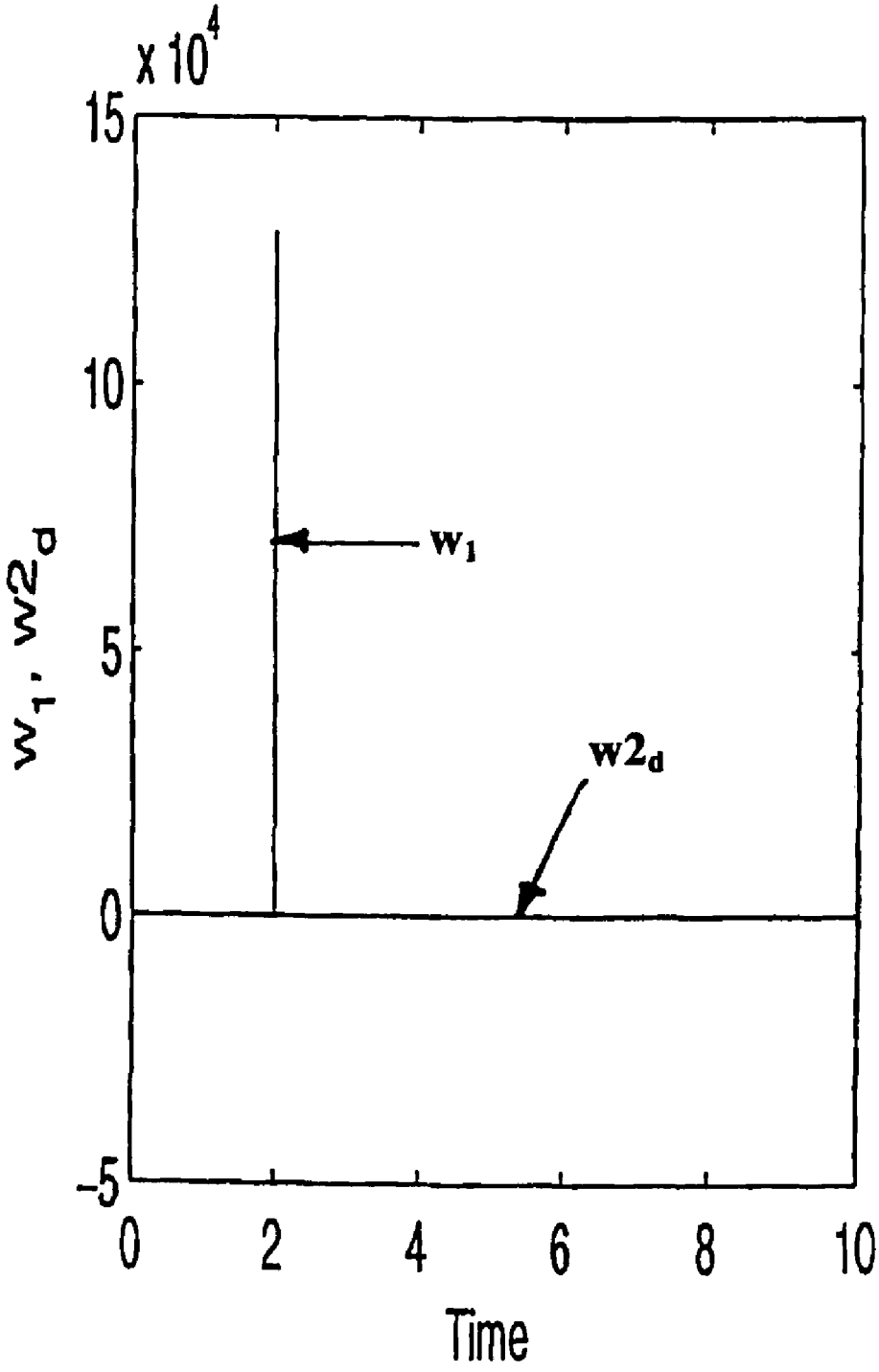
Figure 2A:
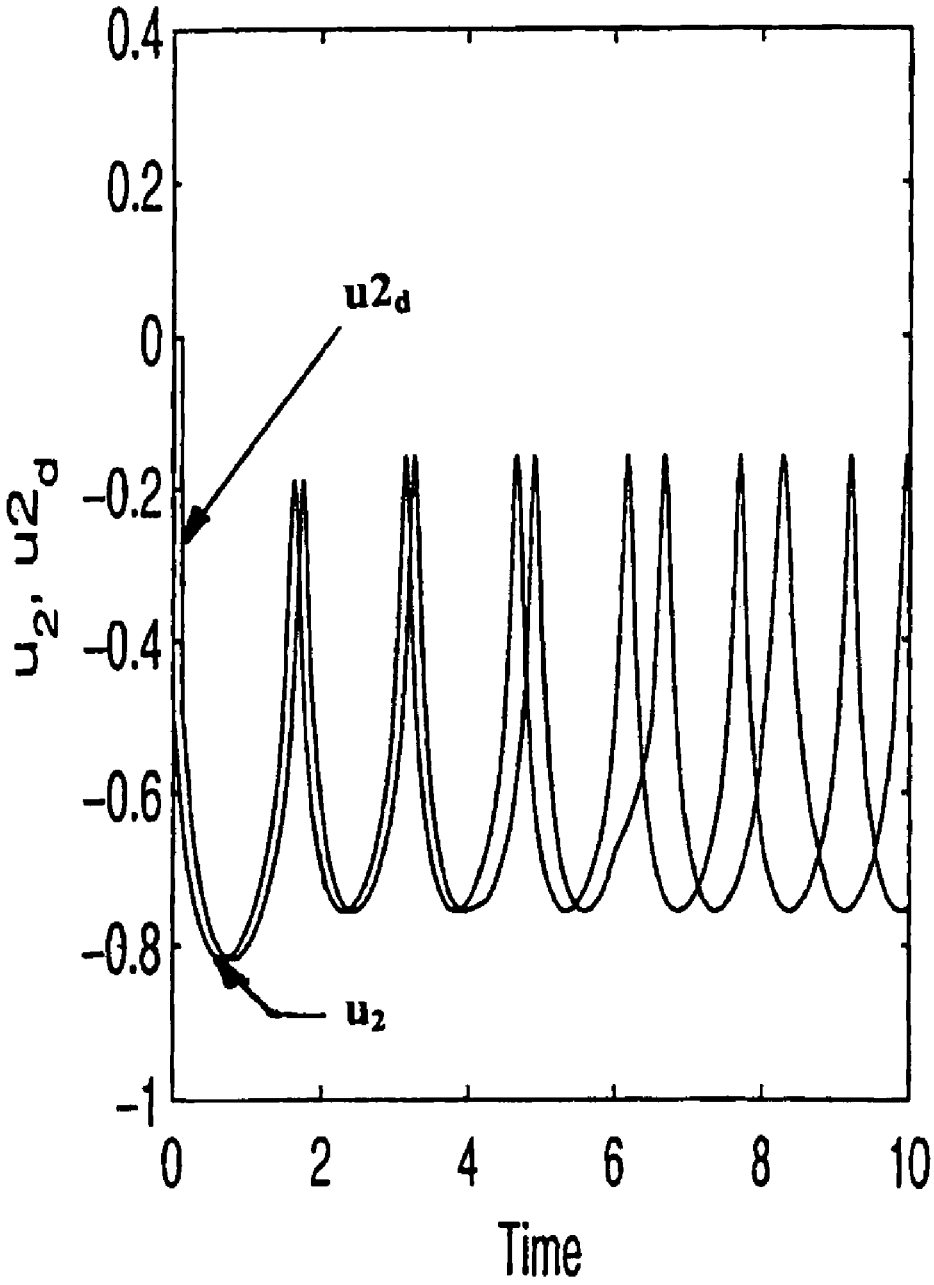
FIG. 2A-2D are each a graph depicting global synchronization using control law, $C_u$, plots are of $x_2(t)$ and $x_2(t-t_d)$ for command inputs of FIG. 1A-1D.
Figure 2B:
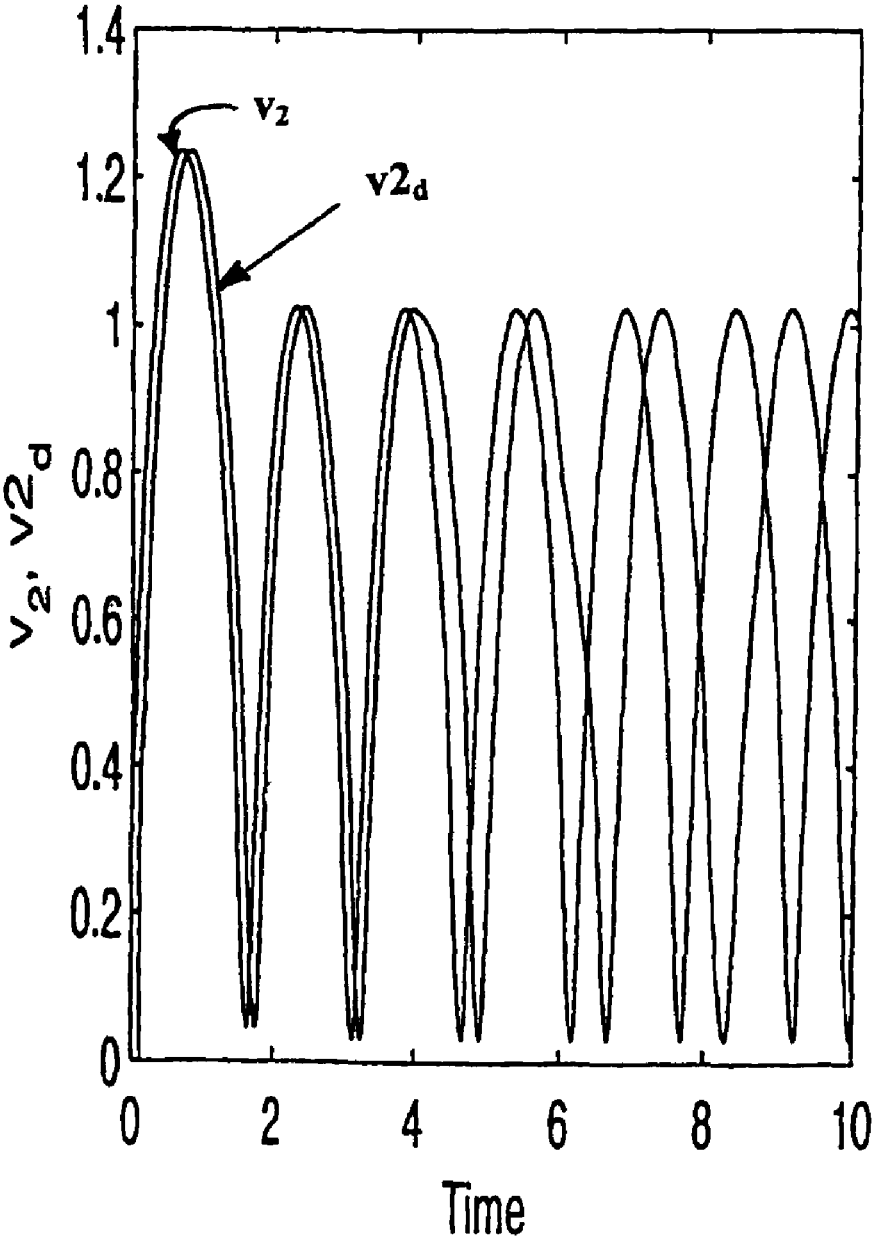
Figure 2C:
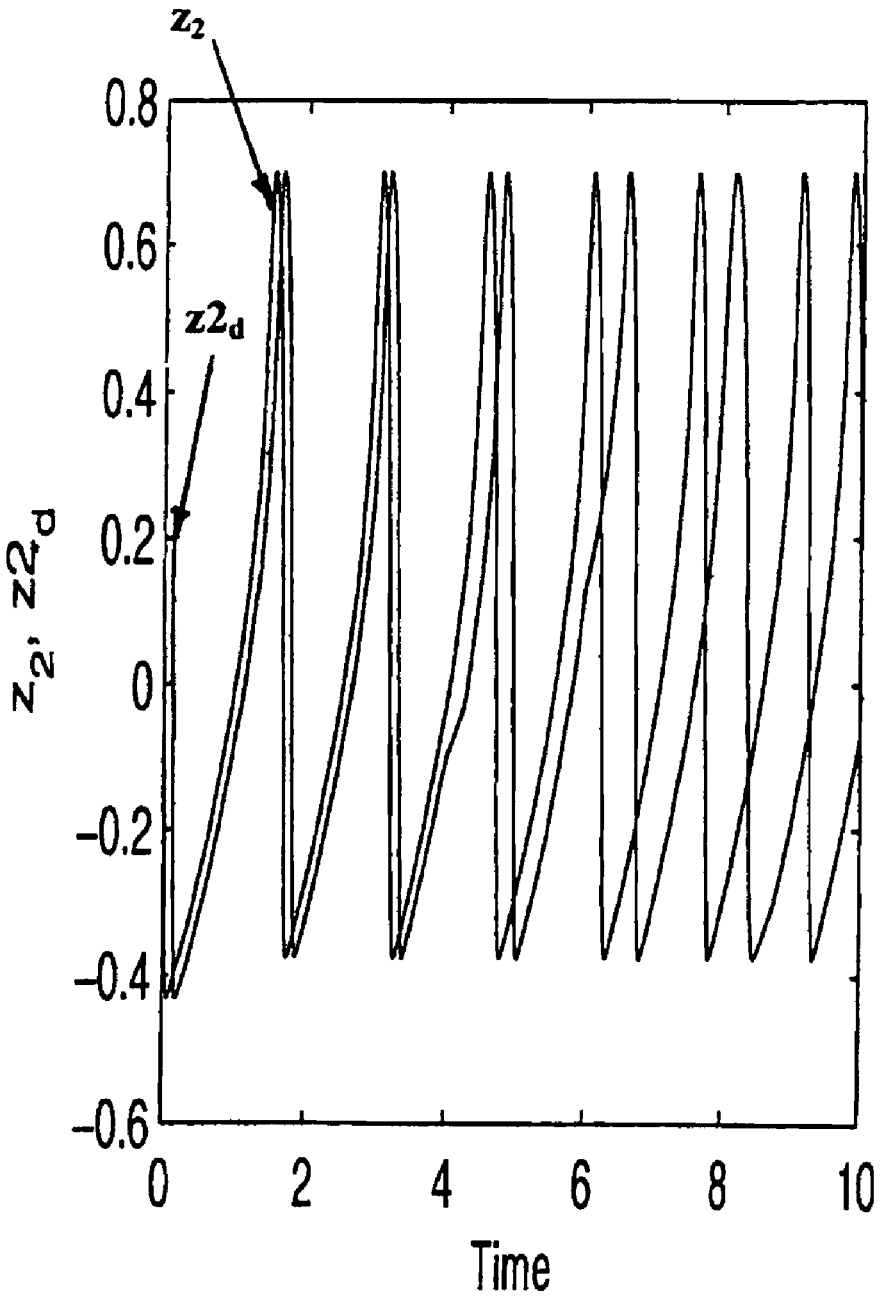
Figure 2D:
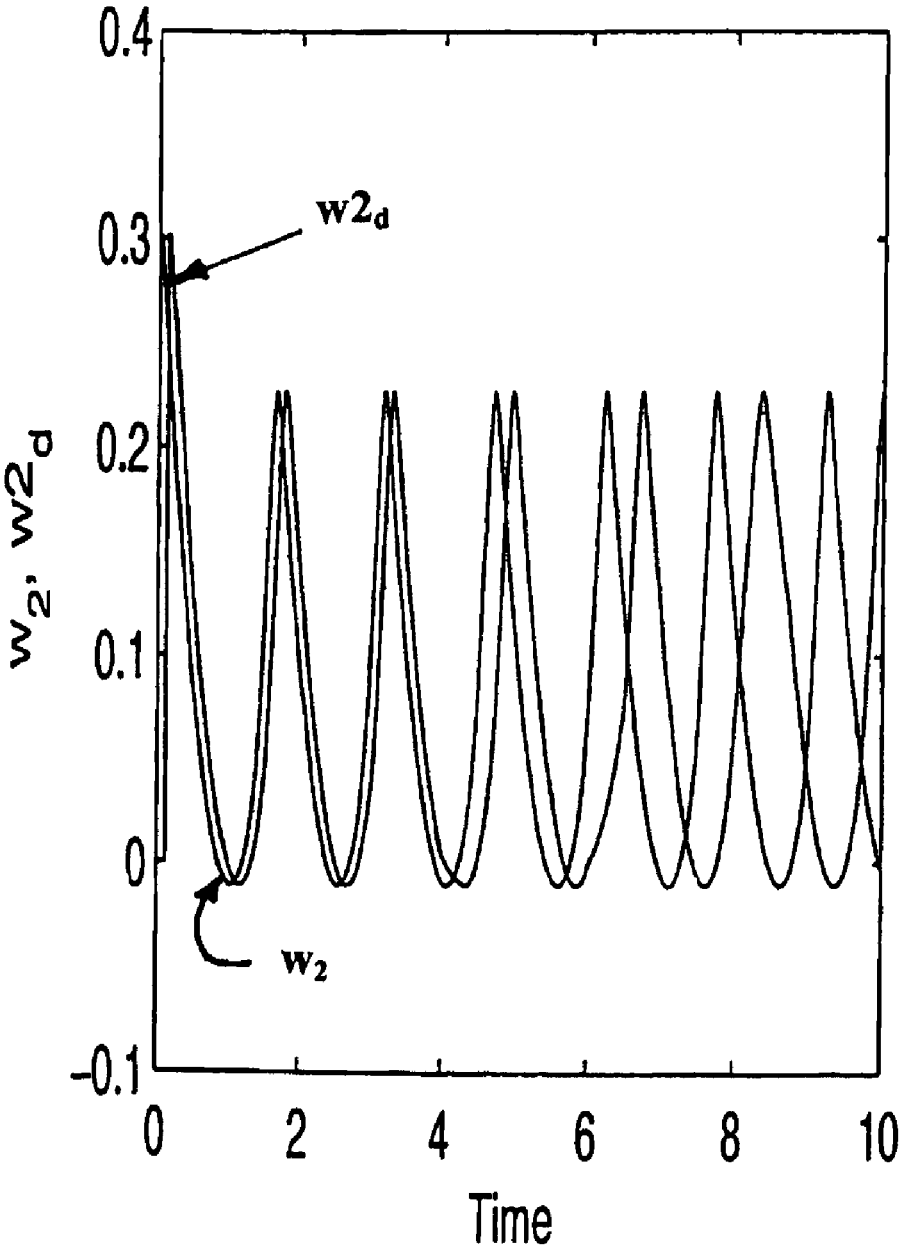
Figure 3A:
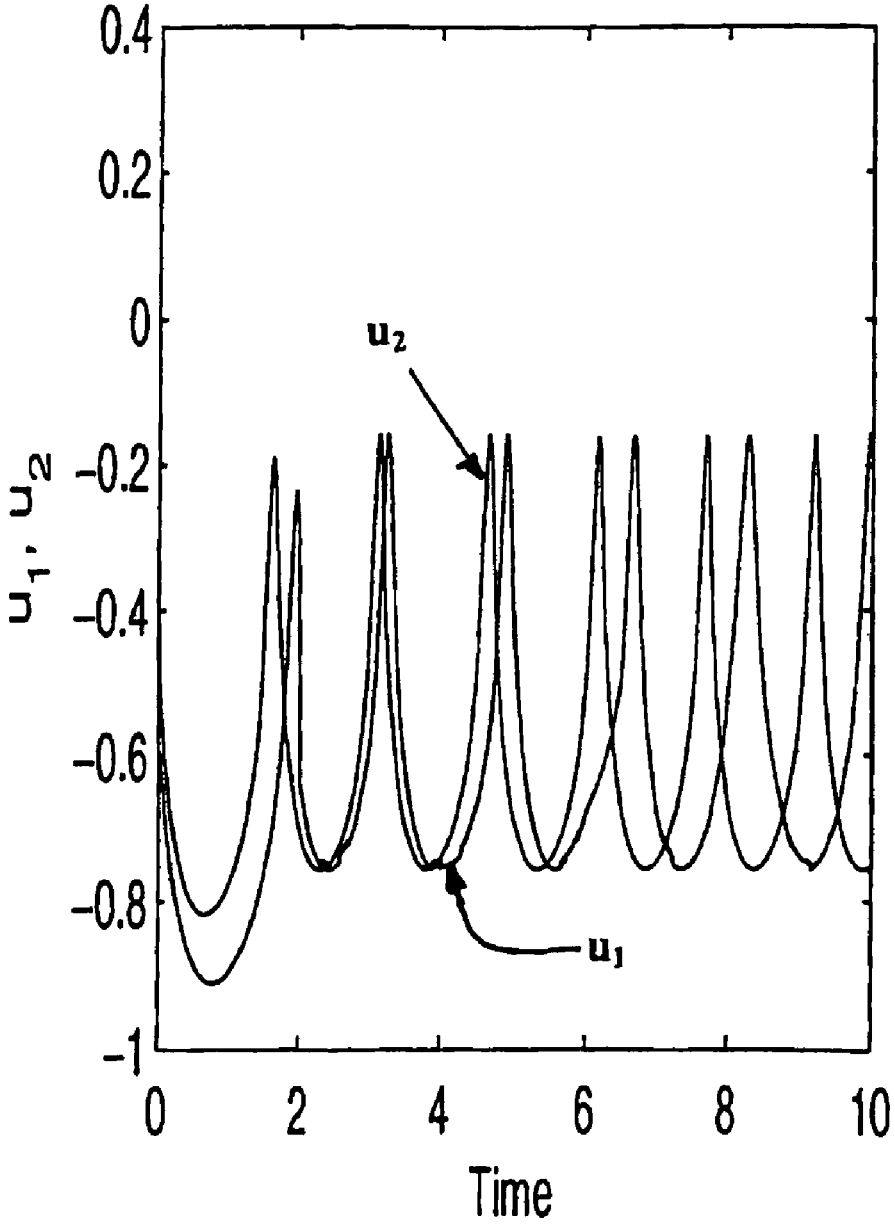
FIG. 3A-3D are each a graph depicting global synchronization using control law, $C_u$, plots are of $u_i(t)$, $v_i(t)$, $z_i(t)$ and control inputs $I_{est1}$, $I_{ext2}$ for command inputs of FIG. 1A-1D.
Figure 3B:
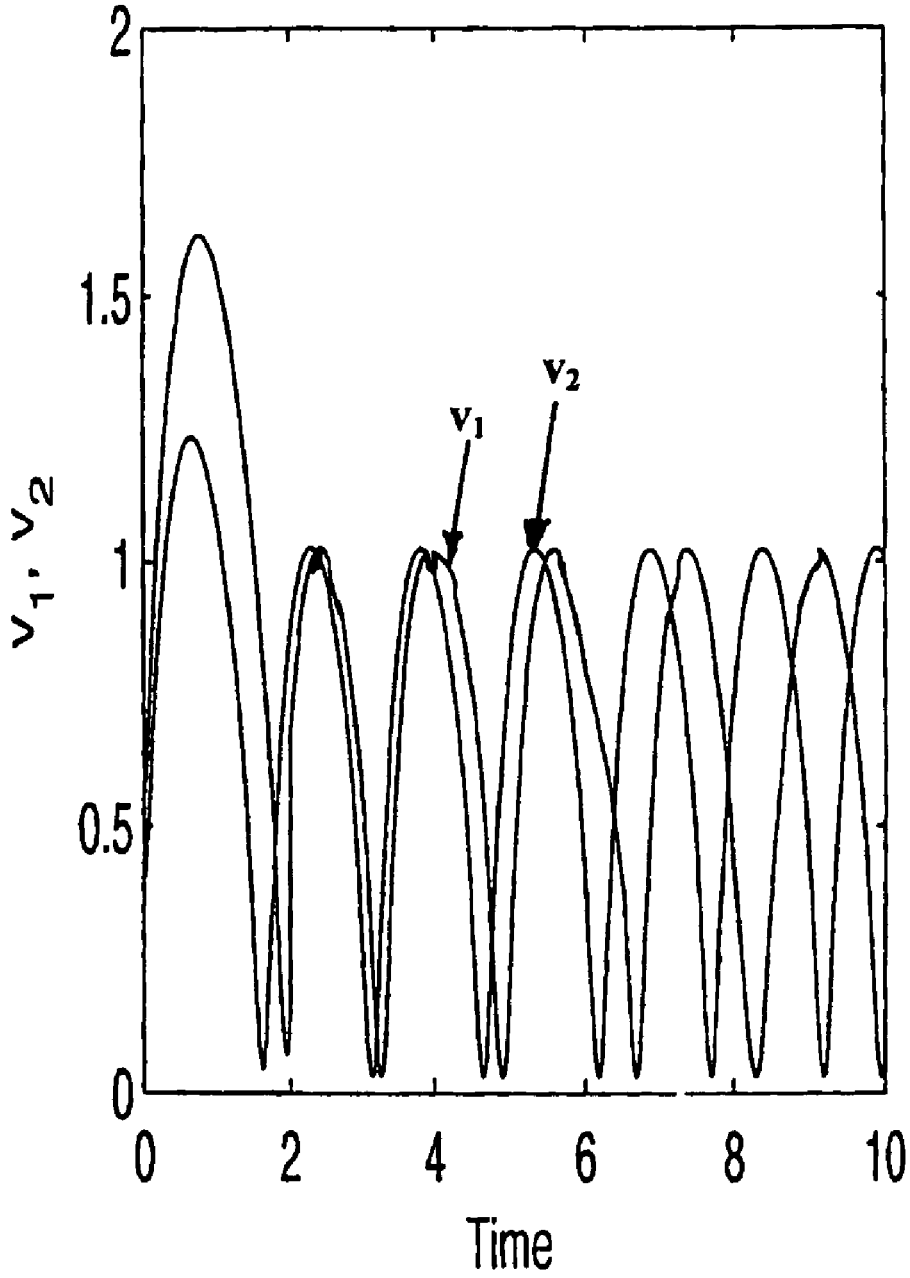
Figure 3C:
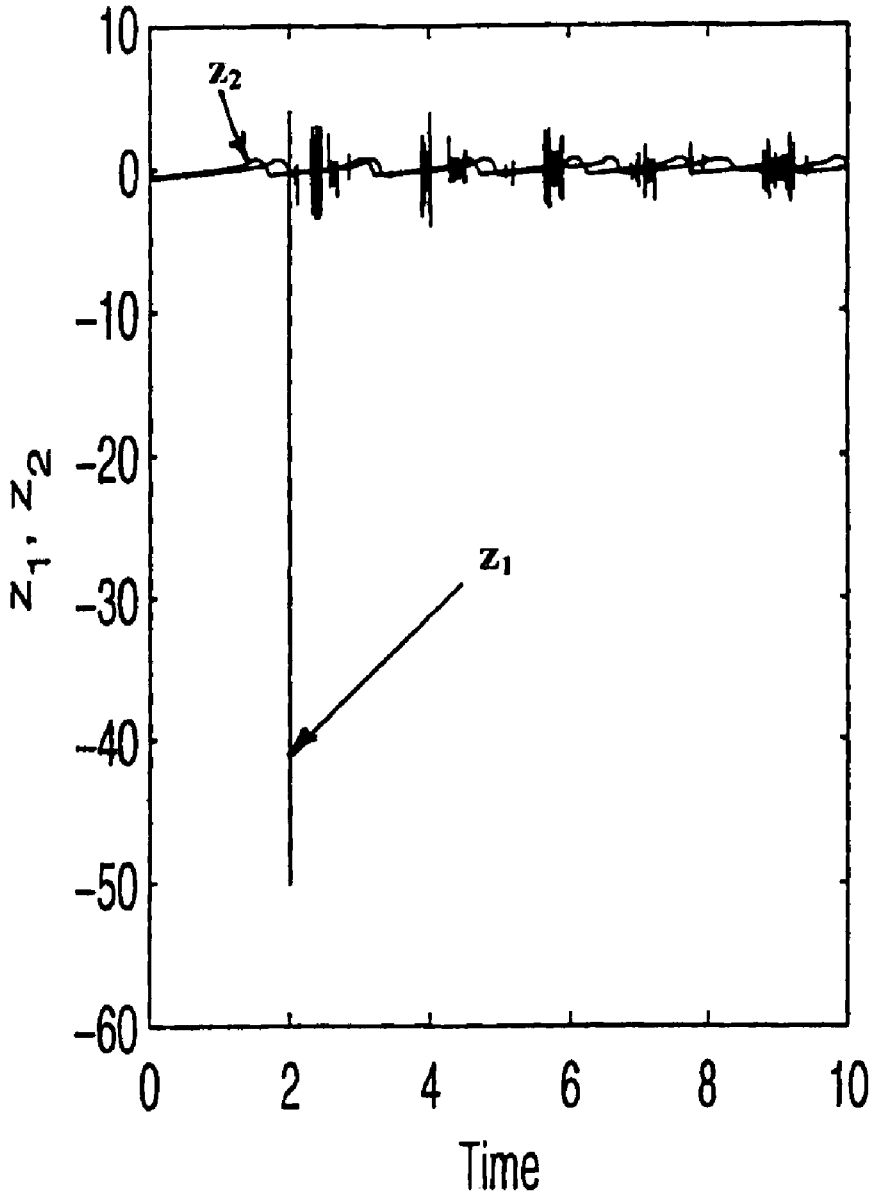
Figure 3D:
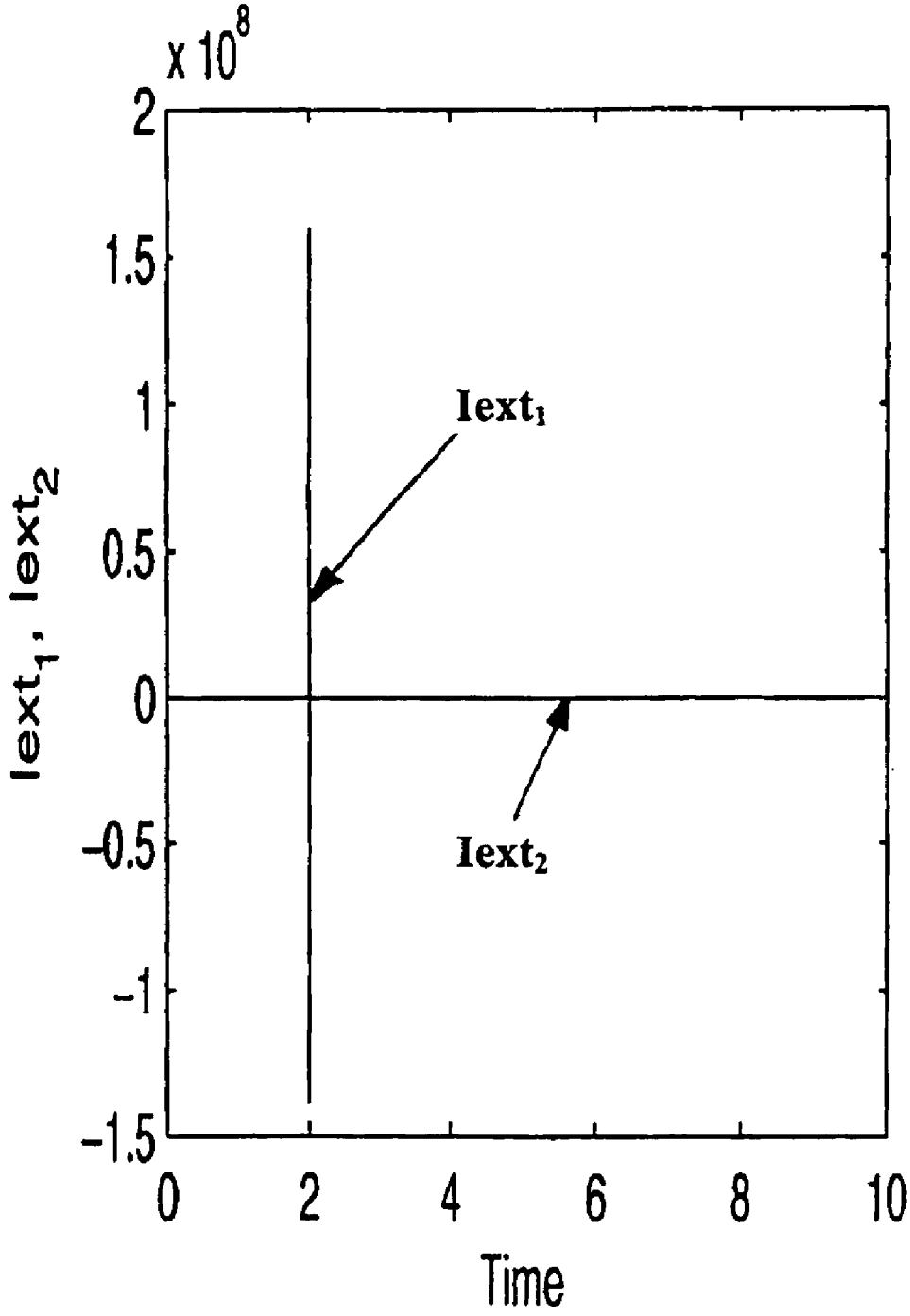

It is desired to have the delay time $t_d$ as 0.125 for $t \in [0,4)$, 0.25 for $t \in [4, 6)$, 0.5 for $t \in [6, 8)$ and 0.75 for $t \in [8, 10)$, respectively. The controller is switched on at t=2 (sec), that is $I_{ext1}$=0 for t<2 and the delay command changes every two seconds. Referring now to the drawings, responses are shown in FIG. 1(*a*)-(*d*), FIG. 2(*a*)-(*d*) and FIG. 3(*a*)-(*d*). In the figures, the variables with a subscript "d" indicate delayed values (such as $u2_d$ denoting $u_2(t-t_d)$). It is observed that the IOs are not initially in phase. As the controller switches at two seconds, the IOs synchronize having a delay time of 0.125 seconds. The command changes at four, six, and eight seconds to delay times of 0.25, 0.5 and 0.75 seconds. Following each command, $x_1(t)$ tracks $x_2(t-t_d)$ and it is seen that $u_1(t)-u_2(t-t_d)$ and $v_1(t)-v_2(t-t_d)$ remain close to zero after two seconds. However, as the command changes, it causes larger deviations in the tracking of z- and w-trajectories due to large control input acting on the system. Note that a comparatively large spike appears in the control input at two seconds and subsequently smaller magnitudes of control input are required each time that the command changes. Simulation has been done for other initial conditions and a parameter value of a. It is found that frequency changes with a, but for a low value of a=0.01, u-response has a sharper spike.

The controller $C_u$ uses feedback of nonlinear functions of the state variables and has a global synchronization property. A controller using fewer state components and/or nonlinear feedback functions will be notable for implementation. The complexity and performance of the controller depends on the choice of the output function e. The existence of simpler controllers using different controlled output variables is examined in the next subsections.

Local Synchronization: Control Law ($C_v$)

Now consider the derivation of a control law (termed as $C_v$) for the choice of controlled output variable $$e(t)=h_v(x_a(t))=v_1(t)-v_2(t-t_d)=\tilde{v}(t). \tag{19}$$

Note that the same symbol "e" is used to indicate a different function. For this choice of e, that for j=0, 1, 2, one has $$e^{(j)}(t) = L_f^j h_v(x_a(t)) \text{ and for } j = 3 \text{ gives} \tag{20}$$

$$e^{(j)}(t) = L_f^j h_v(x_a(t)) + L_g L_f^{j-1} h_v(x_a(t))u_{c1}(t) \doteq a_{v1}(\tilde{x}, t) + b_{v1}u_{c1} \tag{21}$$

where one can show that $b_{v1}=-k\,\epsilon_{Ca}$. Since the control input appears in the third derivative of the output e for the first time for the system of Equation (9), the output e has the relative degree r=3.

In view of Equation (21), an input-output linearizing control law is selected as $$u_{c1} = b_{v1}^{-1}\left(-a_{v1} - \sum_{j=0}^{2} p_j L_f^j h_v(x_a(t))\right) \tag{22}$$

where $p_j$, j=0, 1, 2, are the constant feedback gains. Substituting the control law of Equation (22) in Equation (21) gives the output equation of the form $$e^{(3)}+p_2e^{(2)i}+p_1\dot{e}+p_0e=0. \tag{23}$$

The gains $p_1$ are chosen such that the characteristic polynomial $$\Pi_v(\lambda)=\lambda^3+p_2\lambda^2+p_1\lambda+p_0. \tag{24}$$

associated with Equation (23) is Hurwitz, commonly known in the art. Hurwitz means that the roots of $\Pi_v(\lambda)=0$ have real part negative. For the choice of such parameters, e and the derivatives tend to zero.

For the nonlinear closed-loop system of Equation (9) and Equation (22), the output e(t) satisfies a third-order linear differential equation. Because the system of Equation (9) is of dimension four and the relative degree or e is three, the dimension of the zero dynamics is one. In fact, there exists a diffeomorphism $P_v$ for $t\epsilon[0,\infty)$ mapping $R^4$ into $R^4$ such that $\tilde{x}=P_v(\xi,t)$ where $\xi$ is now defined as $\xi=(\tilde{u},e,\dot{e},\ddot{e})^T$. Using Equation (20) one can show that $$\tilde{x} = P_v(\xi, t) = \begin{bmatrix} \tilde{u} \\ e \\ \tilde{u} - k^{-1}\dot{e} \\ q_v(\tilde{u}, e, \dot{e}, \ddot{e}, t) \end{bmatrix} \tag{25}$$

where $$q_v = k\,\epsilon_{Na}^{-1}\,(-p_{1u}(\tilde{u} + u_2(t-t_d)) + p_{2u}(u_2(t-t_d)) + e) + p_{1z}(\tilde{z} + z_2(t-t_d)) - p_{2z}(z_2(t-t_d)) + k^{-1}\ddot{e} \tag{26}$$

and it is understood that $\tilde{z}$ is replaced by $\tilde{u}-\dot{e}/k$ in $q_v$. Furthermore, it can be verified that $P_v(0, t)=0$. However, the convergence of the error "e" and the derivative to zero does not necessarily imply the convergence of $\tilde{x}$ to the origin. For the synchronization of the IOs, the stability property of the residual dynamics (the zero dynamics) must be examined when e vanishes.

It can be shown that the zero dynamics (when e=0) is given by $$\dot{\tilde{u}} = -ka\,\epsilon_{Na}^{-1}\,\tilde{u} + k\,\epsilon_{Na}^{-1}\,[(1 + a - 3u_2(t-t_d))\tilde{u}^2 + (2(1+a)u_2(t-t_d) - 3u_2^2(t-t_d))\tilde{u} - \tilde{u}^3] \doteq g_c(\tilde{u}, u_2(t-t_d)) \tag{27}$$

The IOs will synchronize in a local (global) sense only if the equilibrium point $\tilde{u}=0$ is asymptotically stable (globally asymptotically stable). The system of Equation (27) is a nonlinear nonautonomous system and depends on the state $u_2(t-t_d)$ of the reference IO. It is seen that the solution of Equation (27) is bounded, because for large $\tilde{u}$, $g_c$ is dominated by $-\tilde{u}^3$.

For the stability analysis, consider the solutions of the zero dynamics in a sufficiently small open set $\Omega_u$ around $\tilde{u}=0$. If $u_2(t-t_d)$ is sufficiently small, one has $(\partial g_c(0,t)/\partial\tilde{u})<0$, and therefore $\tilde{u}=0$ of the zero dynamics is exponentially stable and the controller accomplishes local synchronization.

Alternatively, one can establish asymptotic stability of the zero dynamics using a center manifold theorem known to those ordinarily skilled in the art. First note that, the solution $x_2(t-t_d)$ of the reference IO converges to a closed orbit $\Gamma_2$. For asymptotic analysis, ignoring the decaying part, which represents the deviation of the trajectory from $\Gamma_2$, the periodic signal $u_2(t-t_d)$ can be represented by a Fourier series. Moreover, the amplitude of the kth harmonic converges to zero as k tends to infinity and for stability analysis a finite number (N, a sufficiently large integer) of harmonics will suffice. Let $\omega_e$ be the fundamental frequency of oscillation of the reference IO. As such, in the steady-state, it can be assumed that $u_2(t-t_d)$ can be generated by an exosystem $$\dot{x}_e=\Lambda x_e \tag{28}$$

and $u_2(t-t_d)=C_0x_e$ for row vector $C_O$, where the block diagonal matrix $\Lambda$ is $$\Lambda = diag\left\{0, \begin{bmatrix} 0 & -n\omega_e \\ n\omega_e & 0 \end{bmatrix}, n = 0, 1, 2, \ldots N\right\}. \tag{29}$$

Assume that $x_e \epsilon \Omega_{xe}$ and that the set $\Omega_{xe}$ is sufficiently small. This implies that $u_2(t-t_d)$ is small. Since Equation (27) is a function of $x_e$ and Equation (27) is stable, there exists an invariant manifold $\tilde{u}(t)=\tilde{U}(x_e)$ which satisfies the partial differential equation $$\frac{\partial \tilde{U}}{\partial x_e}\Lambda x_e = g_c(\tilde{U}(x_e), x_e). \tag{30}$$

In view of the form of the function $g_c(\tilde{u},u_2(t-t_d))$, Equation (30) has a trivial solution $\tilde{U}=0$, and moreover for small initial conditions $\tilde{u}(0)$, the solution of Equation (27) satisfies $$\|\tilde{u}(t)-\tilde{U}\|\leq\delta_e^{-\mu t}\|\tilde{u}(0)-\tilde{U}\| \tag{31}$$

where "δ" and "μ" are positive numbers. Since $\tilde{U}=0$, according to Equation (31), it follows that for small u $(t-t_d)$, $\tilde{u}$ converges exponentially to zero and this establishes local synchronization of the IOs because $P_v$ is diffeomorphic. However, only local synchronization of the IOs is established using the control law of Equation (22).

Figure 4A:
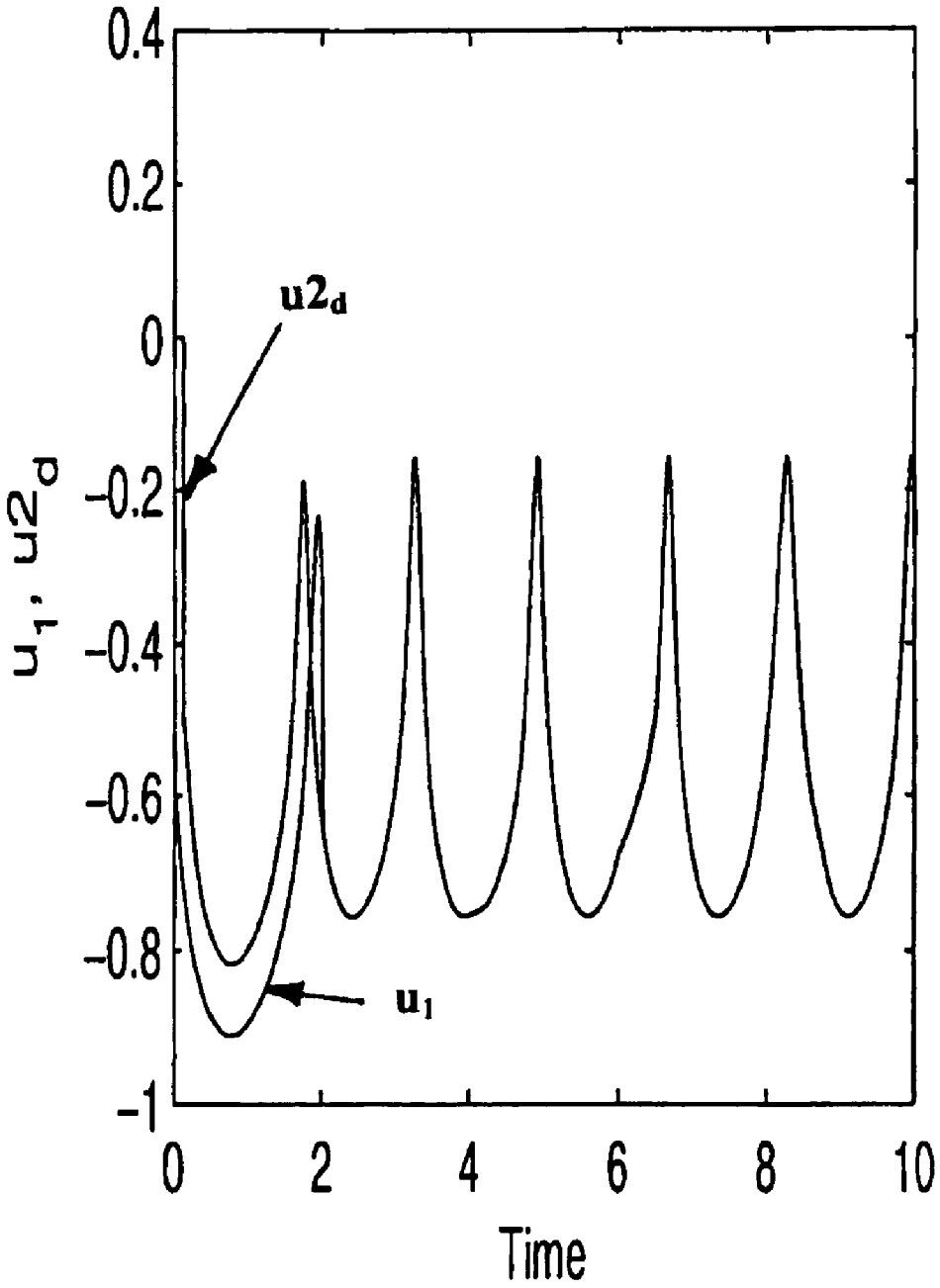
FIG. 4A-4D are each a graph depicting local synchronization using control law $C_v$ with $IO_1$ commanded to track $IO_2$ with a delay 0.125 for $t \in [0, 4)$, 0.25 for $t \in [4, 6)$, 0.5 for $t \in [6, 8)$ and 0.75 for $t \in [8, 10)$ where the controller of $IO_1$ switches at two seconds, plots are of $x_1(t)$ and $x_2(t-t_d)$.
Figure 4B:
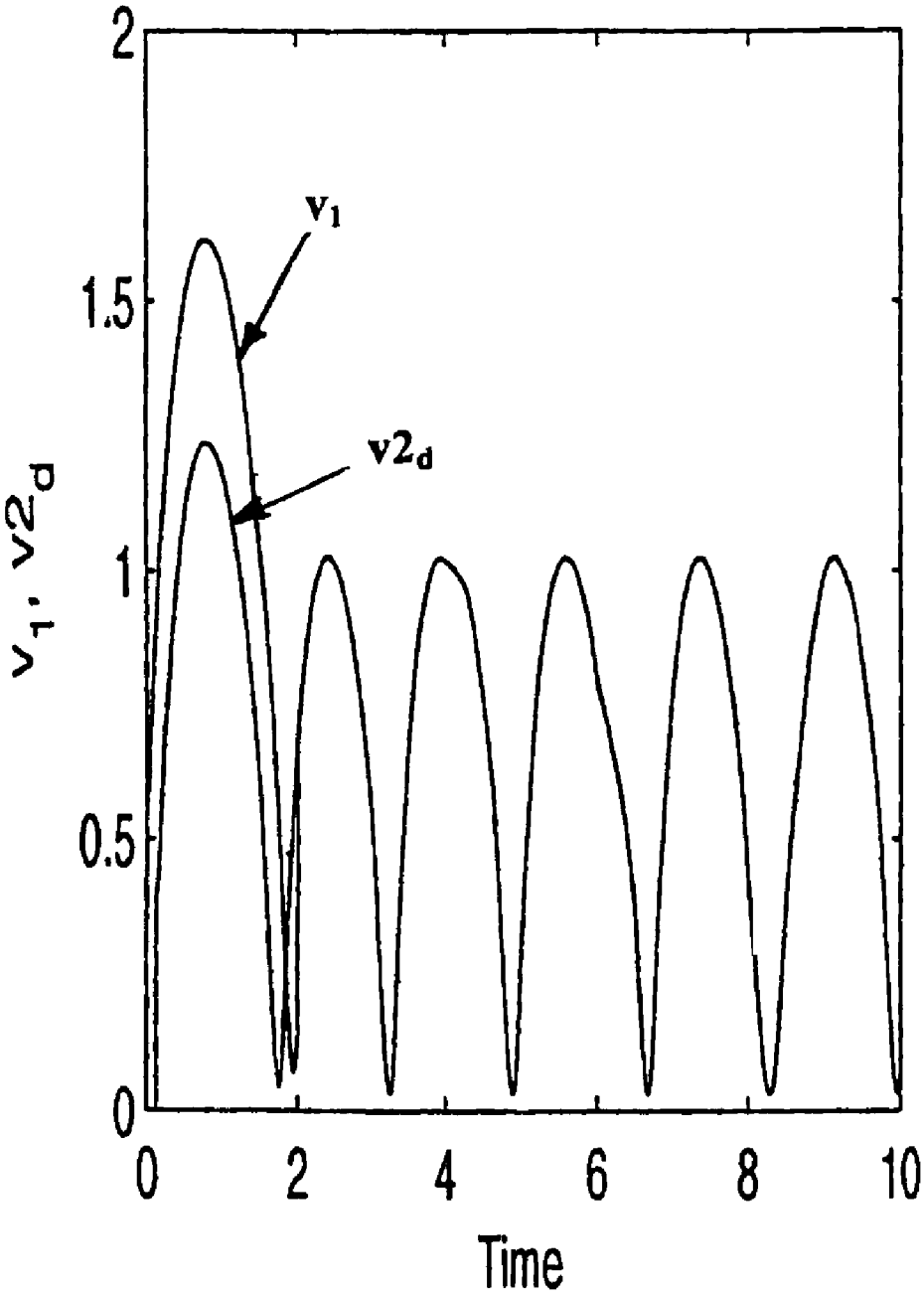
Figure 4C:
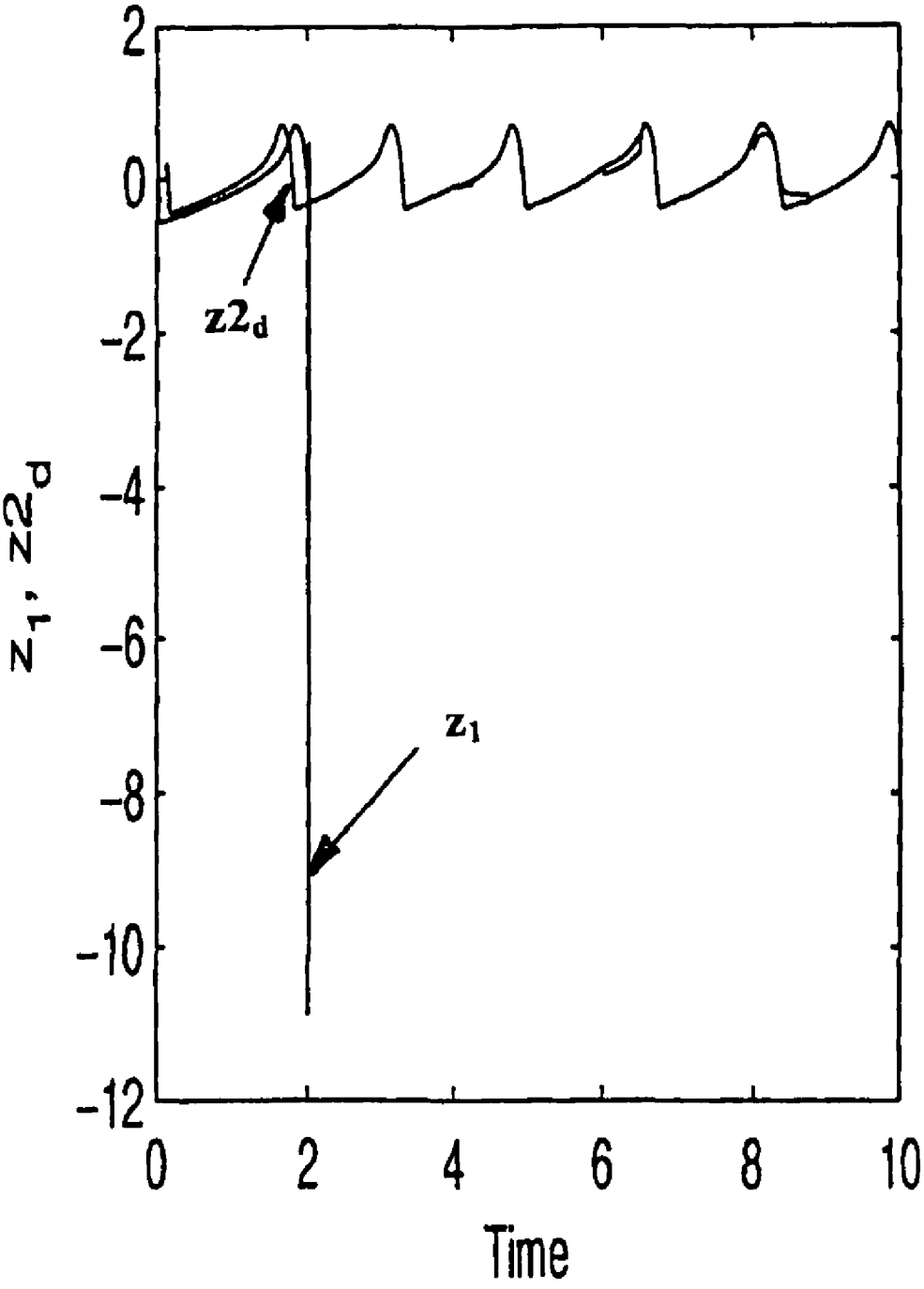
Figure 4D:
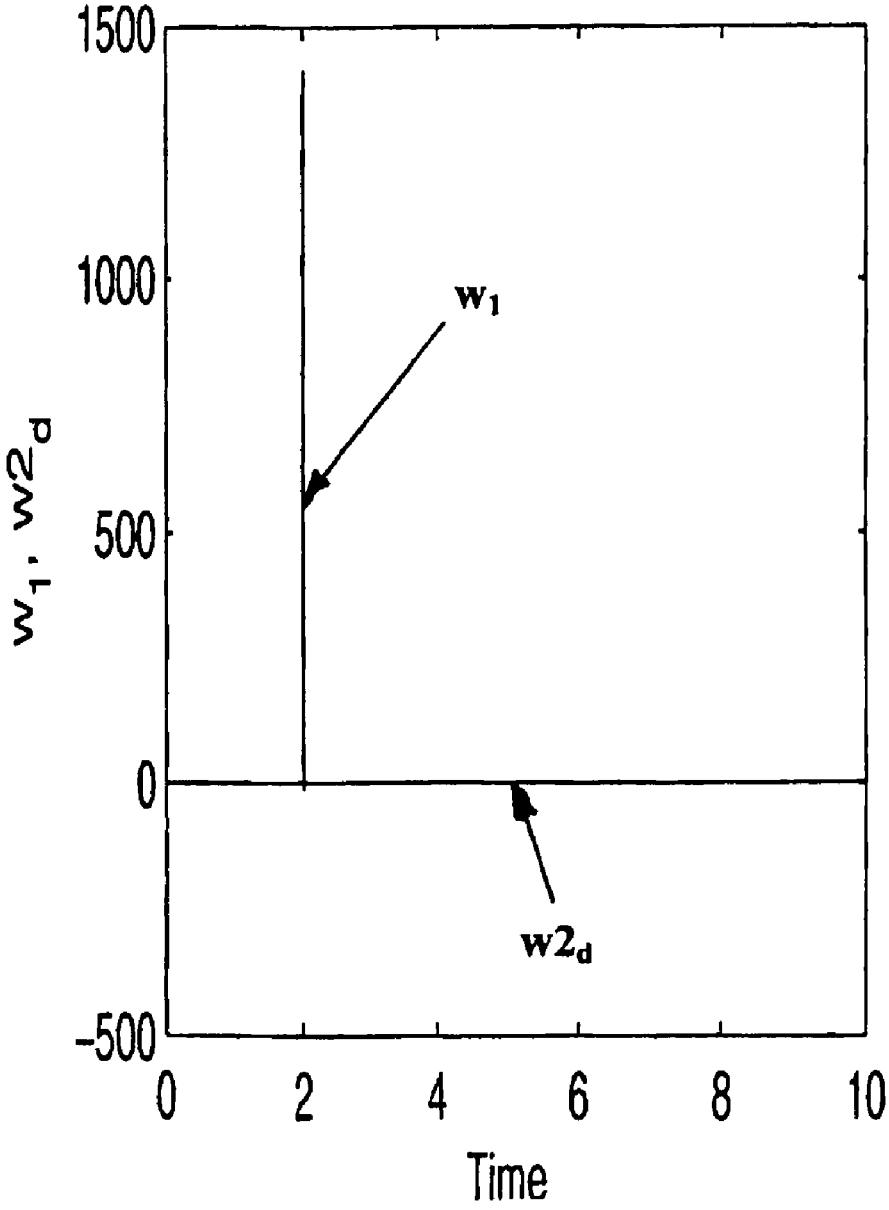
Figure 5A:
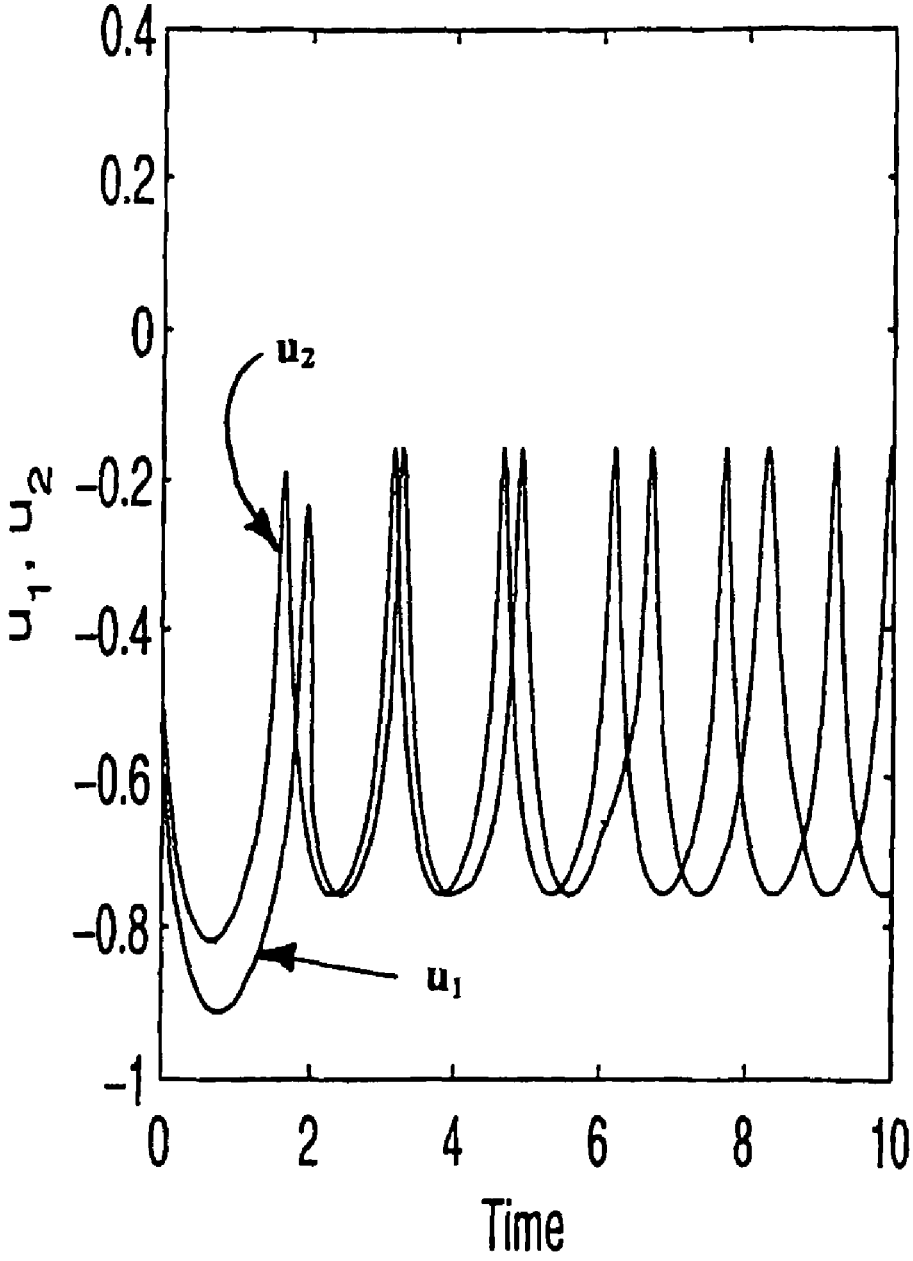
FIG. 5A-5D are each a graph depicting local synchronization using control law, $C_v$, plots of $u_1(t)$, $v_1(t)$, $z_1(t)$ and control inputs $I_{ext1}$, $I_{ext2}$ for the command inputs of FIG. 1A-FIG. 1D.
Figure 5B:
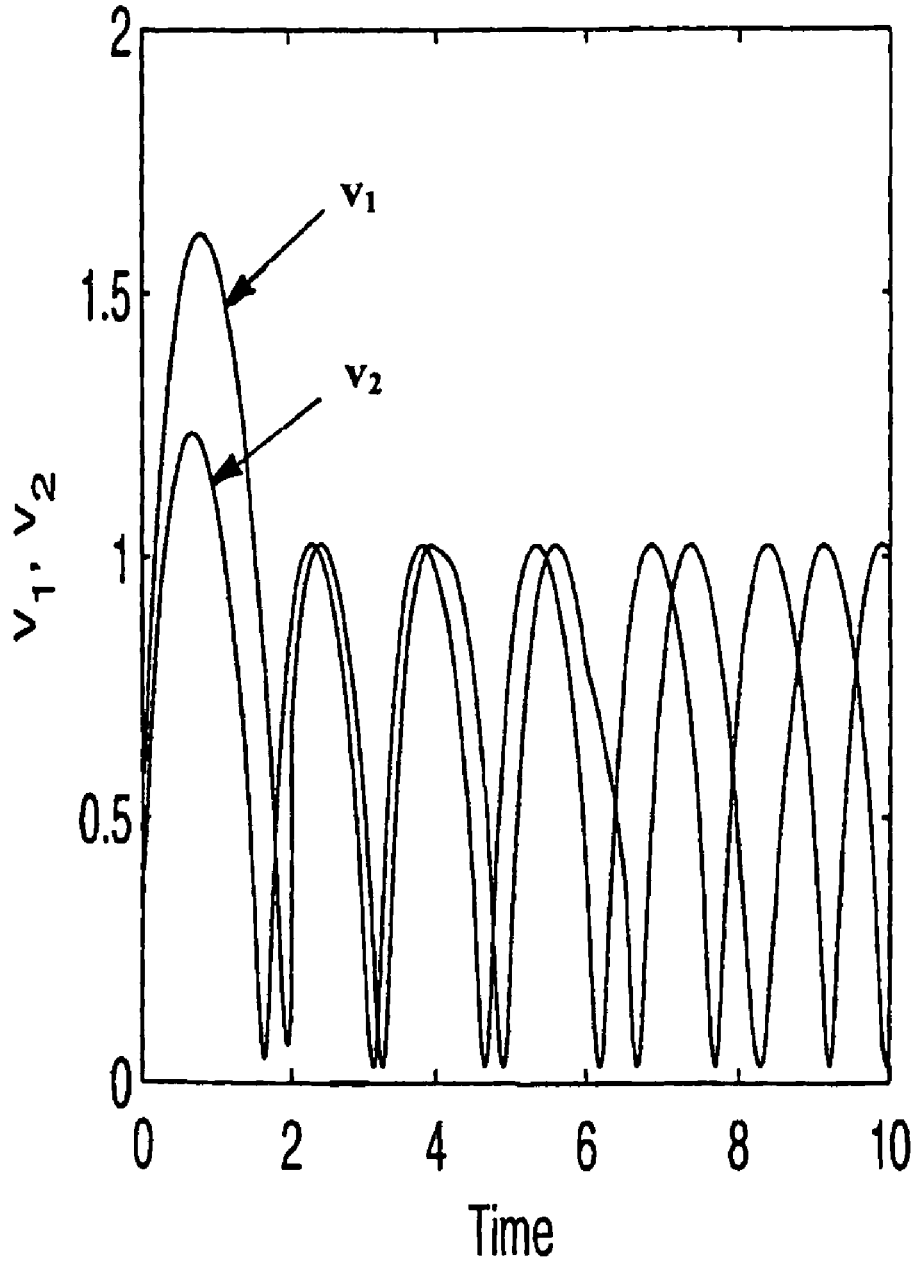
Figure 5C:
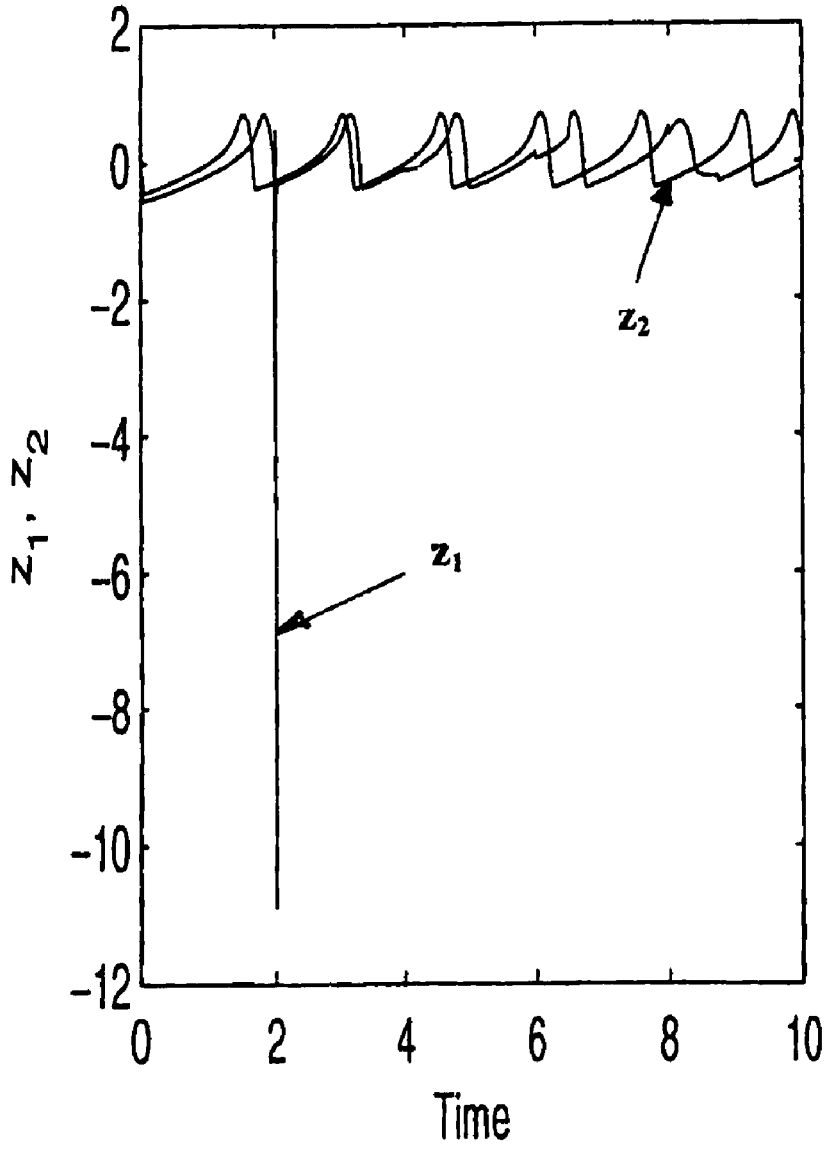
Figure 5D:
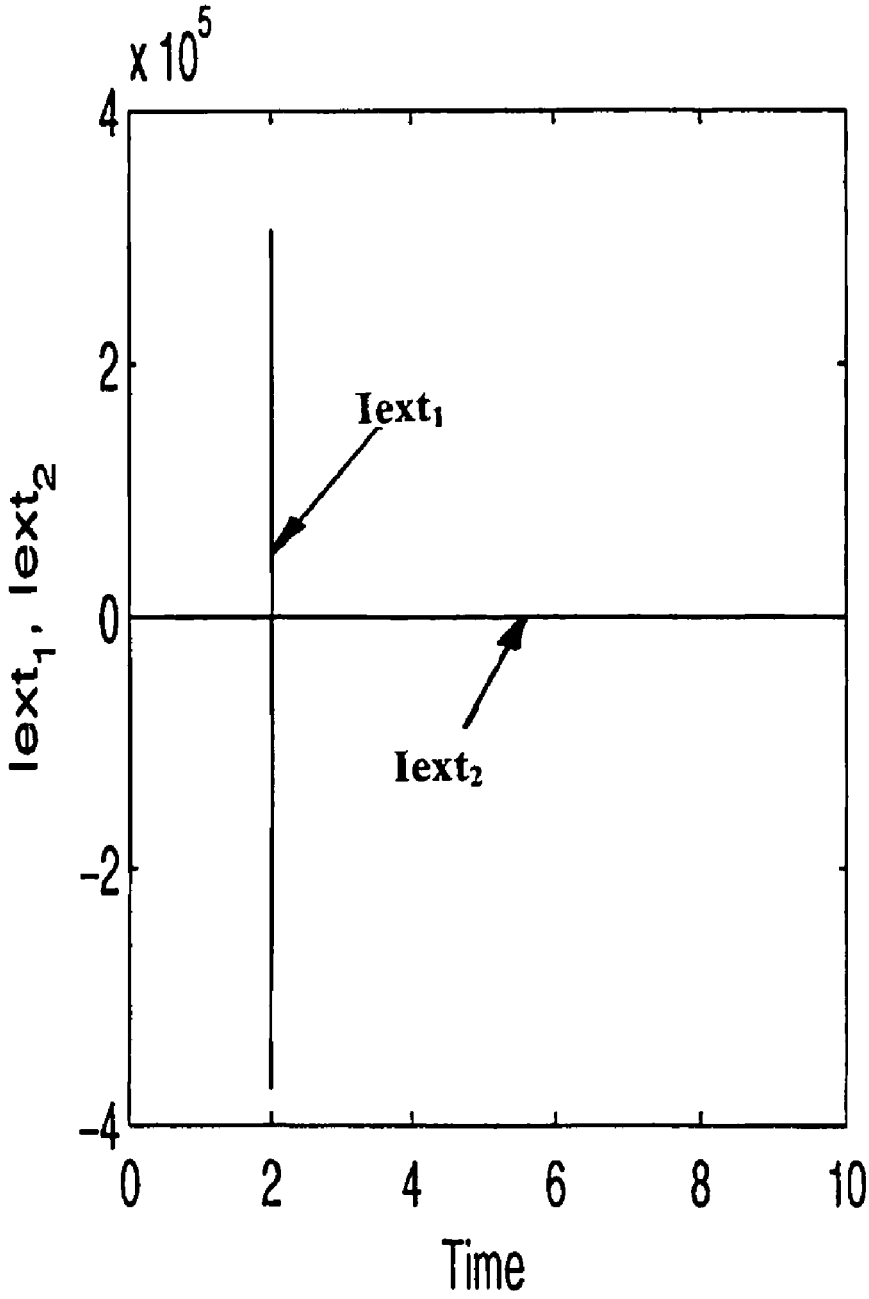

The closed-loop system including the control law of Equation (22) is simulated. The initial conditions, phase command signals and the model parameters of FIG. 1(A)-(D) are retained. The feedback parameters $p_i$ now correspond to the poles −3.5405 and −5(0.521±j1.0681) of the polynomial $\Pi_v(\lambda)$. Simulated responses are shown in FIG. 4(A)-(D) and FIG. 5(A)-(D). Observe that the IOs synchronize following each phase command. The control magnitude is smaller [see FIG. 3(A)-(D)] since the gains chosen are relatively small in this case. Although, it is not easy to establish global stability, it has been found by simulation that synchronization is accomplished for larger values of the initial conditions and different phase command sequences.

Local Synchronization: Control Law ($C_z$)

Consider the derivation of a control law based on $$e(t)=z_1(t)-z_2(t-t_d)=h_z(x_a) \tag{32}$$

as the controlled output. For this choice of "e" it is easily verified that for j=0,1, one has $$e^{(j)}(t) = L_f^i h_z(x_a(t)) \tag{33}$$

and for $j = 2$ gives $$e^{(j)}(t) = L_f^i h_z(x_a(t)) + L_g L_f^{j-1} h_z(x_a(t))u_{c1} \doteq a_{z1}(\tilde{x}, t) + b_{z1}u_{c1} \tag{34}$$

where one can show that $b_{z1}=\epsilon_{Ca}$. Since the control input appears in the second derivative of the output e for the first time for the system of Equation (9), the output e has the relative degree r=2.

In view of Equation (34), an input-output linearizing control law is selected as $$u_{c1} = b_{z1}^{-1}\left( - a_{z1} - \sum_{j=0}^{1} p_j L_f^j h_v(x_a(t))\right) \tag{35}$$

where $p_j$, j=0,1, are the constant feedback gains. Substituting the control law of Equation (35) in Equation (34) gives the output equation of the form $$e^{(2)}+p_1\dot{e}+p_0e=0. \tag{36}$$

The gains $p_i$ are chosen such that the characteristic polynomial $$\Pi_z(\lambda)=\lambda^2+p_1\lambda+p_0 \tag{37}$$

associated with Equation (36) is Hurwitz.

The zero dynamics in this case are described by the Equations $$\begin{bmatrix} \dot{\tilde{u}} \\ \dot{\tilde{v}} \end{bmatrix} = \begin{bmatrix} -ak\,\epsilon_{Na}^{-1} & -k\,\epsilon_{Na}^{-1} \\ k & 0 \end{bmatrix} \begin{bmatrix} \tilde{u} \\ \tilde{v} \end{bmatrix} + \begin{bmatrix} g_u \\ 0 \end{bmatrix} \tag{38}$$

where $$g_u = k\,\epsilon_{Na}^{-1} [(1 + a - 3u_2(t - t_d))\tilde{u}^2 + (2(1 + a)u_2(t - t_d) - 3u_2^2(t - t_d))\tilde{u} - \tilde{u}^3] \tag{39}$$

and a diffeomorphism $p_z(\xi, t)$ exists such that $\tilde{x}=P_z(\xi,t)$ where now $\xi=(\tilde{u},\tilde{v},e,\dot{e})^T$, and $$\tilde{x} = P_z(\xi, t) = \begin{bmatrix} \tilde{u} \\ \tilde{v} \\ e \\ -\dot{e} + p_{1z}(e + z_2(t - t_d)) - p_{2z}(z_2(t - t_d)) \end{bmatrix} \tag{40}$$

It follows that if the origin $(\tilde{u},\tilde{v})=0$ of the zero dynamics is asymptotically stable and $(e,\dot{e})\rightarrow 0$, then $\xi$ tends to zero which implies the convergence of $\tilde{x}$ to zero.

For the parameters of the IO, the matrix $$A_z = \begin{bmatrix} -ak\,\epsilon_{Na}^{-1} & -k\,\epsilon_{Na}^{-1} \\ k & 0 \end{bmatrix} \tag{41}$$

is Hurwitz (i.e., the eigenvalues have a negative real part). In the steady state, $g_u$ is a function of $x_e$, the state of the exosystem of Equation (28). In this case, in view of the center manifold theorem, for $x_e \in \Omega_{xe}$, there exists an invariant manifold $(\tilde{u}, \tilde{v})=(\tilde{U}(x_e), \tilde{V}(x_e))$ which satisfies the set of partial differential equations $$\begin{aligned} \frac{\partial \tilde{U}}{\partial x_e}\Lambda x_e &= -ak\,\epsilon_{Na}^{-1}\,\tilde{U}(x_e) - k\,\epsilon_{Na}^{-1}\,\tilde{V}(x_e) + g_u\{\tilde{U}(x_e), x_e\} \\ \frac{\partial \tilde{V}}{\partial x_e}\Lambda x_e &= k\tilde{U}(x_e) \end{aligned} \tag{42}$$

These equations are satisfied by $(\tilde{U}(x_e), \tilde{V}(x_e))=0$.

Similar to the arguments based on either the Jacobian linearization or the center manifold theorem, it can be concluded that for small $u_2(t-t_d)$, the origin of the zero dynamics is exponentially stable (in a local sense), and thereby local synchronization is accomplished. Note that this control law is simpler that $C_v$.

Figure 6A:
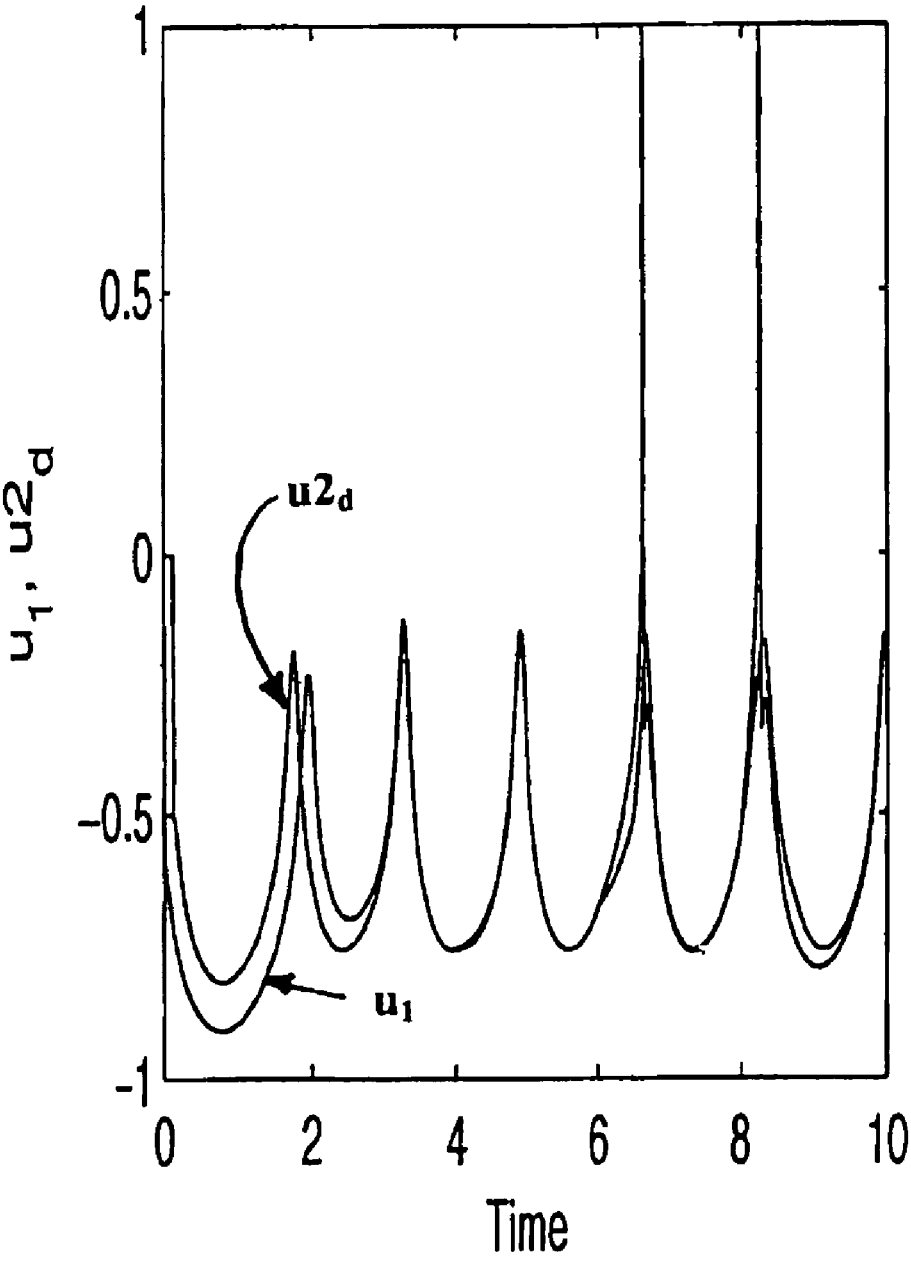
FIG. 6A-6D are each a graph depicting local synchronization using control law $C_z$ with $IO_1$ commanded to track $IO_2$ with a delay 0.125 for $t \in [0, 4)$, 0.25 for $t \in [4, 6)$, 0.5 for $t \in [6, 8)$, and 0.75 for $t \in [8, 10)$ with the controller of $IO_1$ switching at two seconds, plots are of $x_1(t)$ and $x_2(t-t_d)$.
Figure 6B:
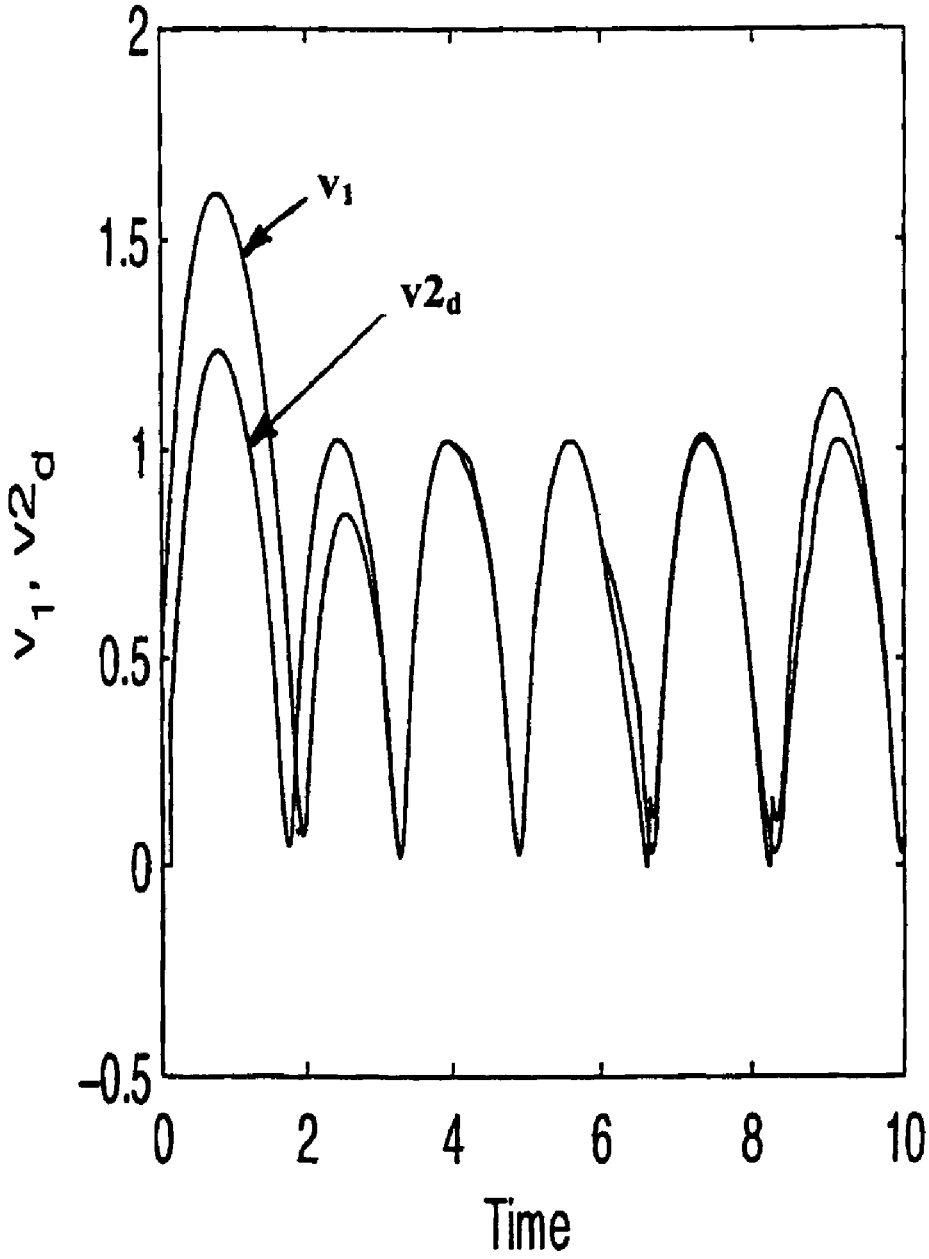
Figure 6C:
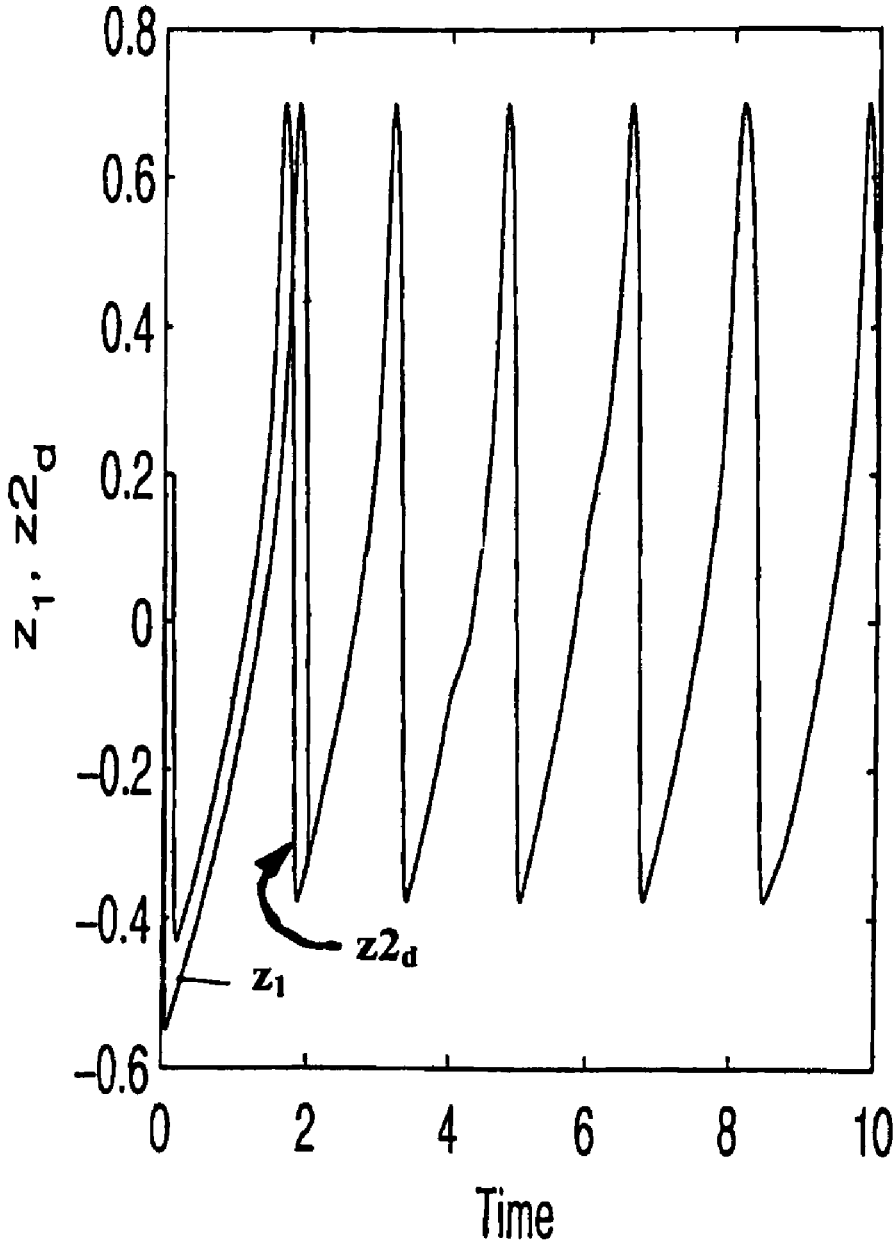
Figure 6D:
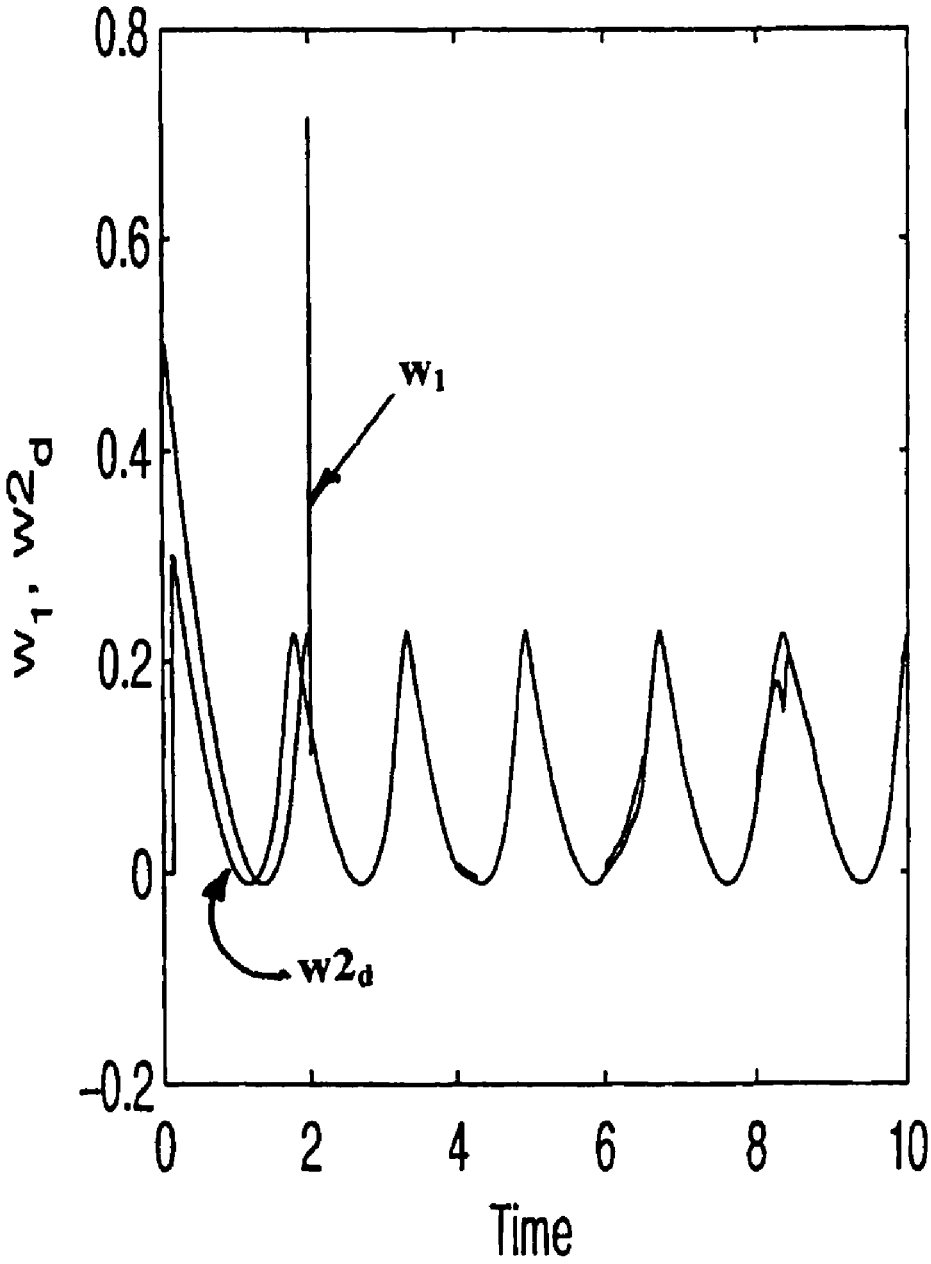
Figure 7A:
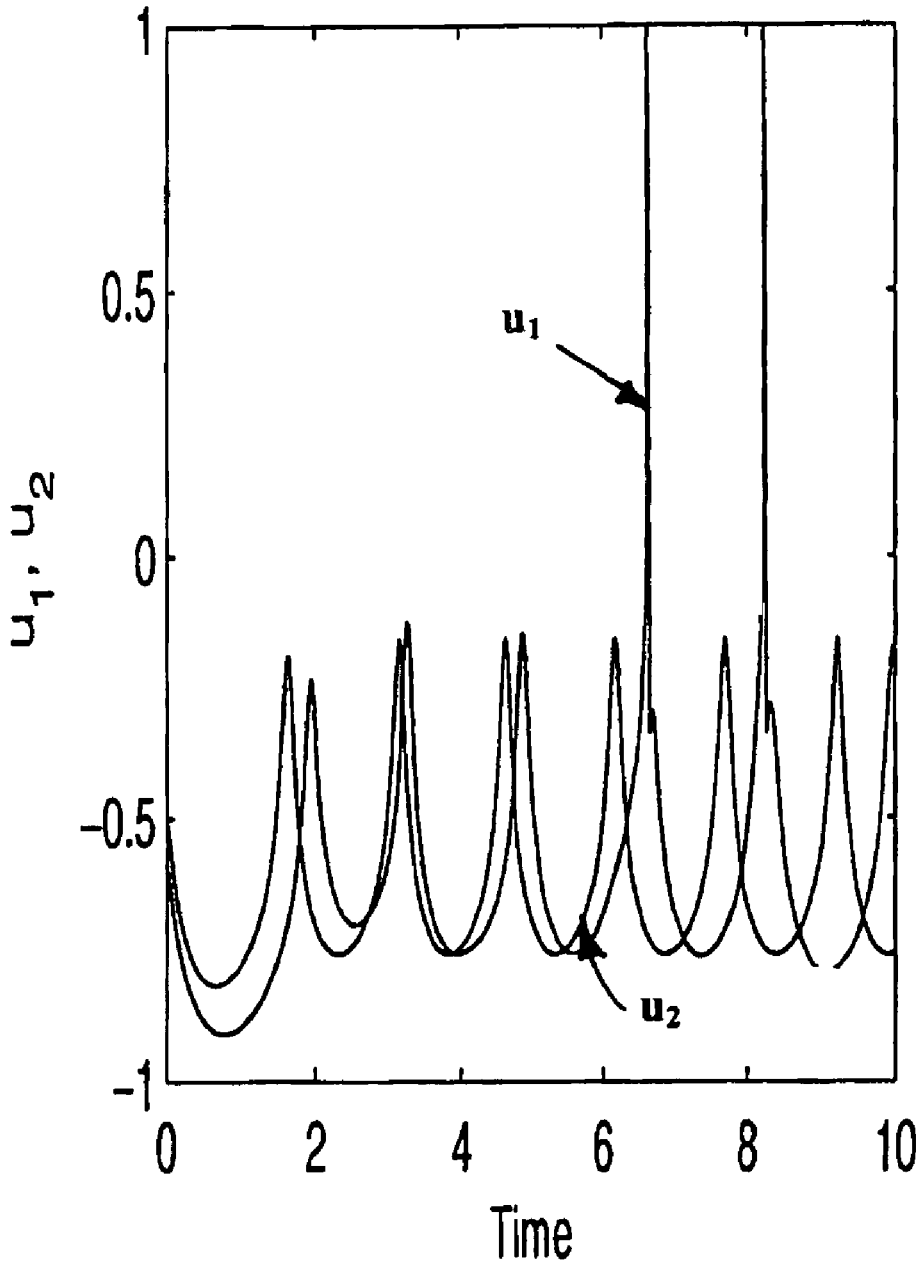
FIG. 7A-7D are each a graph depicting local synchronization using control law, $C_z$, plots of $u_1(t)$, $v_1(t)$, $z_1(t)$ and control inputs $I_{ext1}$, $I_{ext2}$ for the command inputs of FIG. 1A-1D.
Figure 7B:
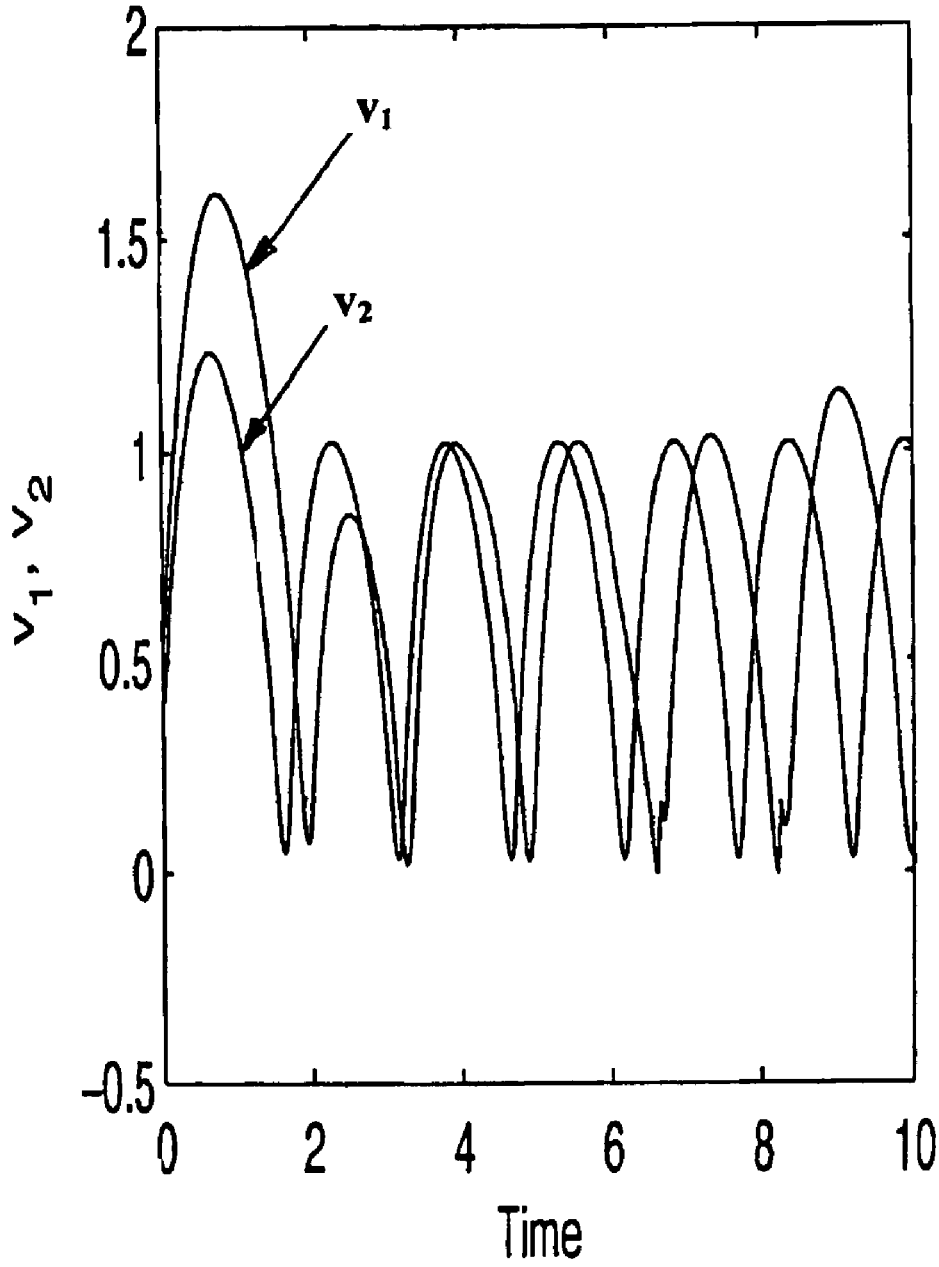
Figure 7C:
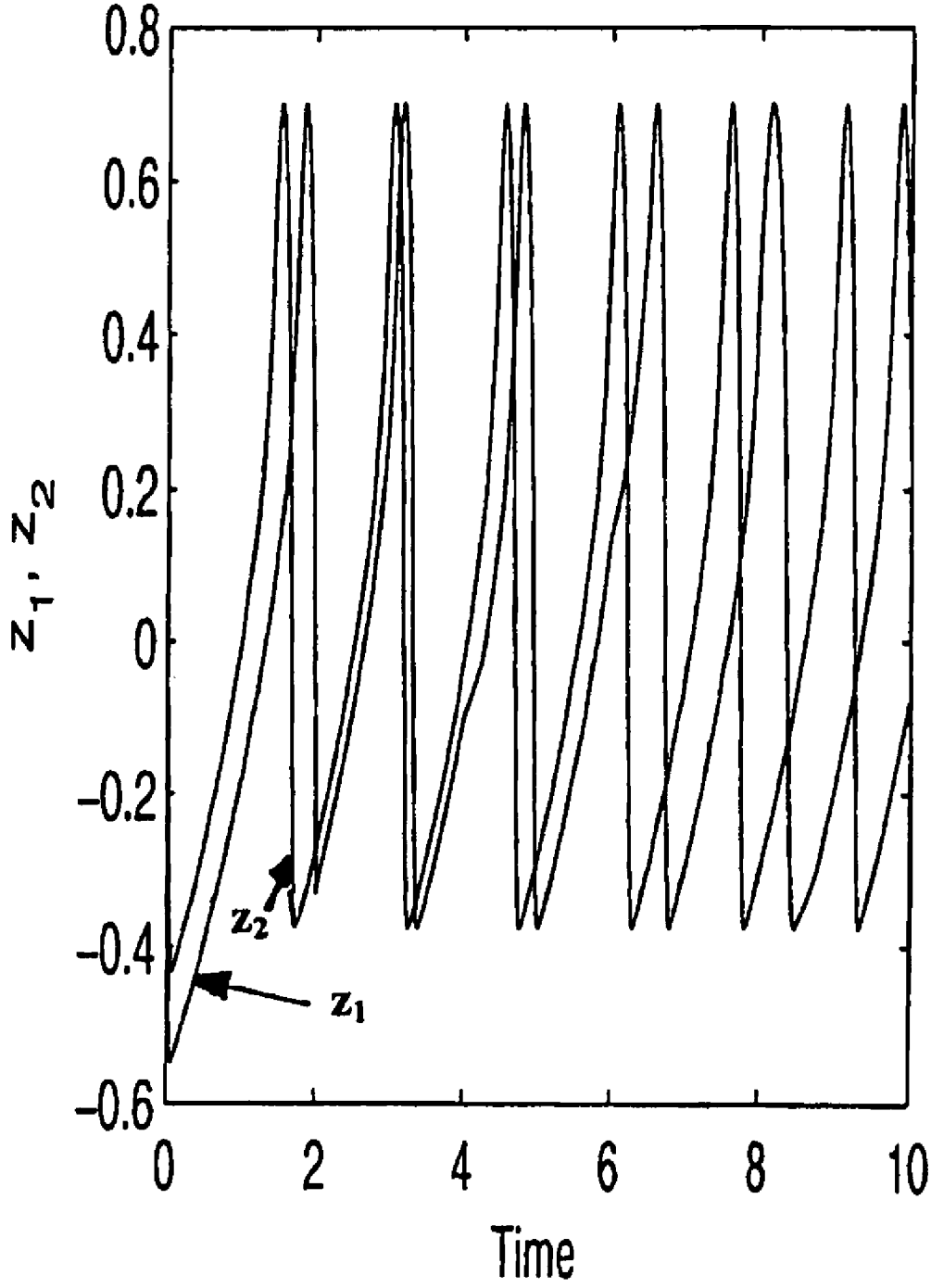
Figure 7D:
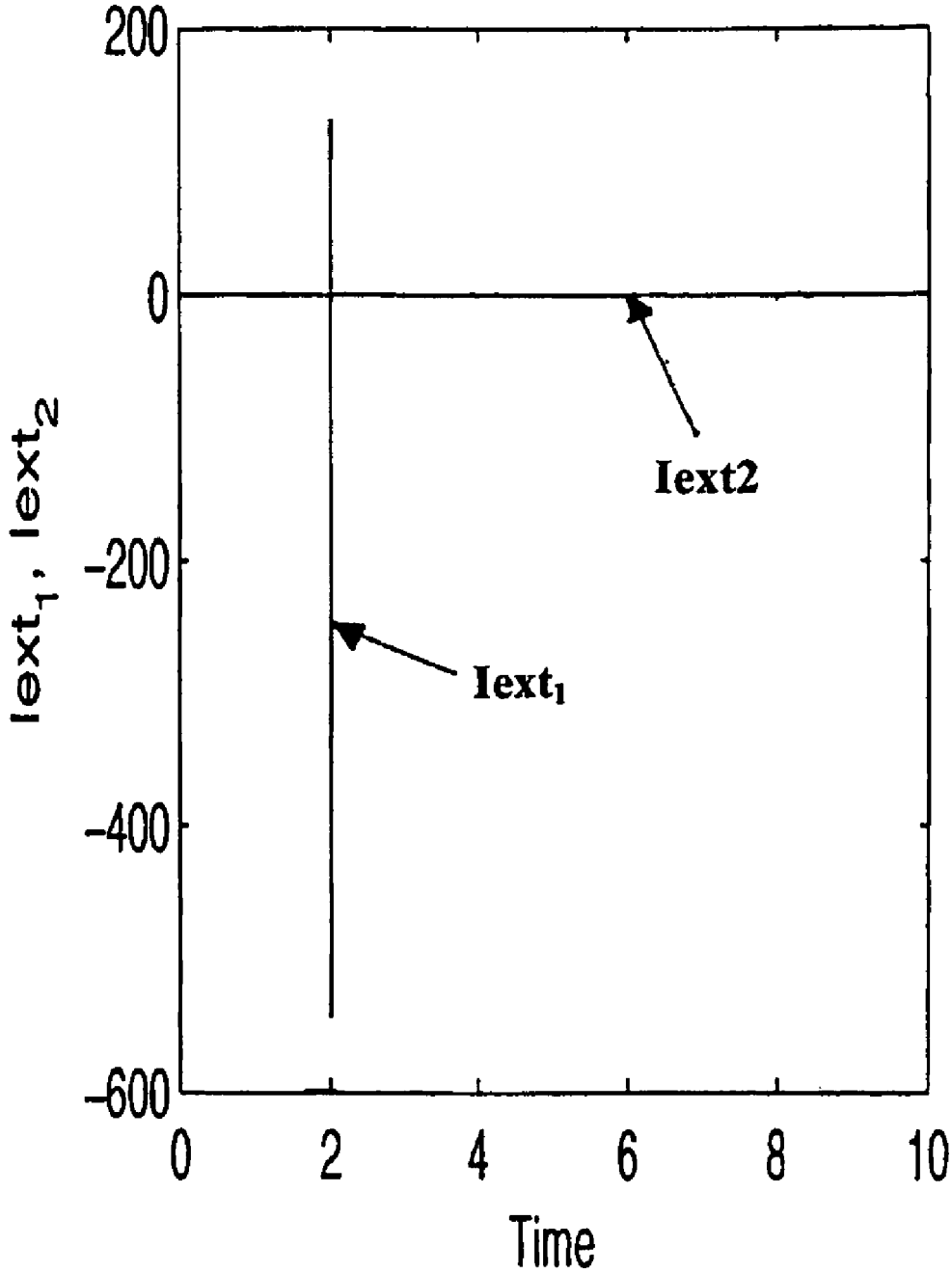

Simulation results are now presented for the closed-loop system of Equations (5) and (35). The parameter values, command input sequence, and the initial conditions of FIG. 1(A)-(D) are retained. The feedback gains are chosen are so that the poles of the e-dynamics are at (−7.07±j7.072). Simulated responses are shown in FIG. 6(A)-(D) and FIG. 7(A)-(D). Synchronization is accomplished and the (z and w)-responses are smoother and control input is smaller than those obtained using the control laws, $C_u$ and $C_v$. However, sharper peaking of u- and w-response is observable at certain instances, when the phase command changes. However, the stability results have been established only for the local synchronization.

Local Synchronization: Control Law ($C_w$)

A still simpler control law for the choice of the controlled output variable is:

$$e(t)=w_1(t)-w_2(t-t_d)=\tilde{w}=h_w(x_a(t)). \tag{43}$$

For this choice, one has $$\dot{e}(t)=L_f h_w(x_a(t))+L_g h_w(x_a(t))u_{c1}(t) \tag{44}$$

and the control law is $$u_{c1}=\tilde{z}(t)+p_0\,\epsilon_{Ca}^{-1}\,\tilde{w} \tag{45}$$

where $p_o$ is any positive number. Thus the control law has simple linear feedback terms involving only the $\tilde{z}$ and $\tilde{w}$ variables and are independent of $u_i$ and $v_i$.

The output $\tilde{w}$ now satisfies a first-order equation $$\dot{\tilde{w}}+p_0\tilde{w}=0 \tag{46}$$

and in the closed-loop system $\tilde{w}$ tends to zero. However, the stability in the closed-loop system will depend on the stability property of the zero dynamics which is now of dimension three.

The zero dynamics in this case are obtained by setting $\tilde{w}=0$ and can be shown to be described by $$\begin{bmatrix}\dot{\tilde{u}}\\ \dot{\tilde{v}}\\ \dot{\tilde{z}}\end{bmatrix}=\begin{bmatrix}-ak\in_{Na}^{-1} & -k\in_{Na}^{-1} & 0\\ k & 0 & -k\\ 0 & 0 & -a\end{bmatrix}\begin{bmatrix}\tilde{u}\\ \tilde{v}\\ \tilde{z}\end{bmatrix}+\begin{bmatrix}g_u(\tilde{u},t)\\ 0\\ g_z(\tilde{z},t)\end{bmatrix}\doteq A_w(\tilde{u},\tilde{v},\tilde{z})^T+g_{uz}(\tilde{u},\tilde{z},t) \tag{47}$$

where $g_{uz}(\tilde{u},\tilde{z},t)=(g_u,0,g_z)^T$ and $$g_z-(1+a-3z_2(t-t_d))\tilde{z}^2+(2(1+a)z_2(t-t_d)-3z_2^2(t-t_d))\tilde{z}-\tilde{z}^3. \tag{48}$$

Apparently if the origin $(\tilde{u},\tilde{v},\tilde{z})=0$ of the zero dynamics is asymptotically stable, then $\tilde{x}$ converges to zero as $\tilde{w}$ tends to zero.

In Equation (47), the matrix $A_w$ is Hurwitz and the periodic signals $u_2(t-t_d)$ and $z_2(t-t_d)$ are functions of the state $x_e$ of the exosystem. In this case, in view of the functions $g_u$ and $g_z$ in Equation (47), one finds that the center manifold is $(\tilde{u},\tilde{v},\tilde{z})=(\hat{U},\hat{V},\hat{Z})=0$. Similar to the arguments used on either the Jacobian linearization or the center manifold theorem, it can be concluded that for small $(u_2(t-t_d),z_2(t-t_d))$, the origin of the zero dynamics is exponentially stable (in a local sense), and thereby local synchronization is accomplished.

Figure 8A:
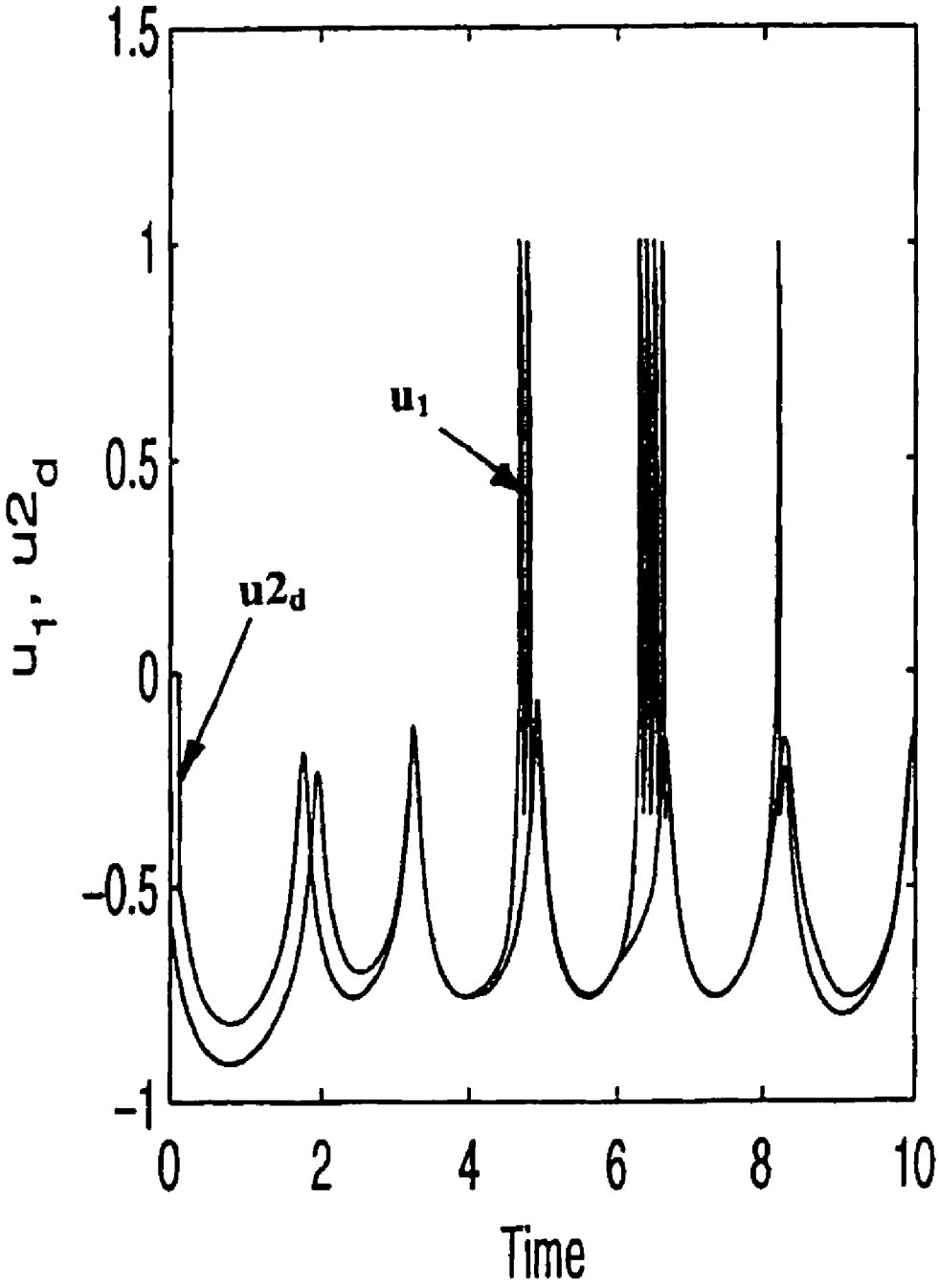
FIG. 8A-8D are each a graph depicting local synchronization using control law $C_w$ with $IO_1$ commanded to track $IO_2$ with a delay 0.125 for $t \in [0, 4)$, 0.25 for $t \in [4, 6)$, $t \in [6, 8)$ and 0.75 for $t \in [8, 10)$ with the controller $IO_1$ switching at two seconds, plots are of $x_1(t)$ and $x_2(t-t_d)$.
Figure 8B:
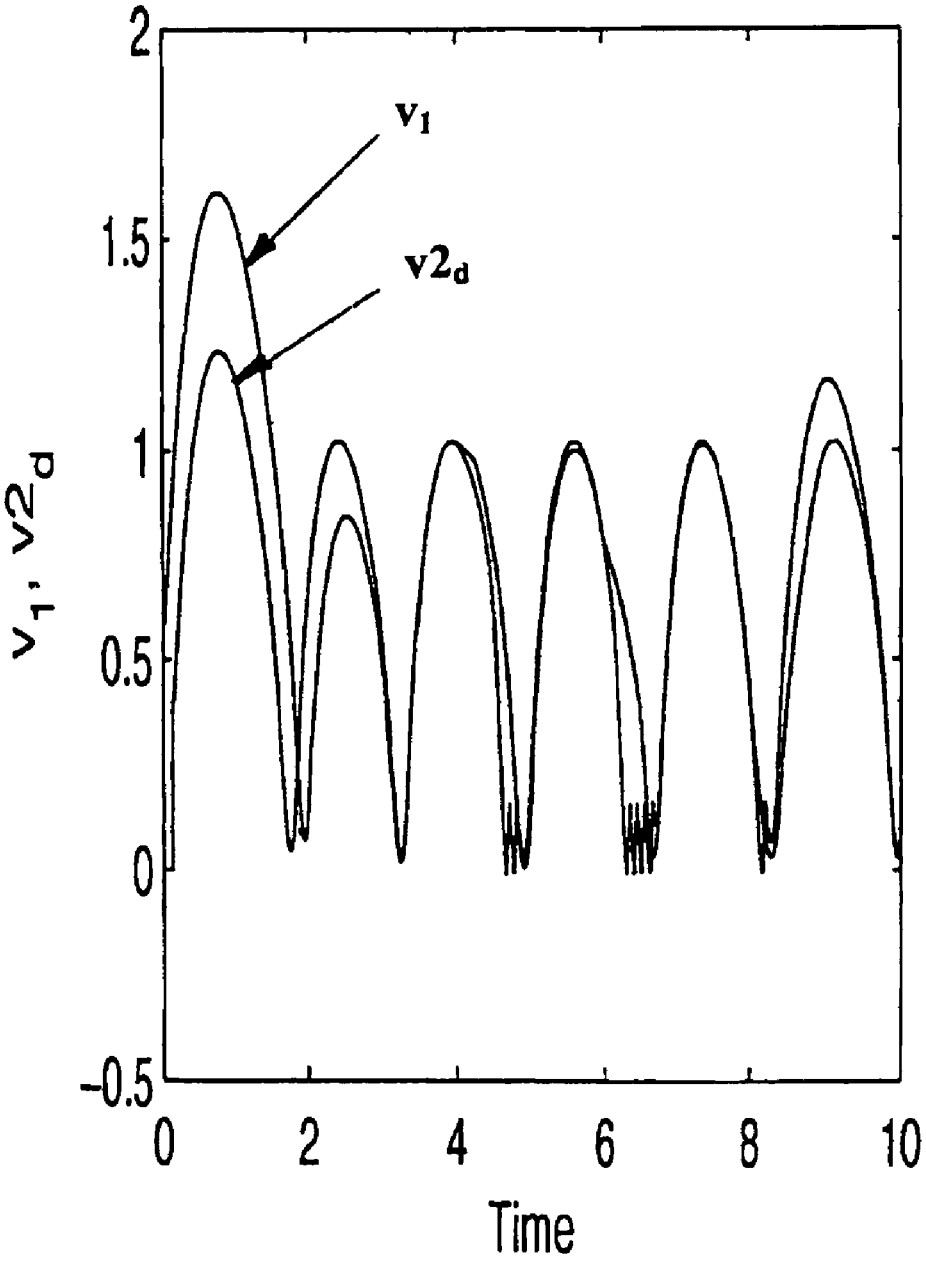
Figure 8C:
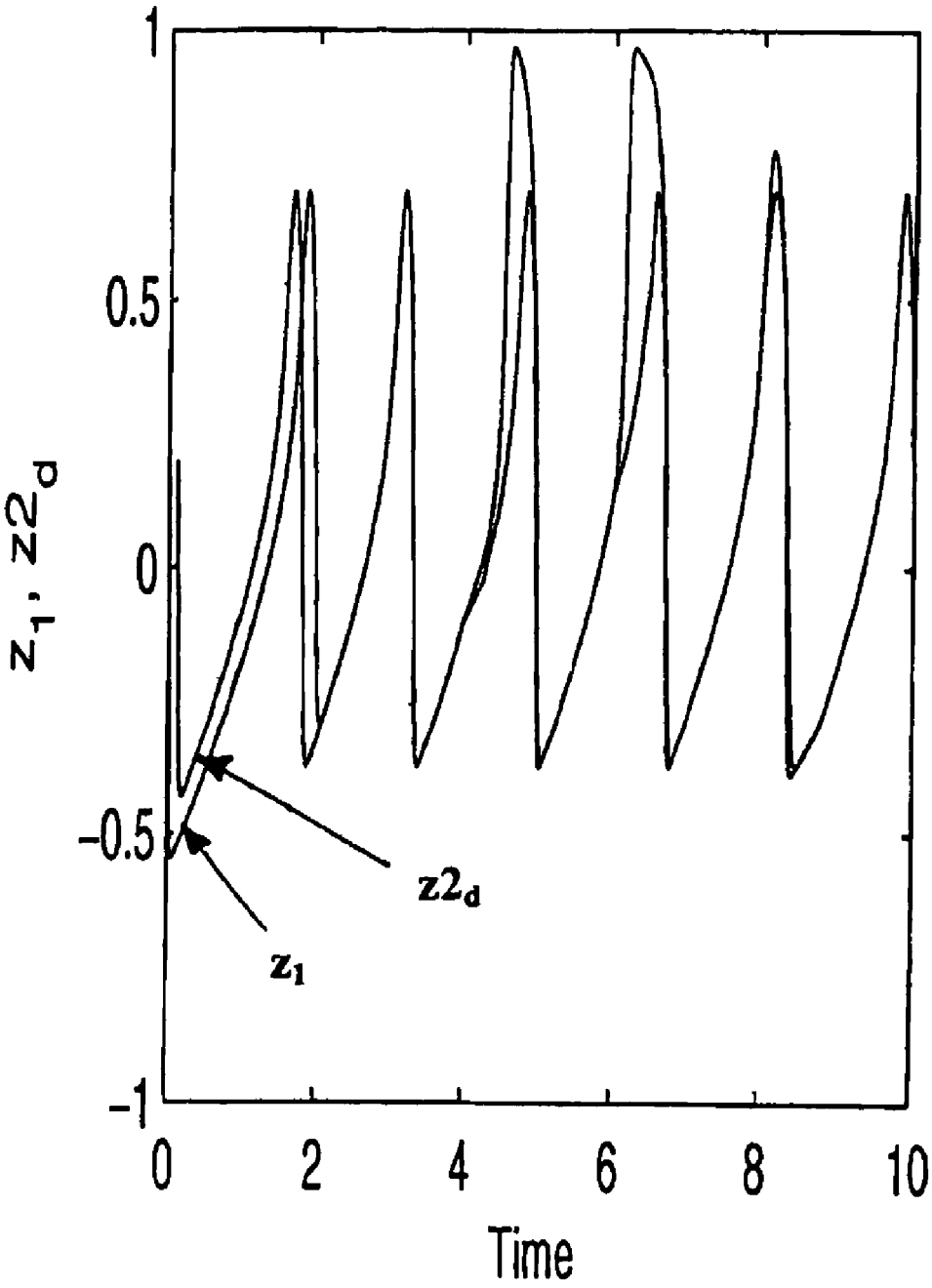
Figure 8D:
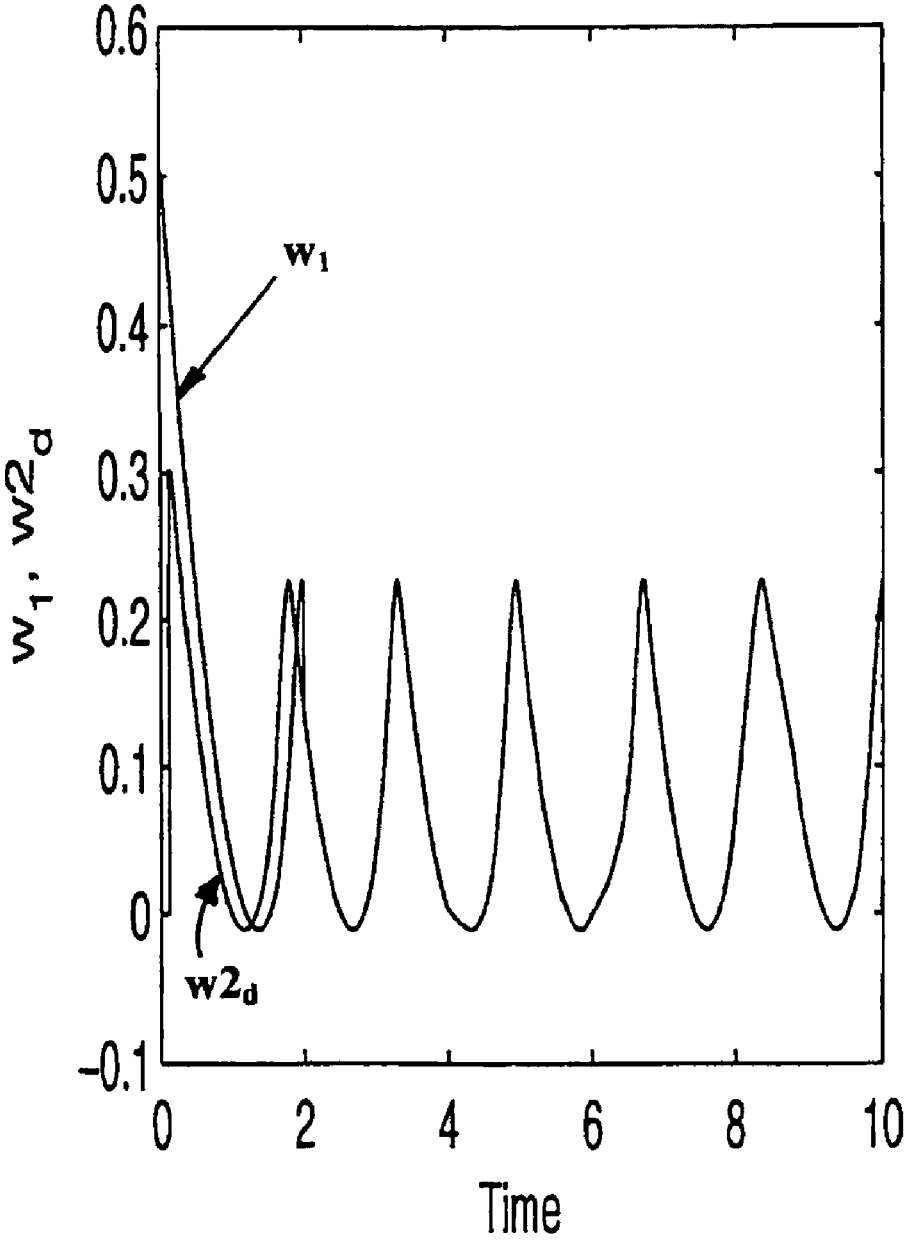
Figure 9A:
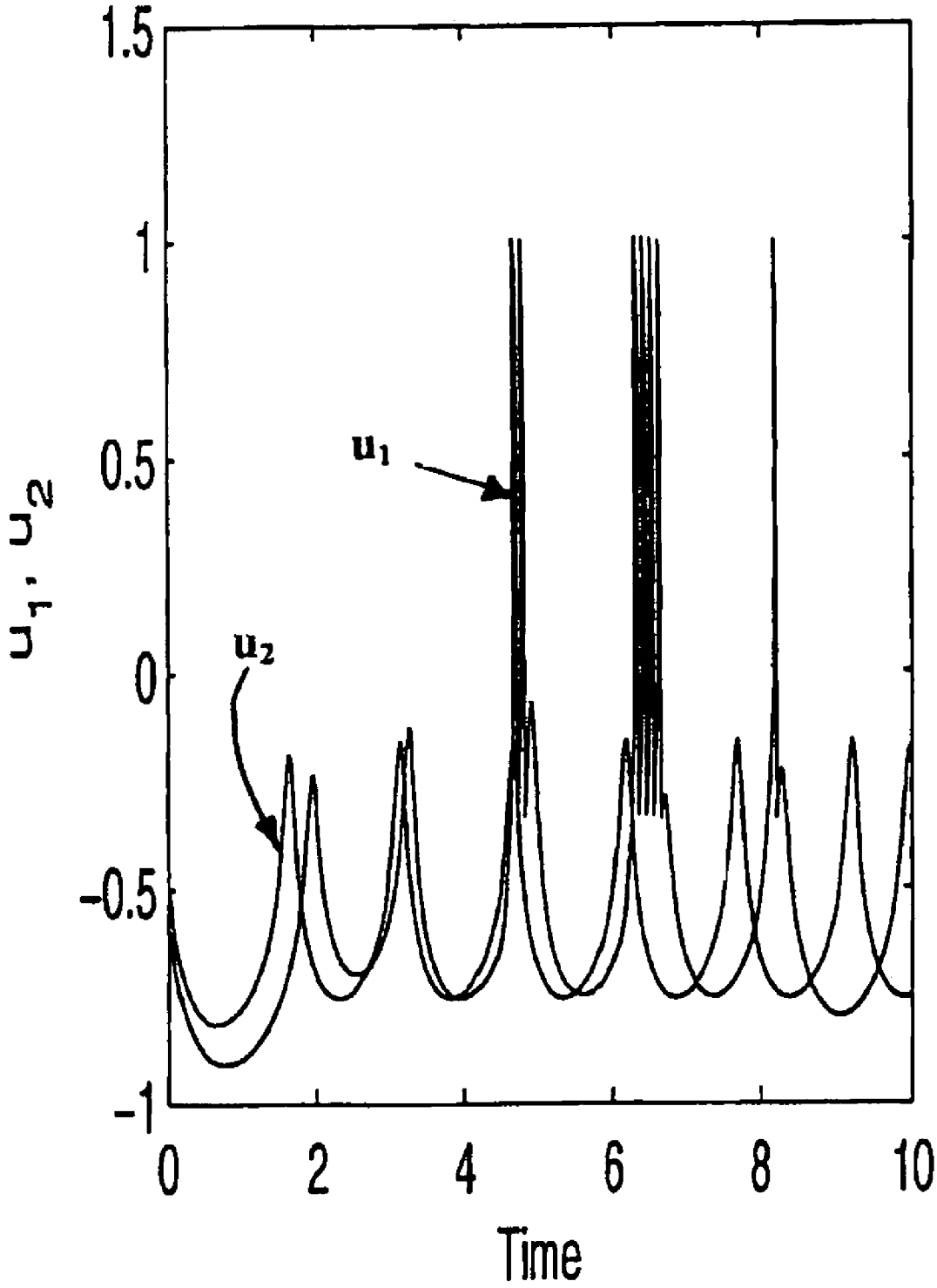
FIG. 9A-9D are each a graph depicting local synchronization using control law, $C_w$, plots of $u_1(t)$, $v_1(t)$, $z_1(t)$ and control inputs $I_{ext1}$, $I_{ext2}$ for the command inputs of FIG. 1A-1D.
Figure 9B:
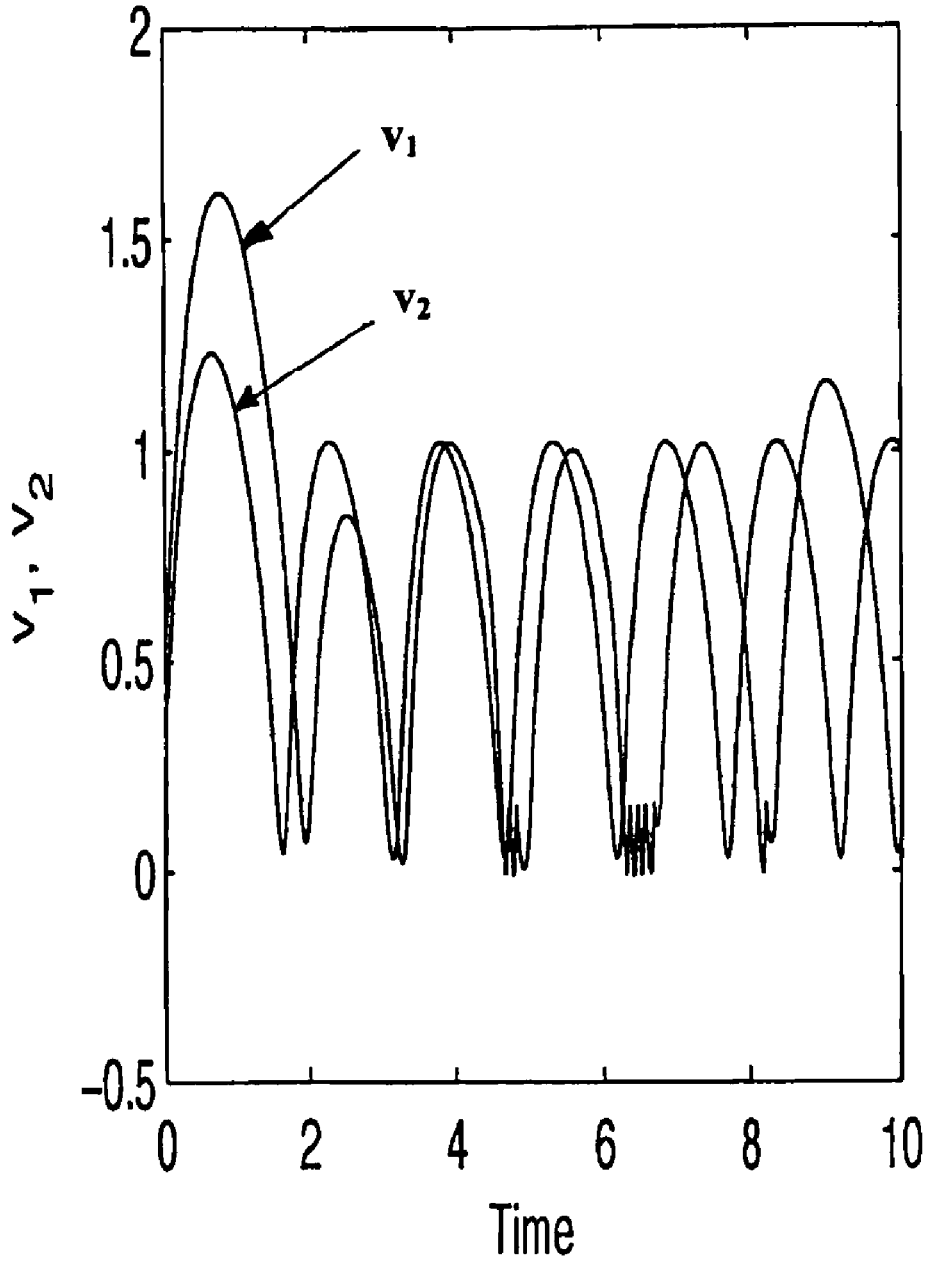
Figure 9C:
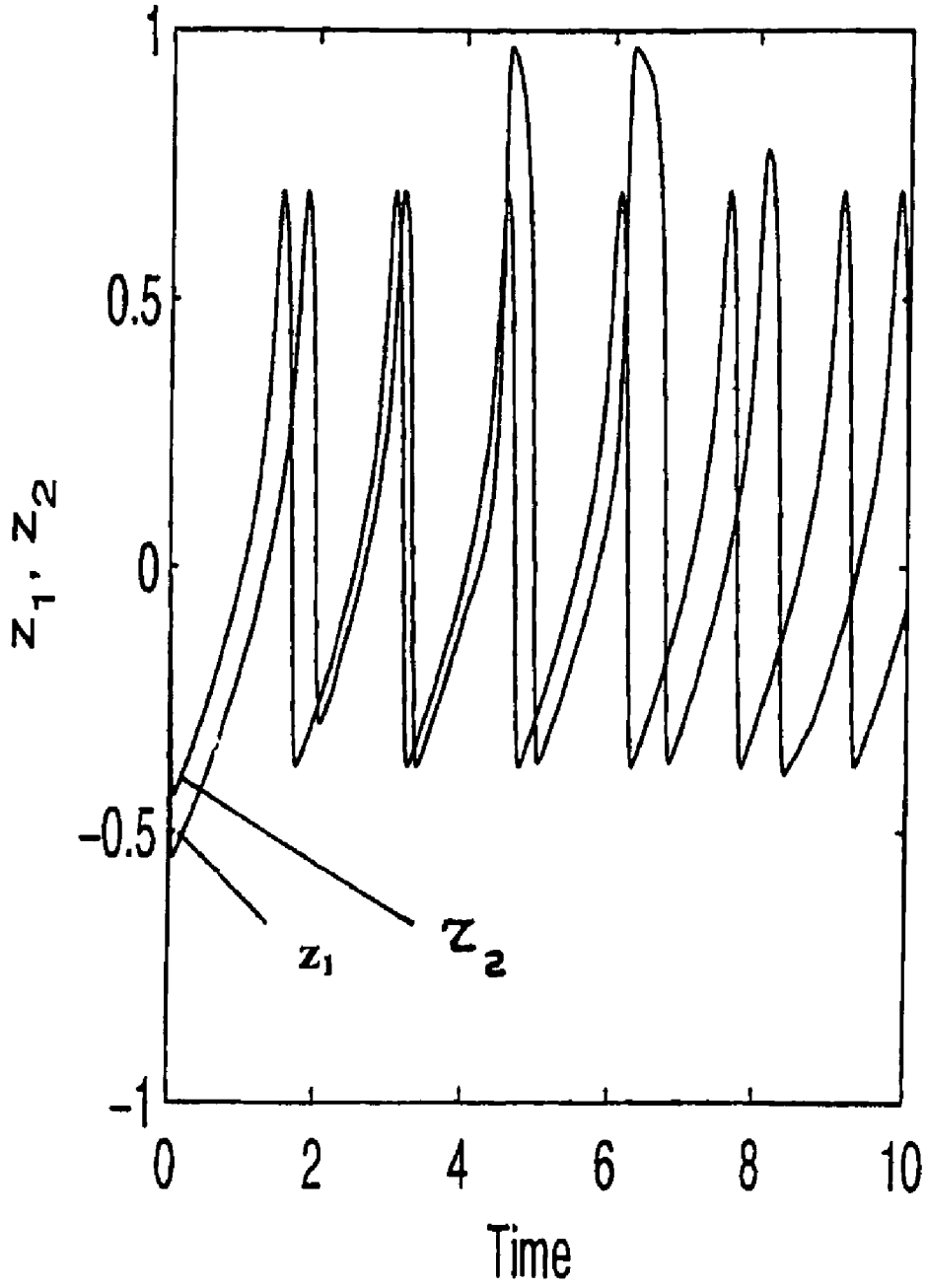
Figure 9D:
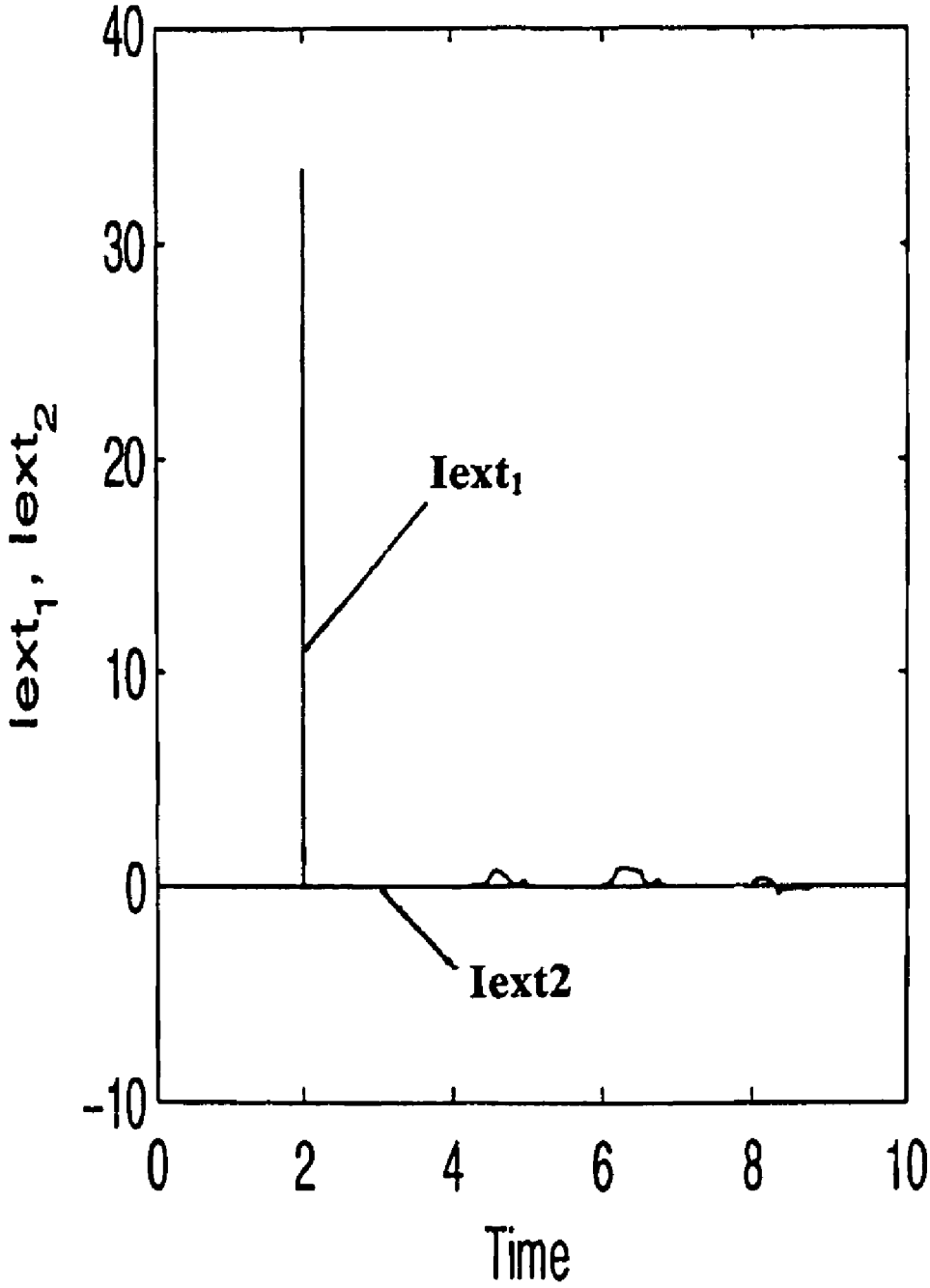

Simulation results are now presented for the closed-loop system of Equation (5) and Equation (45). The parameter values, command input sequence, and the initial conditions of FIG. 1(A)-(D) are retained. The feedback gain chosen is $p_0=8$. The responses are shown in FIG. 8(A)-(D) and FIG. 9(A)-(D). It is observed that synchronization has been accomplished following each change in the phase command signal, but convergence time is larger. The plots of $u_1$ show high frequency oscillation at certain instances, but it has not caused any problems. Only a small control magnitude has been used.

Figure 10A:
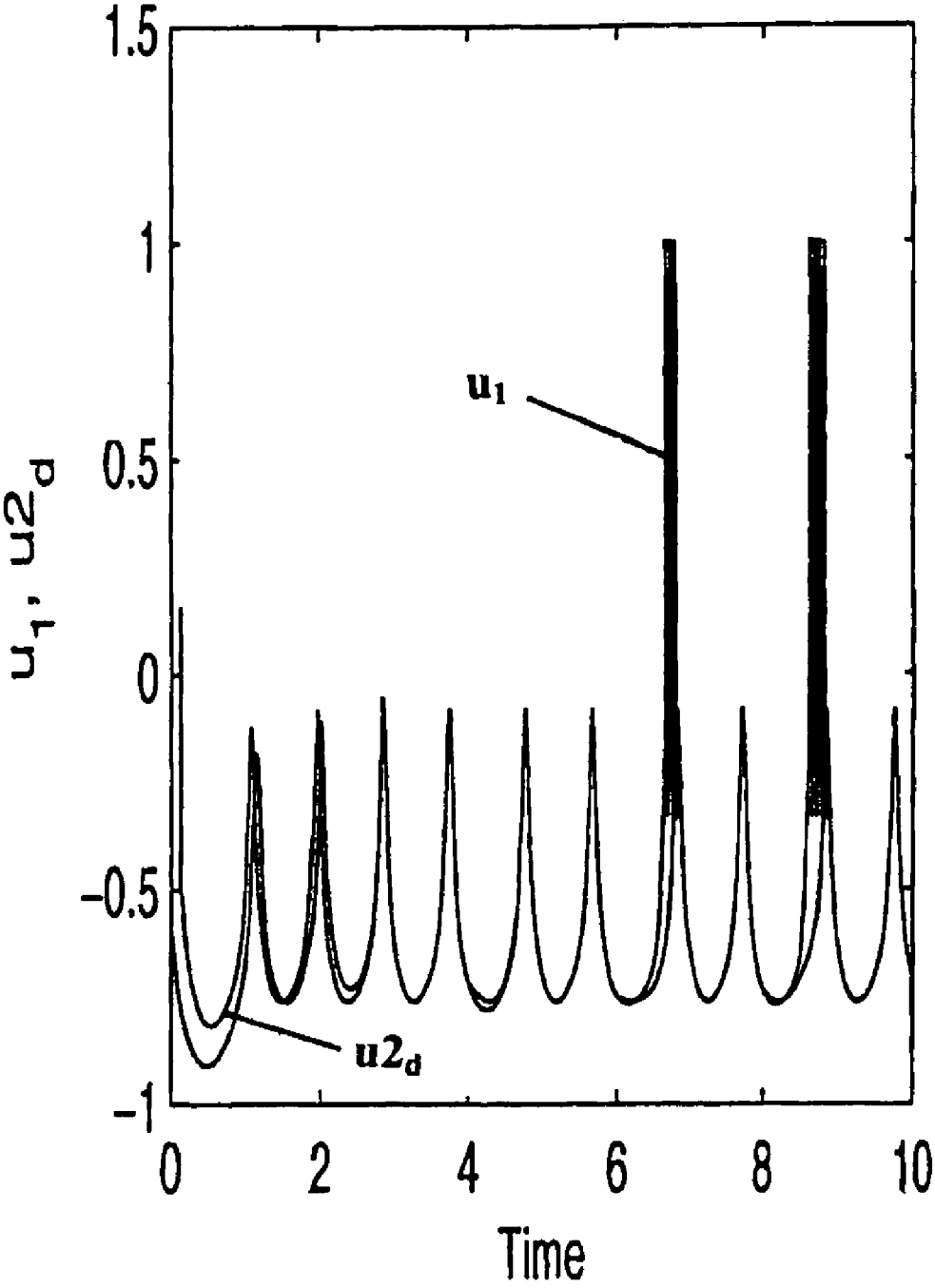
FIG. 10A-10D are each a graph depicting local synchronization using control law $C_w$ (faster oscillation) with $IO_1$ commanded to track $IO_2$ with a delay 0.125 for $t \in [0, 4)$, 0.25 for $t \in [4, 6]$, 0.5 for $t \in [6, 8)$ and 0.75 for $t \in [8, 10)$ with the controller $IO_1$ switching at two seconds, plots are of $x_1(t)$ and $x_2(t-t_d)$.
Figure 10B:
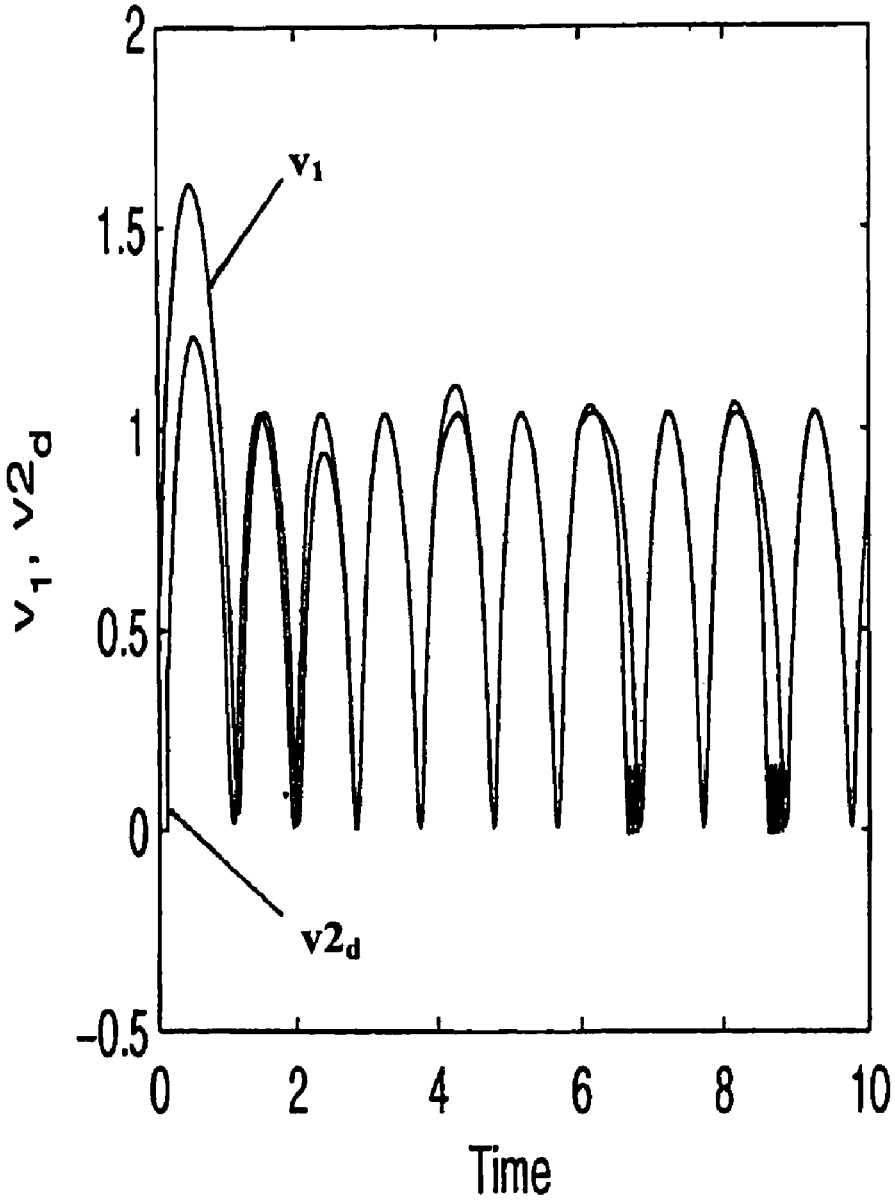
Figure 10C:
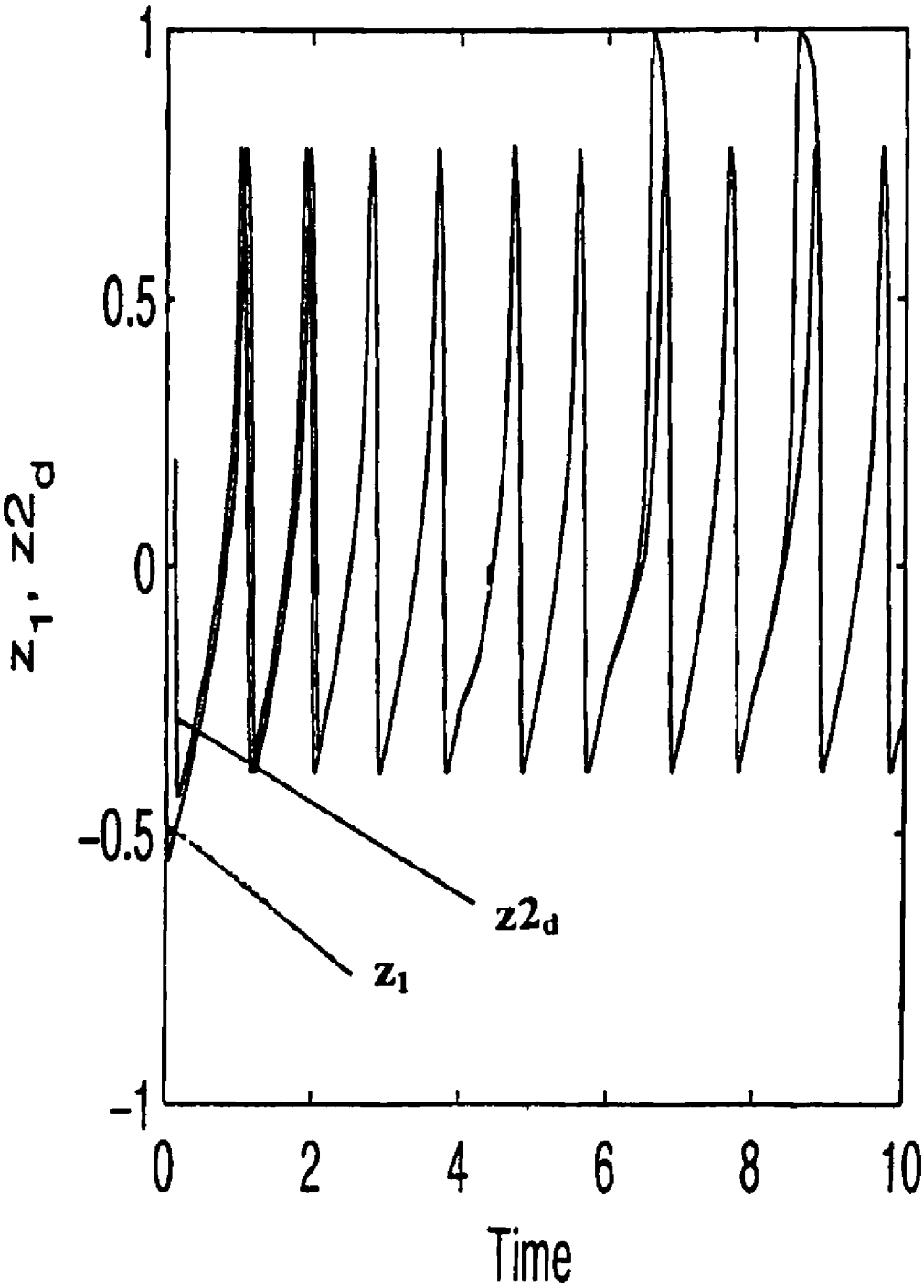
Figure 10D:
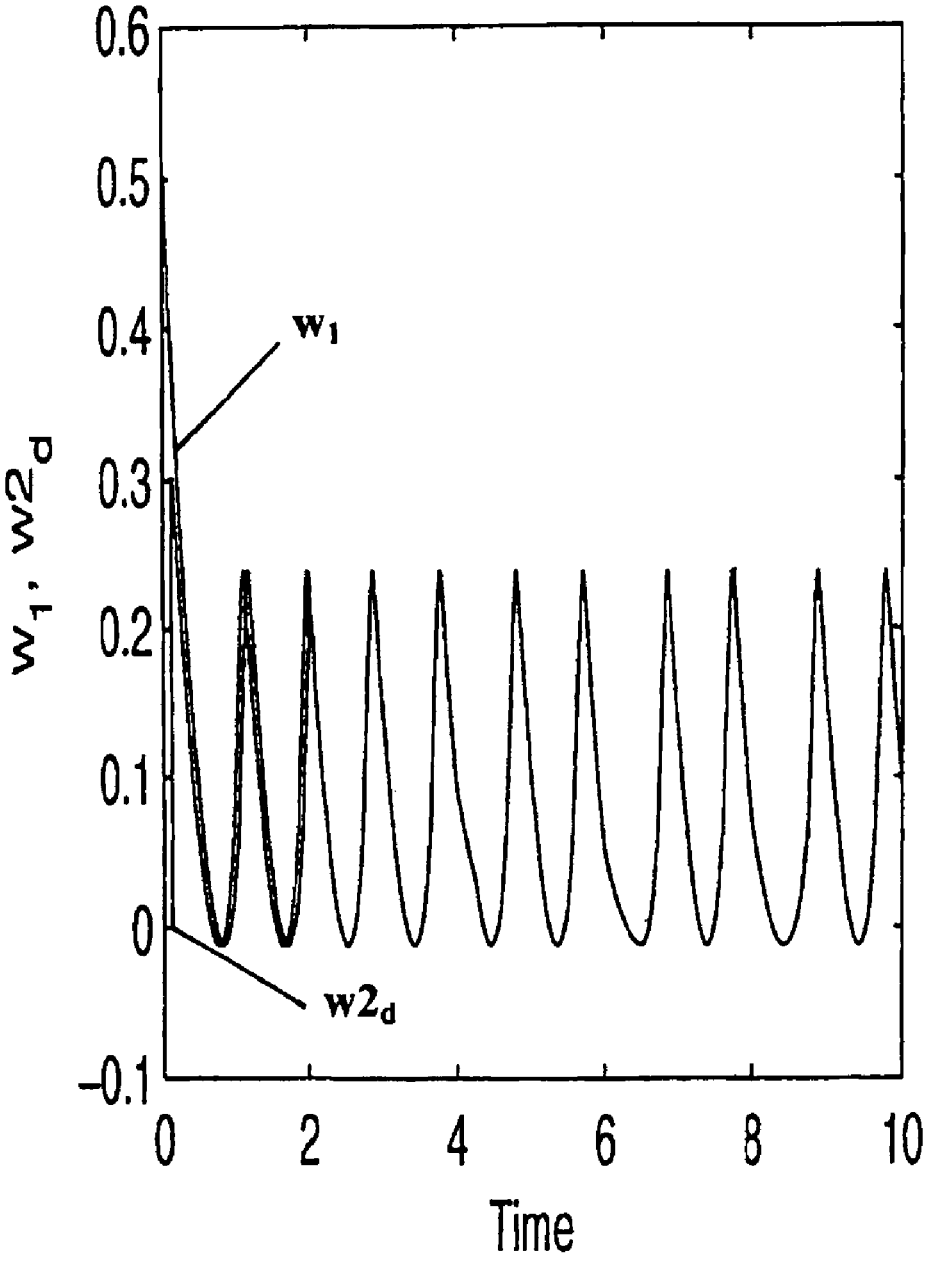
Figure 11A:
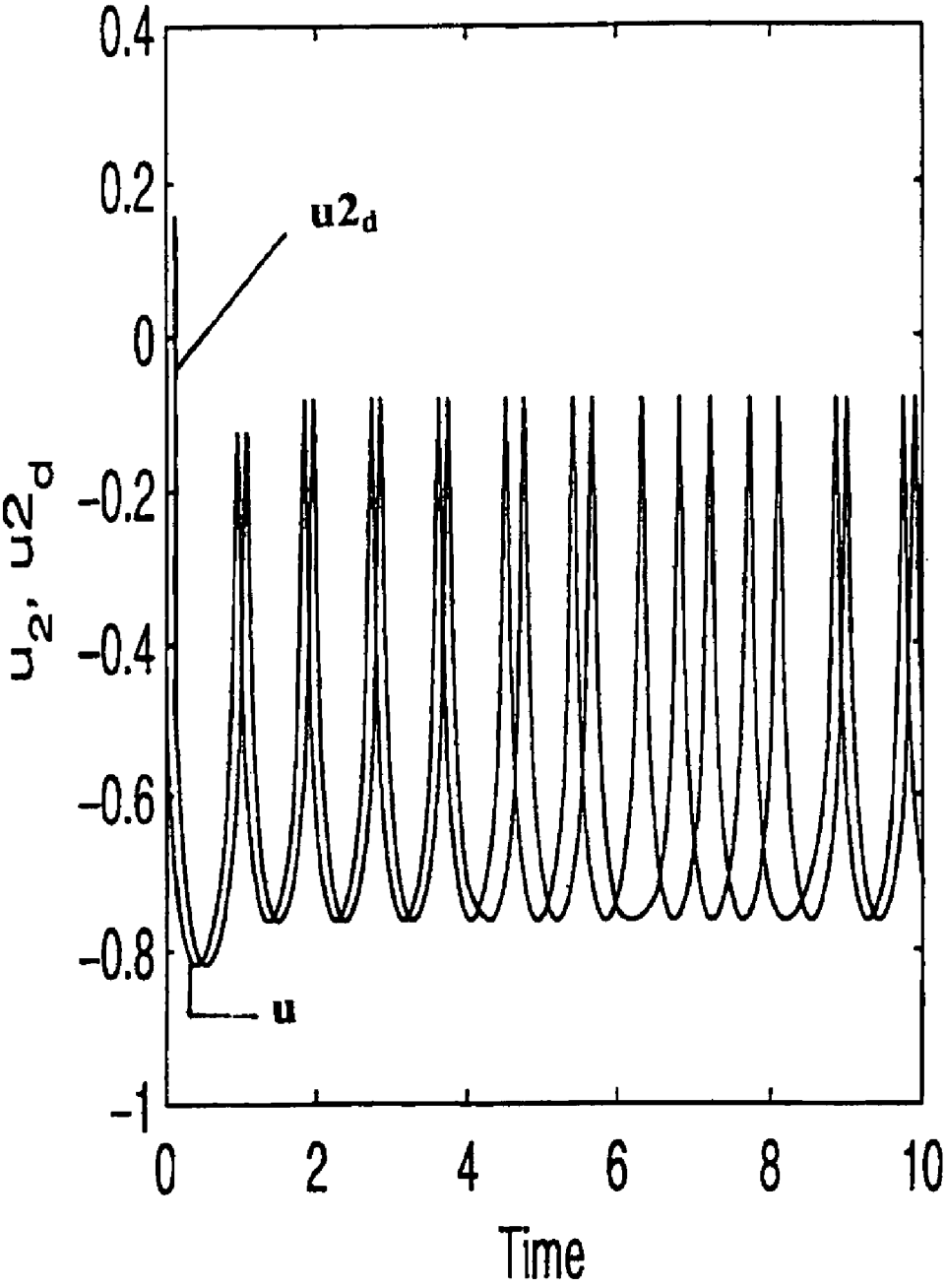
FIG. 11A-11D are each a graph depicting synchronization, plots are of $x_2(t)$ and $x_2(t-t_d)$ for the command inputs of FIG. 1A-1D.
Figure 11B:
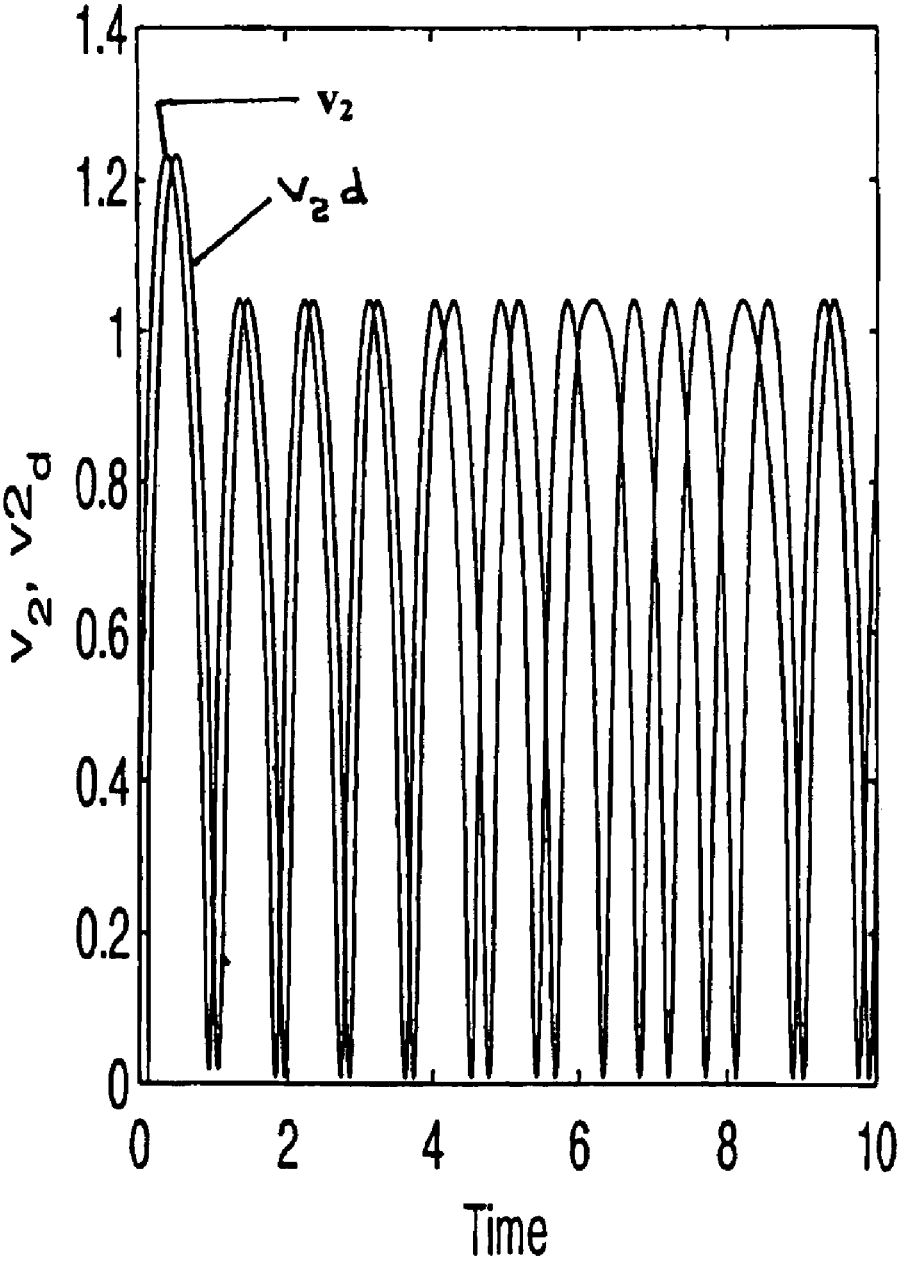
Figure 11C:
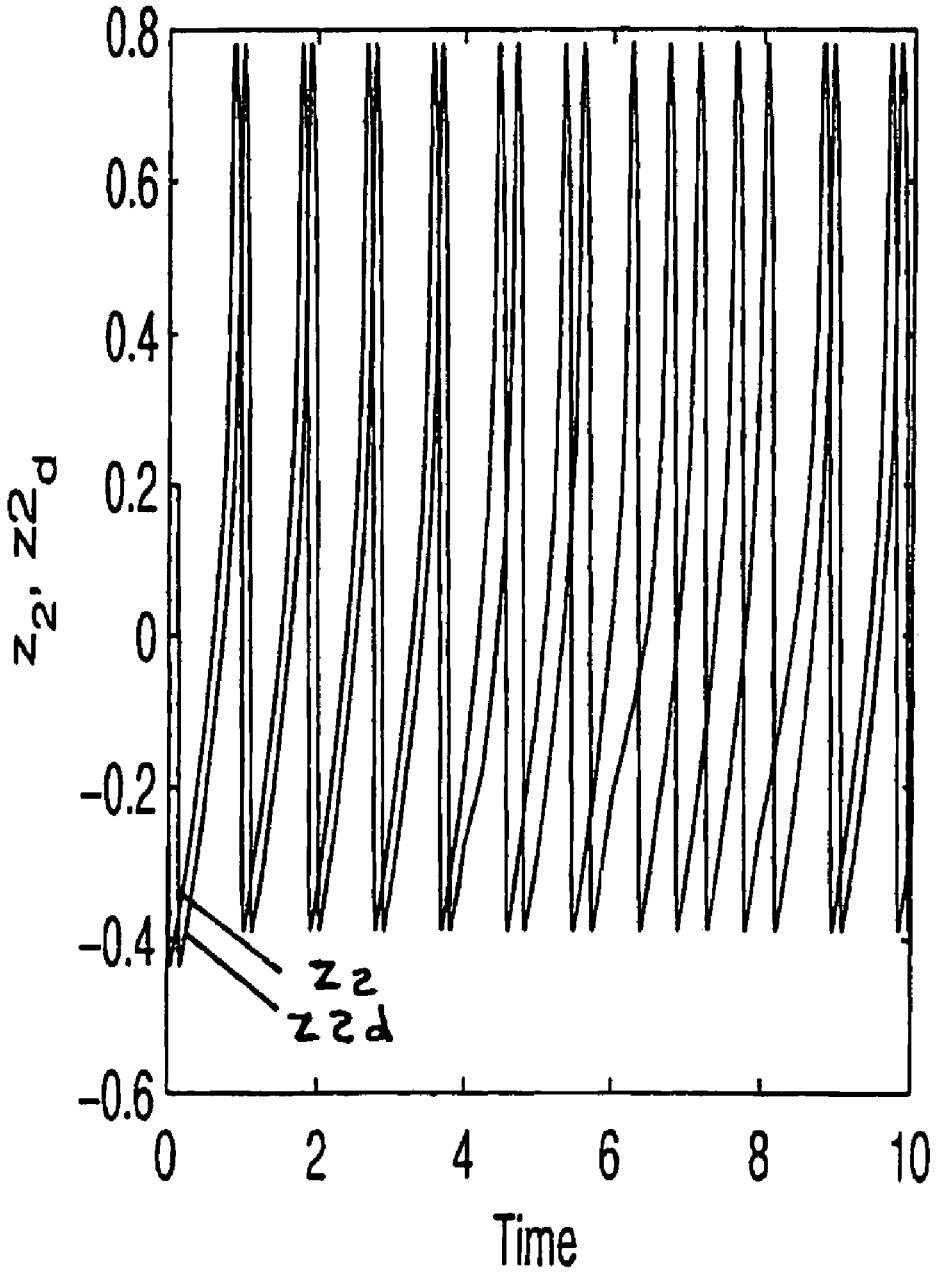
Figure 11D:
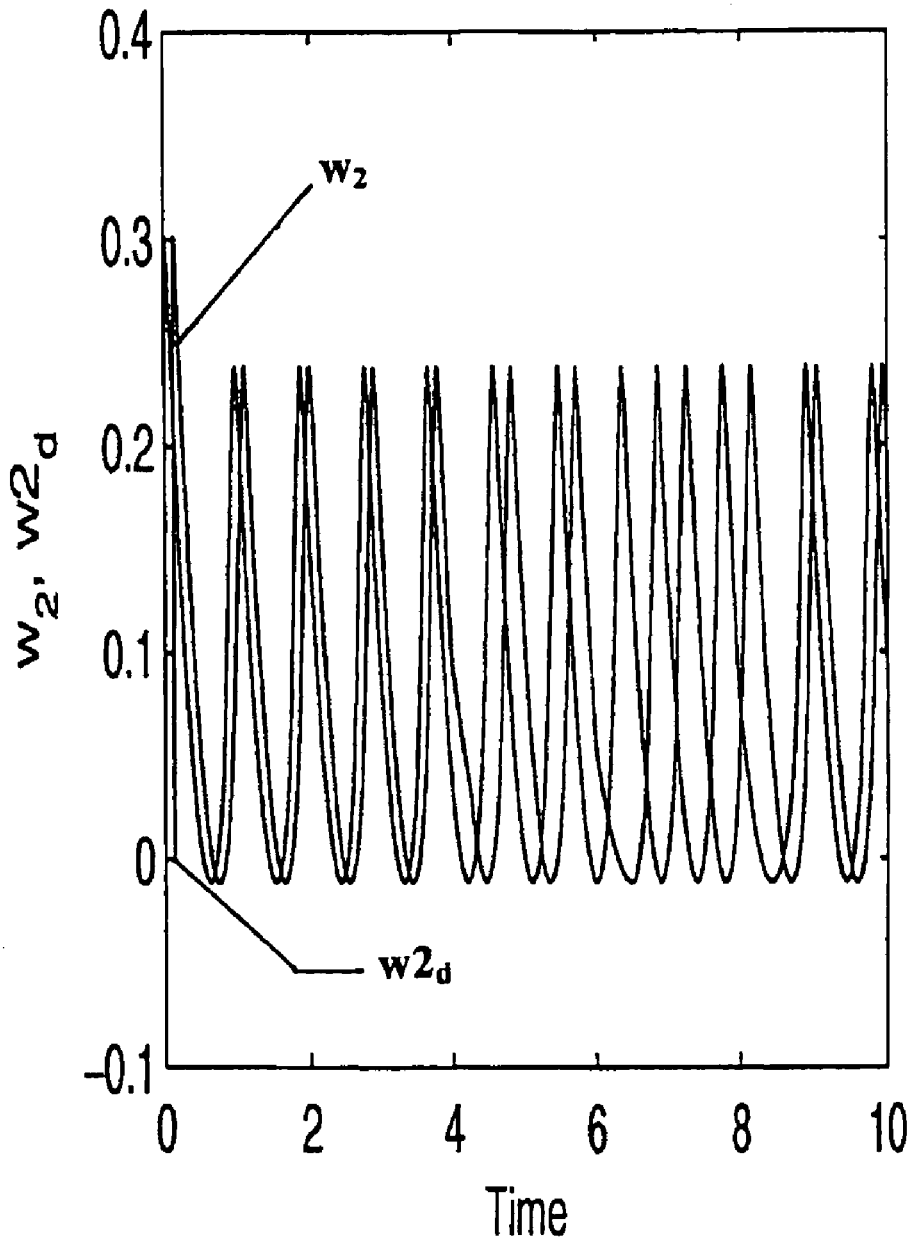
Figure 12A:
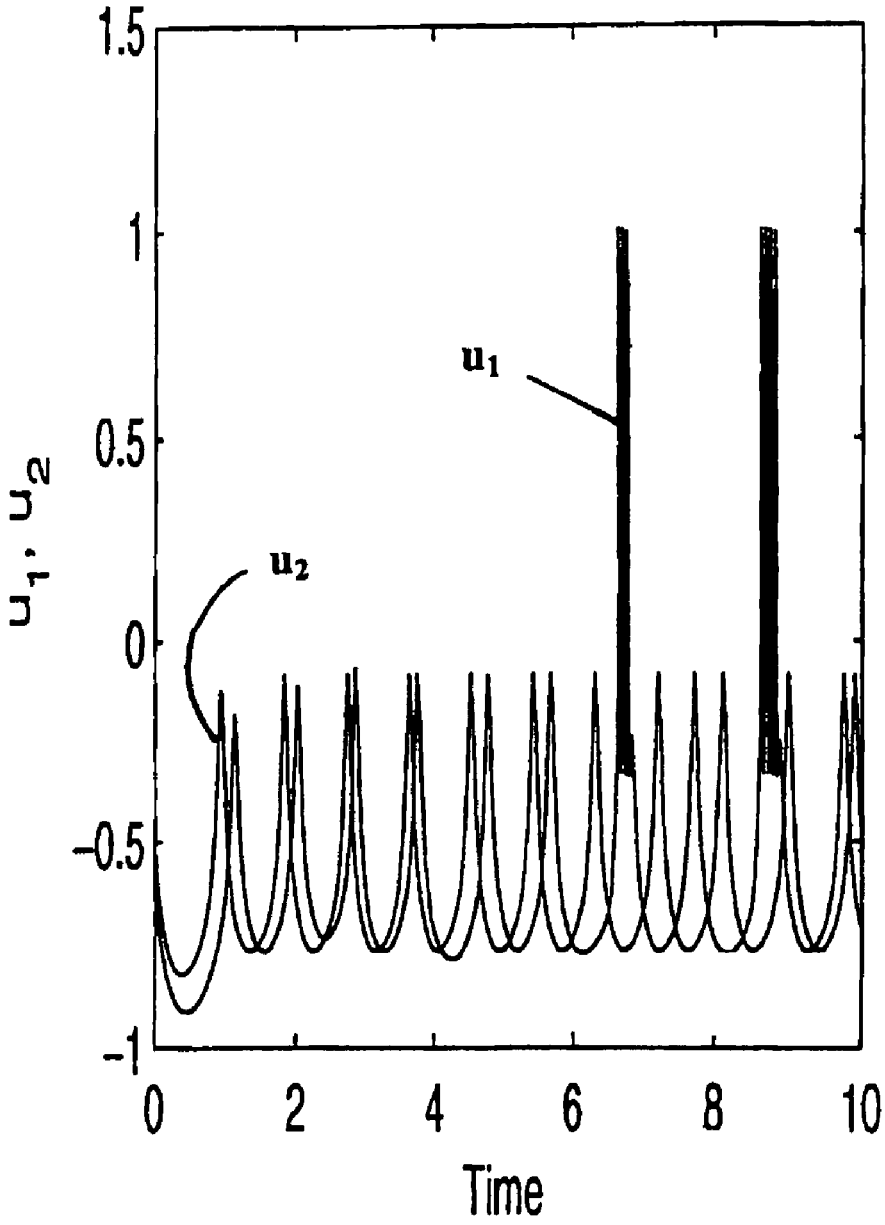
FIG. 12A-12D are each a graph depicting local synchronization using control law $C_W$ (faster oscillation), plots are of $u_1(t)$, $v_1(t)$, $z_1(t)$ and control inputs $I_{ext1}$, $I_{ext2}$ and control inputs for the command inputs of FIG. 1A-1D.
Figure 12B:
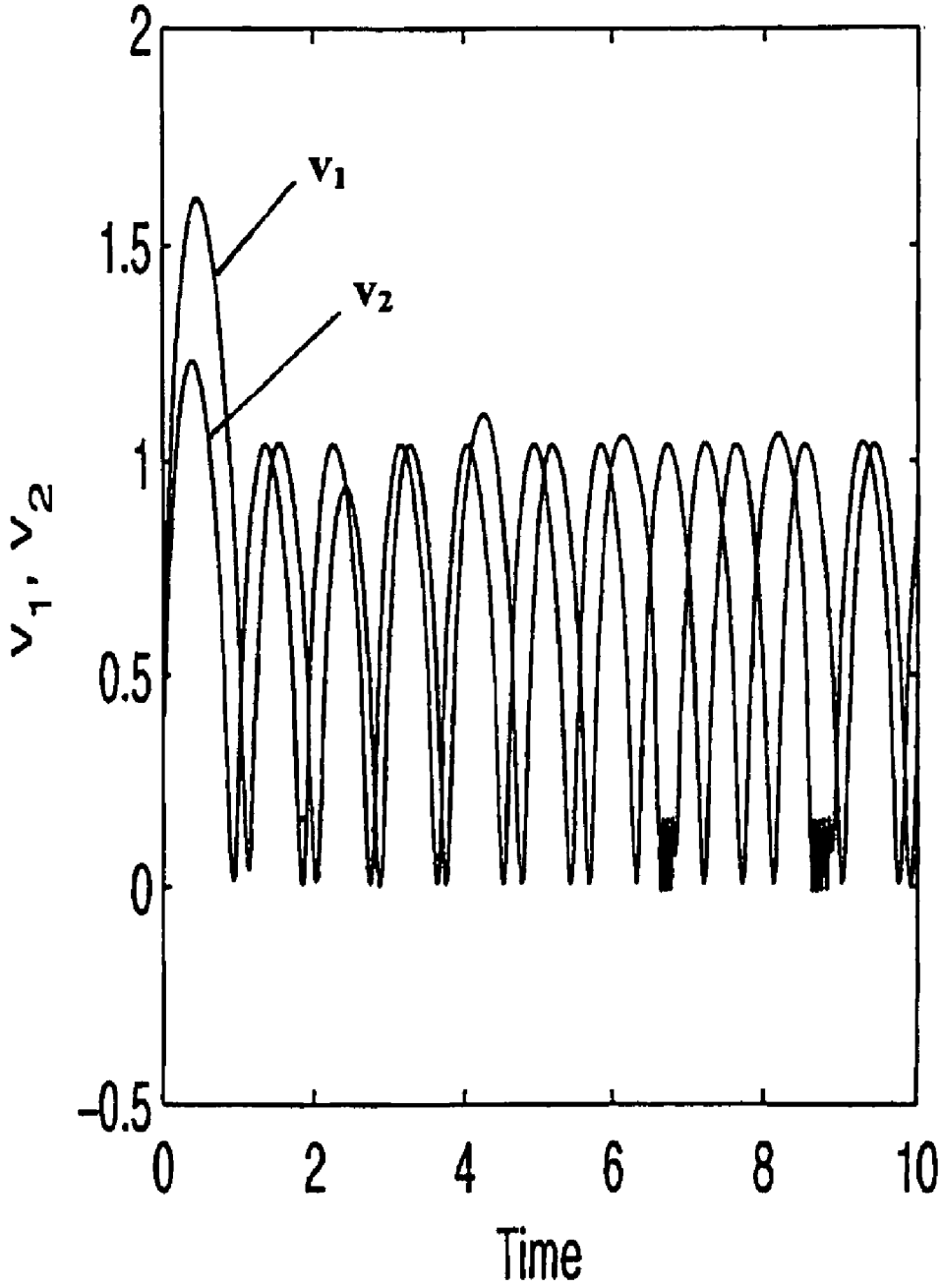
Figure 12C:
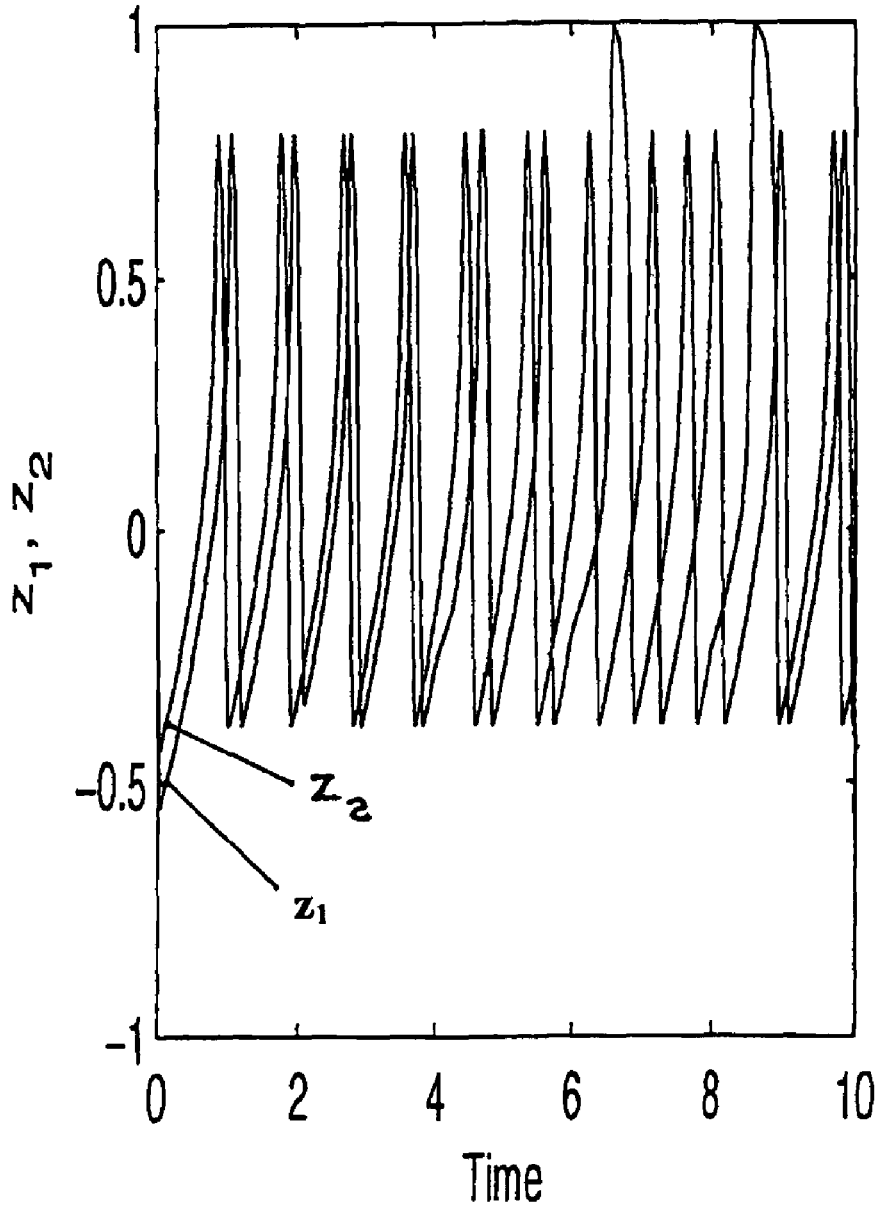
Figure 12D:
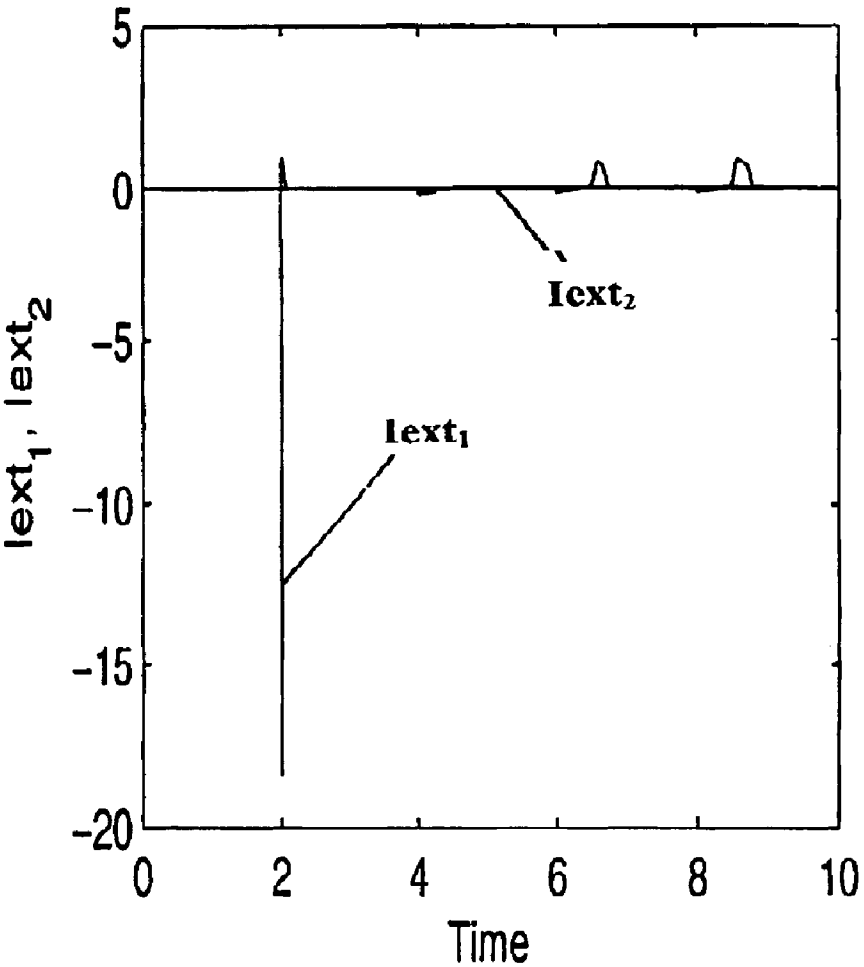

Simulation results are obtained for a different value of the parameter a=0.01 and the time scaling factor is set to 100 giving the frequency of oscillation close to one Hz. The closed-loop control system using each of the control laws $C_u$, $C_v$ and $C_z$ and $C_w$ is simulated. The command input, the feedback gains, and initial conditions of FIG. 1(A)-(D) are retained for simulation. Results are presented only for the closed-loop system including the simplest control law $C_w$. The responses are shown in FIG. 10(A)-(D) through FIG. 12(A)-(D).

It is of interest to discuss the relative merits of the four controllers. As indicated earlier, the first controller has a global stabilization property and for the remaining controllers only local synchronization has been established. It is important to note that only a finite region of stability in the $\tilde{x}$-space exists because the local stability of the closed-loop system including the controllers $C_v$, $C_z$, and $C_w$ has been proven. But it is expected that as the complexity of control law increases, the region of stability enlarges. For this reason, one expects that the control law $C_w$ has been proven. But it is expected that as the complexity of control law increases, the region of stability enlarges. For this reason, one expects that the control law $C_w$ can accomplish synchronization only for relatively small perturbations in $\tilde{x}$ at the instant when the phase command is given. Of course, the error $\tilde{x}$, and therefore the synchronization of the IOs, depends on the instant of controller switching. Based on the simulation results, it has been found that the controllers $C_v$ and $C_z$ have fairly large regions of stability and one does not necessarily have to use the controller $C_u$, which has the highest degree of complexity among the derived controllers. Unlike the global controller, the controllers $C_v$, $C_z$, and $C_w$ provide smoother (z,w)-responses. This is due to the fast-varying nonlinear function of large magnitude in the control law $C_u$. It may be pointed out that there exists flexibility in the design, and by a proper choice of feedback gains and the reference phase command signals, one can obtain different response characteristics. This flexibility in phase control of IOs is useful in performing desirable maneuvers of the BAUV.

In the derivation of the control laws, it is assumed that the IOs are identical. While for the BAUV application, it is appropriate to have similar parameters, it is pointed out that the design approach is quite general, and it is applicable to non-identical IOs having different parameters. The design has been presented only for two IOs, but it is straightforward to extend the derivation for the synchronization of any number of IOs.

Advantages and Disadvantages

The IOs have complex nonlinear dynamics. As such, controllers (PID, optimal, lead-lag compensation, etc.) designed using linearized models cannot guarantee global synchronization. One must note that the profile of the control signal will depend on the states of the IOs when the pulse is applied. The derived controllers are based on the input-output feedback linearization theory, and stability and convergence. The designed global controller accomplishes synchronization for all initial conditions. Moreover, design parameters provide flexibility in shaping response characteristics. The controller can be switched on for phase control at any instant since the controller utilizes state variable feedback and one can command the IO to follow a sequence of phase changed when needed for the control of the BAUV. This is especially important if operating fins of the BAUV operate at low frequencies. The control laws are explicit functions of the state variables of the IOs and can be easily implemented.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A control system for maneuvering an underwater vehicle, said control system comprising:

a propulsor system positioned on the underwater vehicle; and a controller operationally connected to said propulsor wherein said controller is capable recognizing at least two inferior olives wherein a first inferior olive of the inferior olives oscillates in synchronism with a predetermined delay time t and a phase angle corresponding to a second inferior olive of the inferior olives to resolve nonlinear functions in response to disturbances when maneuvering;

wherein the inferior olives are controlled by synchronization of initial conditions of the first inferior olive and the second inferior olive wherein a controlled output variable is chosen as $$e(t)=h_u(x_1(t), x_2(t-t_d))=u_1(t)-u_2(t-t_d)$$

wherein a composite state vector for the inferior olives is defined as $x_a(t)=(x_1(t)^T, x_2(t-t_d)^T \in R^8$ and a vector field is defined by $$L_f h_u(x_a(t)) = \frac{\partial h}{\partial x_a} f(x_a(t)) = \frac{\partial h_u}{\partial x_1} f_1(x_1(t)) + \frac{\partial h_u}{\partial x_2} f_2(x_2(t-t_d));$$

resolving $L_f^i h_u(x_a) = L_f L_f^{j-1} h_u(x_a(t))$ and $$L_g L_f^k h_u(x_a) = \frac{\partial L_f^k h_u}{\partial x_a} g$$

wherein an input-output linearizing control law for the inferior olives programmable to the controller is selected by $$u_{c1} = b_{u1}^{-1}(-a_{u1} - \sum_{j=0}^{3} p_j L_f^j h_u(x_a(t)).$$

2. A method for maneuvering an underwater vehicle, said method comprising the steps of:

providing at least two inferior olives;

resolving $e=h(x_1(t), x_2(t-t_d))$;

choosing an output variable $$e(t)=h_u(x_1(t), x_2(t-t_d))=u_1(t)-u_2(t-t_d);$$

defining a composite state vector for the inferior olives as $$x_a(t)=(x_1(t)^T, x_2(t-t_d)^T \in R^8;$$

defining along a vector field $$L_f h_u(x_a(t)) = \frac{\partial h}{\partial x_a} f(x_a(t)) = \frac{\partial h_u}{\partial x_1} f_1(x_1(t)) + \frac{\partial h_u}{\partial x_2} f_2(x_2(t-t_d));$$

resolving $L_f^i h_u(x_a) = L_f L_f^{j-1} h_u(x_a(t))$ and $$L_g L_f^k h_u(x_a) = \frac{\partial L_f^k h_u}{\partial x_a} g;$$

selecting an input-output linearizing control law $$\text{by } u_{c1} = b_{u1}^{-1}(-a_{u1} - \sum_{j=0}^{3} p_j L_f^j h_u(x_a(t));$$

producing an output equation of the form $$e^{(4)}+p_3e^{(3)}+p_2e^{(2)}+p_1\dot{e}+p_0e=0;$$

synchronizing the inferior olives wherein a first inferior olive of the inferior olives oscillates in synchronism with a delay time corresponding to a desired phase angle with respect to a second inferior olive of the inferior olives;

processing the synchronized inferior olives with a controller; and maneuvering a propulsor of the underwater vehicle with the controller.

3. The method in accordance with claim 2, further comprising the step of obtaining frequencies of the inferior olives by time scaling.

4. A method for controlling an underwater vehicle, said method comprising the steps of:

providing at least two inferior olives;

choosing an output variable for the inferior olives $$e(t)=h_v(x_a(t))=v_1(t)-v_2(t-t_d)=\tilde{v}(t);$$

selecting an input-output linearizing control law by $$u_{c1} = b_{v1}^{-1}\left(-a_{v1} - \sum_{j=0}^{2} p_j L_f^j h_v(x_a(t))\right);$$

determining an output equation $e^{(3)}+p_2e^{(2)}+p_1\dot{e}+p_0e=0$;

choosing gains $p_i$ such that a characteristic polynomial is $$\Pi_v(\lambda)=\lambda^3+p_2\lambda^2+p_1\lambda+p_0;$$

establishing residual dynamics such that an equilibrium point is asymptotically stable;

achieving local synchronization of the inferior olives wherein a first inferior olive of the inferior olives oscillates in synchronism with a delay time corresponding to a desired phase angle with respect to a second inferior olive of the inferior olives in a closed system;

processing the synchronized inferior olives with a controller; and maneuvering a propulsor of the underwater vehicle with the controller.

5. The method in accordance with claim 4, said method further comprising the step of establishing asymptotic stability of the zero dynamics using a center manifold theorem.

6. A method for controlling an underwater vehicle, said method comprising the steps of:

providing at least two inferior olives;

choosing an output variable $e(t)=z_1(t)-z_2(t-t_d)=h_z(x_a)$;

selecting an input-output linearizing control law by $$u_{c1} = b_{z1}^{-1}(-a_{z1} - \sum_{j=0}^{1} p_j L_f^j h_v(x_a(t));$$

determining an output equation $e^{(2)}+p_1\dot{e}+p_0e=0$;

choosing gains $p_i$ such that a characteristic polynomial is $$\Pi_z(\lambda)=\lambda^2+p_1\lambda+p_0;$$

defining a composite state vector for the inferior olives as $$x_a(t)=(x_1(t)^T, x_2(t-t_d)^T \in R^8;$$

establishing residual dynamics wherein an equilibrium point is asymptotically stable;

achieving local synchronization of the inferior olives wherein a first inferior olive of the inferior olives oscillates in synchronism with a delay time corresponding to a desired phase angle with respect to a second inferior olive of the inferior olives in a closed system;

processing the synchronized inferior olives with a controller; and maneuvering a propulsor of the underwater vehicle with the controller.

7. A method for controlling an underwater vehicle, said method comprising the steps of:

providing at least two inferior olives;

choosing an output variable $$e(t)=w_1(t)-w_2(t-t_d)=\tilde{w}=h_w(x_a(t));$$

selecting an input-output control law by $u_{c1}=\tilde{z}(t)+p_0\,\epsilon_{Ca}^{-1}\tilde{w}$ thereby satisfying an output with $\dot{\tilde{w}}+p_0\tilde{w}=0$ and in a closed-loop system $\tilde{w}$ tends to zero;

establishing residual dynamics wherein an equilibrium point is asymptotically stable;

achieving local synchronization of the inferior olives wherein a first inferior olive of the inferior olives oscillates in synchronism with a delay time corresponding to a desired phase angle with respect to a second inferior olive of the inferior olives in the closed system;

processing the synchronized inferior olives with a controller; and maneuvering a propulsor of the underwater vehicle with the controller.

* * * * *